US006334284B1

(12) United States Patent
Provitola

(10) Patent No.: US 6,334,284 B1
(45) Date of Patent: Jan. 1, 2002

(54) STRUCTURAL SYSTEM OF TORSION ELEMENTS AND METHOD OF CONSTRUCTION THEREWITH

(76) Inventor: Anthony Italo Provitola, P.O. Box 2855, DeLand, FL (US) 32721-2855

( * ) Notice: Subject to any disclaimer, the term of this patent is extended or adjusted under 35 U.S.C. 154(b) by 0 days.

(21) Appl. No.: 09/276,666

(22) Filed: Mar. 26, 1999

(51) Int. Cl.[7] ..... E04B 1/24

(52) U.S. Cl. ..... 52/698; 52/712; 52/81.1; 403/389; 403/396

(58) Field of Search ..... 403/389, 385, 403/396; 256/59, 65; 52/698, 712, 81.1

(56) References Cited

U.S. PATENT DOCUMENTS

| | | | | |
|---|---|---|---|---|
| 116,186 A | | 6/1871 | Hershey | |
| 116,187 A | | 6/1871 | Hershey | |
| 122,537 A | | 1/1872 | Saladee | |
| 124,013 A | | 2/1872 | Saladee | |
| 132,695 A | | 10/1872 | Saladee | |
| 1,706,215 A | * | 3/1929 | Davidson | 403/396 |
| 2,767,003 A | * | 10/1956 | Gilmont | 287/54.1 |
| 3,749,429 A | * | 7/1973 | Hauber | 287/54 A |
| 4,027,449 A | | 6/1977 | Alcalde-Civileti | |
| 4,183,190 A | | 1/1980 | Bance | |
| 4,253,284 A | | 3/1981 | Bliss | |
| 4,449,348 A | | 5/1989 | Jacobs | |
| 4,884,790 A | | 12/1989 | Castrilli | |
| 5,715,903 A | * | 2/1998 | Summers et al. | 180/219 |
| 5,718,952 A | | 2/1998 | Zimmerman | |
| 5,888,608 A | | 3/1999 | Tsai | |

* cited by examiner

*Primary Examiner*—Carl D. Friedman
*Assistant Examiner*—Phi Dieu Tran A

(57) ABSTRACT

The present invention is a structural system of torsion elements which are connected in constructions which have the capacity to bear compression, tension and flexion loading by conversion of such loading to torsion loading of the connected torsion elements. The present invention also includes a method of construction using torsion elements.

47 Claims, 75 Drawing Sheets

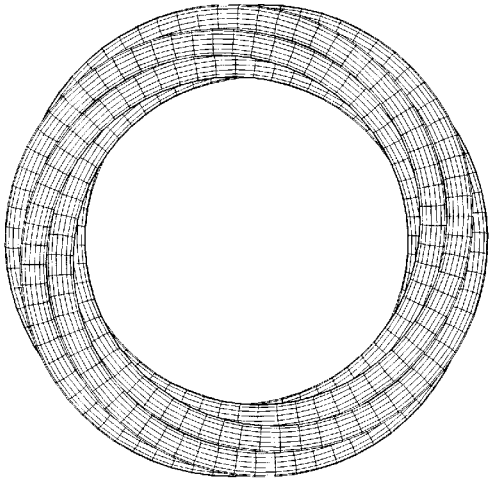
FIG. 138
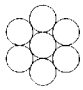
FIG. 139
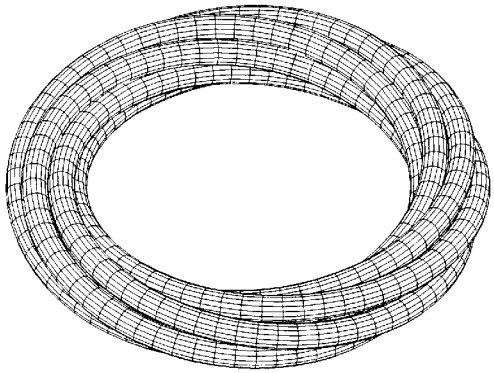
FIG.. 140
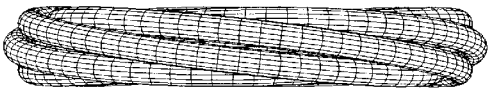
FIG. 141
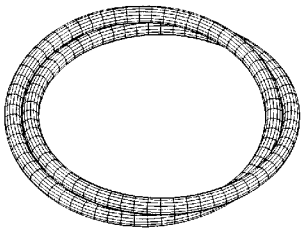
FIG. 142
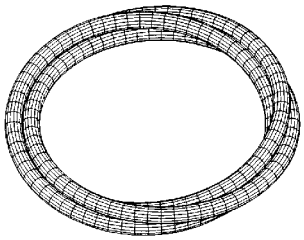
FIG. 143
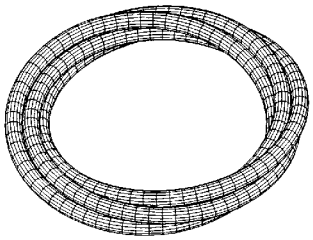
FIG. 144
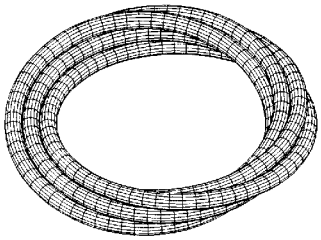
FIG. 145
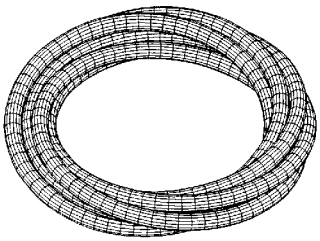
FIG. 146
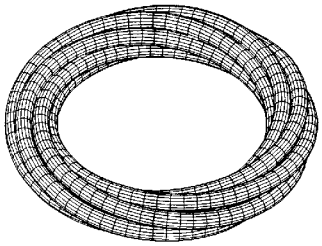
FIG. 147

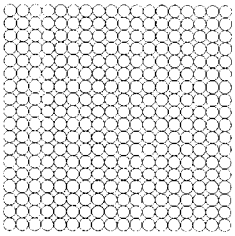
FIG. 381
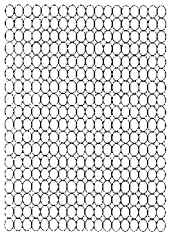
FIG. 382
FIG. 383
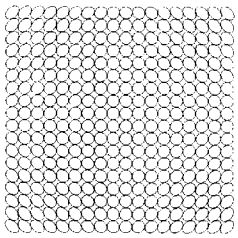
FIG. 384
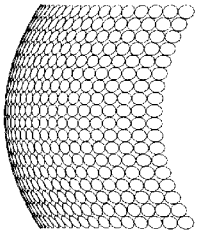
FIG. 385
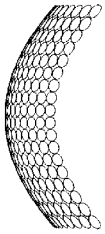
FIG. 386
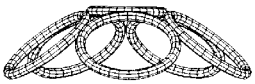
FIG. 387
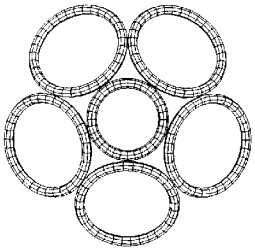
FIG. 388
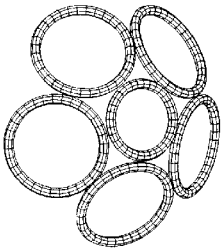
FIG. 389
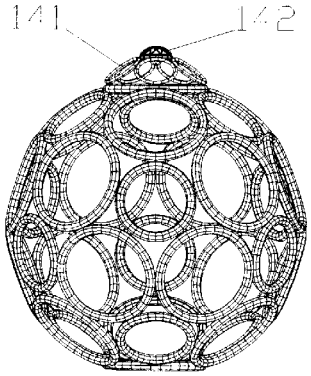
FIG. 390
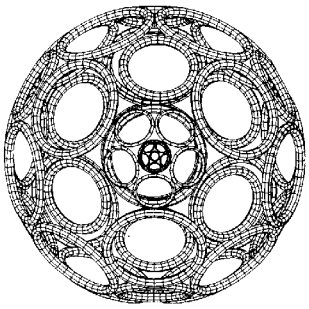
FIG. 391
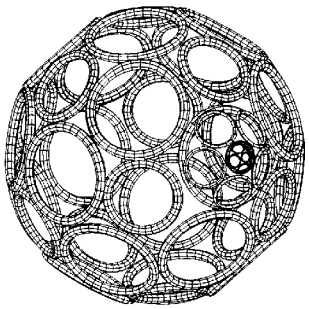
FIG. 392

STRUCTURAL SYSTEM OF TORSION ELEMENTS AND METHOD OF CONSTRUCTION THEREWITH

CROSS-REFERENCE TO RELATED APPLICATIONS

This application is related to an application to be filed by the same inventor immediately subsequent hereto for the invention entitled "Structural System of Toroidal Elements and Method of Construction Therewith", application Ser. No. 09/276,665, by the same inventor filed on Mar. 26, 1999, the same date and immediately after this application, "Structural System of Torsion Elements and Method of Construction Therewith", application Ser. No. 09/276,666. In this connection it is to be noted that the preferred embodiment of the present invention uses the invention entitled "Structural System of Toroidal Elements and Method of Construction Therewith", and the preferred embodiment of the invention entitled "Structural System of Toroidal Elements and Method of Construction Therewith" uses the present invention.

STATEMENT REGARDING FEDERALLY SPONSORED RESEARCH OR DEVELOPMENT

Not Applicable

REFERENCE TO MICROFICHE APPENDIX:

Not Applicable

BACKGROUND OF THE INVENTION

A significant advance in basic structural systems for stationary structures has not occurred since the advent of prestressed and reinforced concrete, structural steel, and the use of cable as a tensional element. There have been some innovative engineering and architectural advances, such as various types of folding structures, tube and ball and other space trusses, and the dymaxion concept. However, none of these advances has escaped the use of conventional structural elements in compression, tension and flexion mode. Although there have been more recent developments in the field of vehicular structure, such as formed sheet rigidification, the fundamental methods have not changed significantly from the rigid rib, stringer, and truss design. The present invention is a significant advance in structural systems, both stationary and moveable, with respect to weight, strength, flexibility and magnitude.

There does not appear to be any prior art that this invention builds upon except generally in the field of structural engineering, none of which directly addresses structural combinations of torsion elements. Torsion loading is generally treated by practitioners of the art as the nemesis of conventional structural elements, and is generally not managed as the principal function of structural elements.

The patent classification system does not contain a classification for structural systems as such, the most appropriate description of the present invention, but does address specific types of structures, such as "static structures" (Class 52), "bridges" (Class 14), "railway rolling stock" (105/396+), "ships" (114/65+), "aeronautics" (244/117+), "land vehicles: bodies and tops" (296/) etc. There are also no classifications for structures which are dynamic in managing the stress of structural elements or for structures which can dynamically change shape or volume. The latter of these may be addressed to a certain extent in Class/Subclass 52/109, which allows for the extension and retraction of a structure by the use of pivotted diagonal levers, or in Class/Subclass 52/160, which covers closures and other panels made of flexible material. With respect to torsion devices, no structural classification could be found, the classifications being restricted to springs, etc. Therefore, at least with respect to the extent that the classification system may reveal such, there does not appear to be prior art described therein. However, there are some superficial graphic similarities involving shapes and forms to be found in certain patents that claim inventions that are confined to specific structural forms or other classes entirely.

There are two United States Patents that disclose structures that utilize ring or circular elements. One is the Ring Structure disclosed by U.S. Pat. No. 4,128,104 which is "a structural framework composed of ring members intersecting one another in a particular manner". That disclosure does not specify any utilization of torsion loading of the ring members. The other is the Modular Dome Structure, U.S. Pat. No. 3,959,937, which is comprised of "ring-shaped" elements of equal size which form a dome when connected in a particular manner. That disclosure is restricted to "improved building construction for domes or other spherical frames", does not teach a universal structural system, and does not specify any utilization of torsional strength of materials or loading.

Otherwise, there does not appear to be any prior art involving the structural use of elements which are designed to bear loads in torsion mode.

BRIEF SUMMARY OF THE INVENTION

The present invention is a structural system which employs "torsion elements" which are connected to form structures, and a method of construction therewith. The term "torsion element" used in this disclosure means a structural element that functions with torsion as its principal load bearing mode. Torsion elements use the torsional strength of materials and have the capacity to bear the torsion loads distributed to them by the structural system of which they are a part. The structural system converts most compression, tension and flexion loading of constructions using the system to torsional loading of the torsion elements of which the constructions are comprised. It is thus the principal object of the structural system which is the present invention that torsion elements bear as torsional load the greatest part of the entire load placed on the structures of which they are a part, and evenly distribute such loading among the connected torsion elements of which the structures are comprised. The present invention contemplates that structures comprised of connected torsion elements may be incorporated in yet other structures that also have conventional structural elements which are designed to bear compression, tension and flexion loads in conjunction with torsion elements.

The preferred embodiment of the present invention employs torsion elements which are toroidal in shape. These toroidal elements may be used to create new structural forms for both stationary and moveable structures. Some of the structural forms can be applied to construct buildings for unstable foundation conditions and which can survive foundation movement and failure. The use of toroidal torsion elements may also be applied to create structures which are dynamic, with the constituent elements capable of movement by design, not only by deflection as a result of loading, but also by the active management of structural stresses. Toroidal torsion elements may also be varied in shape dynamically so as to achieve alteration of the shape, size and volume of the structure of which they are constituent. The use of the invention includes every conceivable structure, from the smallest to the largest, nanostructures, bridges, towers, furniture, aircraft, land and sea vehicles, appliances, instruments, buildings, spacecraft, and planetary and space habitats.

The method of construction of structures using the present invention is also disclosed through numerous drawings of combinations and arrays of connected torsion elements.

BRIEF DESCRIPTION OF THE DRAWINGS

FIG. 120 is a perspective view of a toroidal element the tube of which is comprised of 18 coaxial toroidal elements, the tubes of which are bonded, bound or otherwise connected to one another.

FIG. 121 is a cross section of the tube of the toroidal element shown in FIG. 120.

FIG. 122 is a plan view of a toroidal element with a circular spiral tube.

FIG. 123 is a perspective view of the toroidal element shown in FIG. 122.

FIG. 124 is a side view of the toroidal element shown in FIG. 123.

FIG. 125 is a plan view of a toroidal element with a rounded rectangle spiral tube.

FIG. 126 is a perspective view of the toroidal element in FIG. 125.

FIG. 127 is a perspective view of a toroidal element comprised of a spiral tube toroidal element as shown in FIG. 122 which encloses another toroidal element within the spiral tube.

FIG. 128 is a perspective view of a toroidal element with a circular spiral tube as shown in FIG. 122 the tube of which is bordered by other coaxial toroidal elements of lesser tubular diameter which are bonded, bound or otherwise connected to the central toroidal element.

FIG. 129 is a perspective view of a toroidal element comprised of a toroidal element as shown in FIG. 87 which encloses another toroidal element within its tube.

FIG. 130 is a perspective view of a toroidal element as shown in FIG. 87 the tube of which is bordered by other toroidal elements of lesser tubular diameter which are bonded, bound or otherwise connected to the central toroidal element.

FIG. 131 is a perspective view of a toroidal element as shown in FIG. 129 the tube of which is bordered by other toroidal elements of lesser tubular diameter which are bonded, bound or otherwise connected to the central element.

Figure 87:
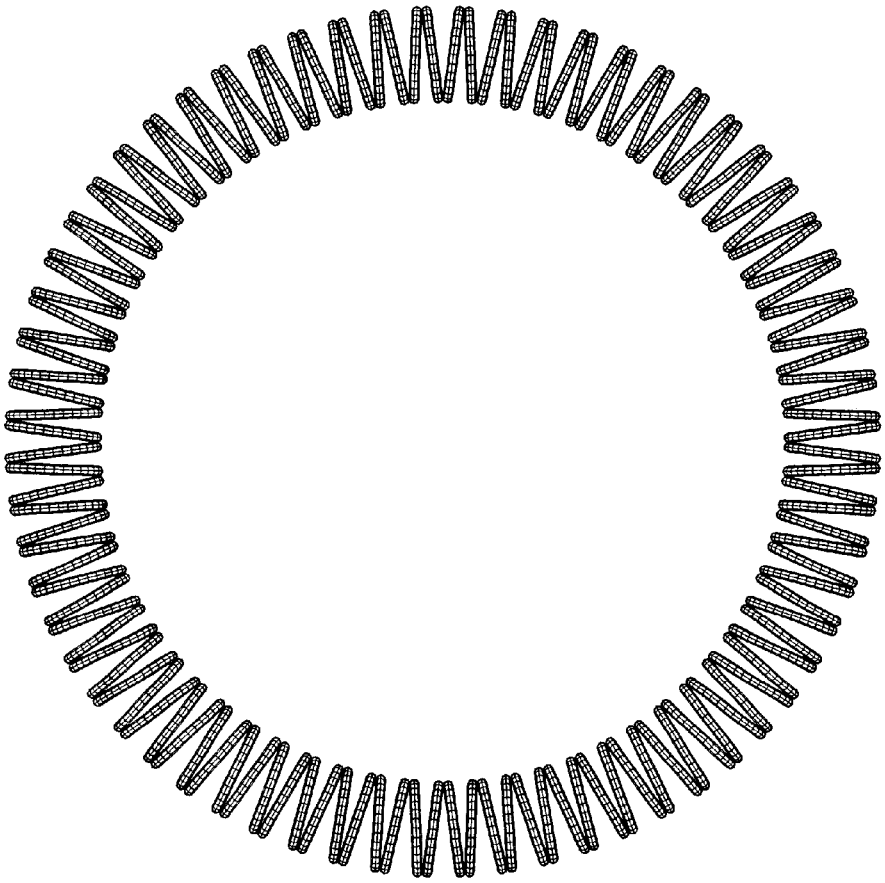
FIG. 87 is a plan view of 64 pairs of angularly connected toroidal torsional elements connected in a circular array forming a toroid.
Figure 132:
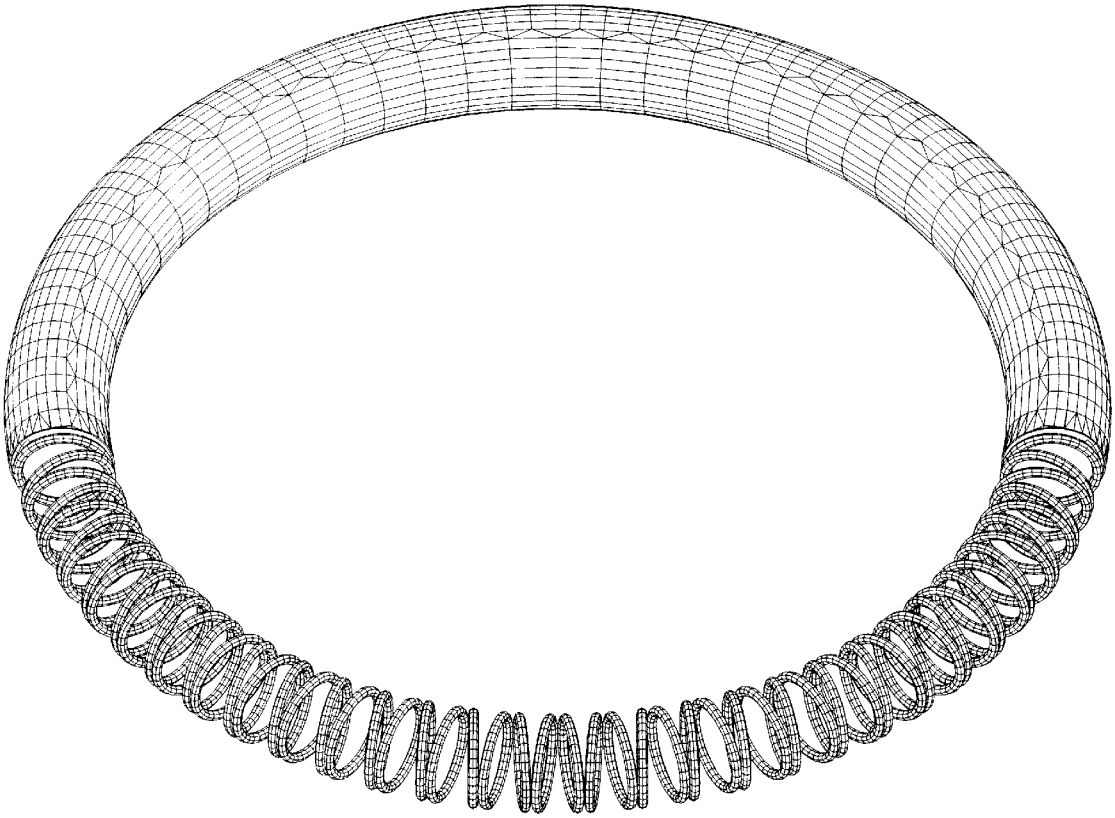

FIG. 132 is a cutaway perspective view of a toroidal element comprised of a toroid as shown in FIG. 87 the tube of which is sheathed by the tube of another toroidal element, which may be bonded, bound or otherwise connected to the central element.

Figure 133:
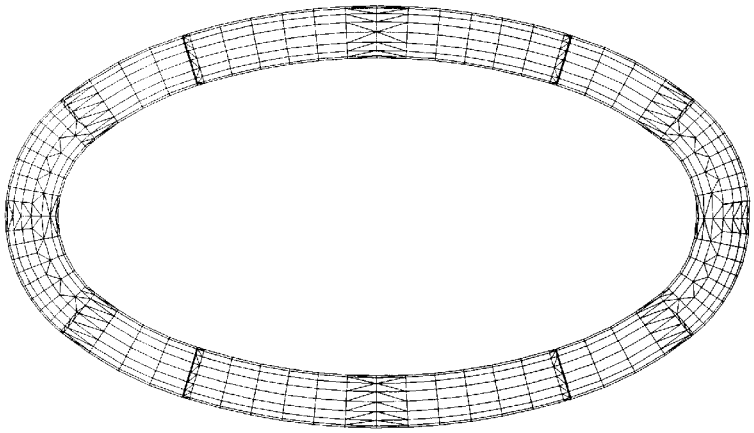

FIG. 133 is a plan view of a elliptical toroidal element.

Figure 134:
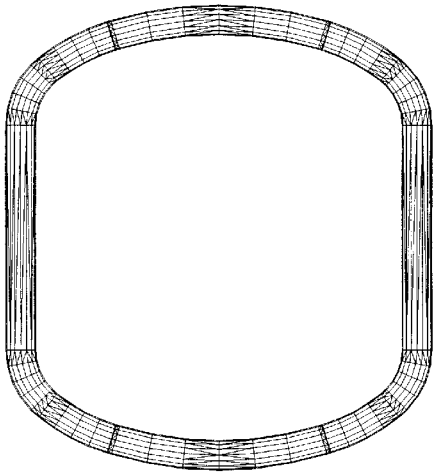

FIG. 134 is a plan view of a toroidal element with two opposite semi-elliptical sides and two opposite straight sides.

Figure 135:
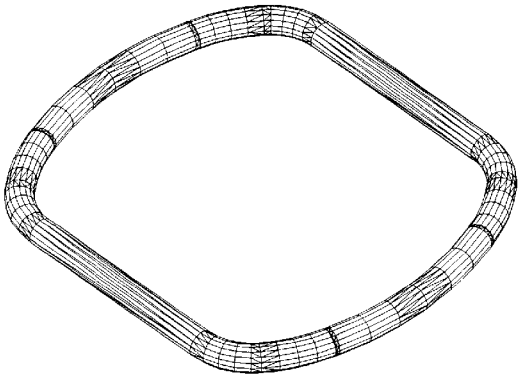

FIG. 135 is a perspective view of the toroidal element in FIG. 134.

Figure 136:
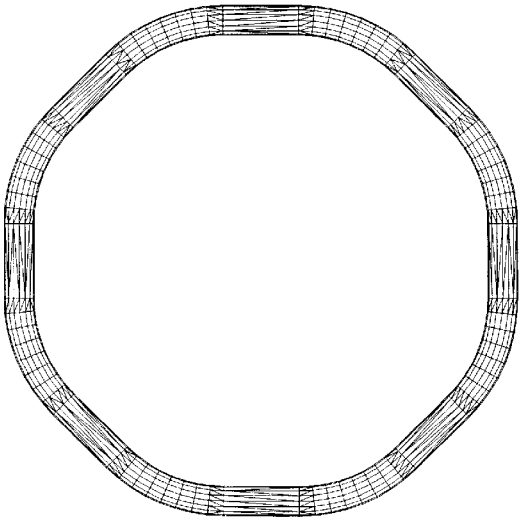

FIG. 136 is a plan view of a rounded octagon toroidal element.

Figure 137:
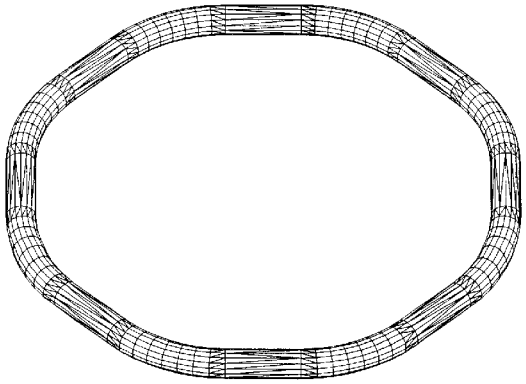

FIG. 137 is a perspective view of the toroidal element in FIG. 136.

FIG. 138 is a plan view of a toroidal element consisting of seven interlinked toroidal elements, the tubes of which may be bonded, bound or otherwise connected to one another.

FIG. 139 is a cross section of the toroidal element in FIG. 138.

FIG. 140 is a perspective view of the toroidal element in FIG. 138.

FIG. 141 is a side view of the toroidal element in FIG. 138.

FIGS. 142 through 147 show the method of interlinkage in 6 steps which produces the toroidal element in FIG. 138.

Figure 81:
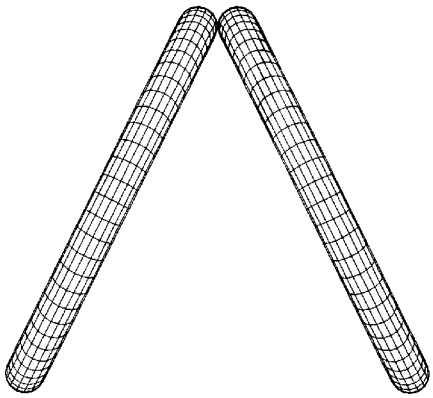
FIG. 81 is a side view of the toroidal torsion elements in FIG. 80.
Figure 148:
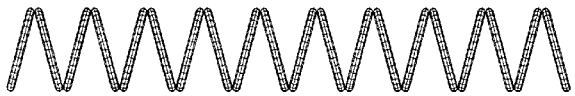

FIG. 148 is a side view of a plurality of pairs of toroidal elements as shown in FIG. 81 connected in a linear array to form a straight cylindrical rod, post or tube.

Figure 149:
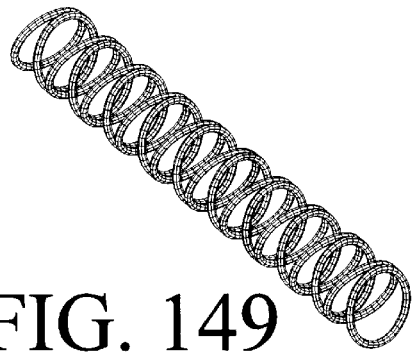

FIG. 149 is a perspective view of the linear array shown in FIG. 148.

Figure 82:
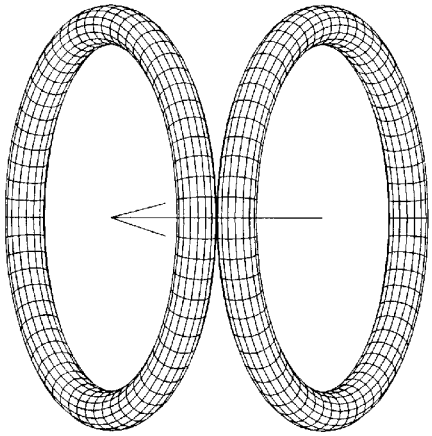
FIG. 82 is a plan view of the toroidal torsion elements in FIG. 80.
Figure 83:
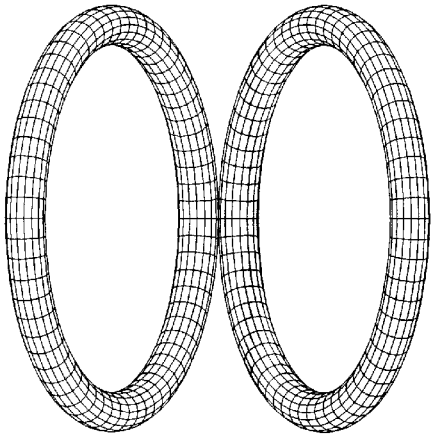
FIG. 83 is a bottom view of the toroidal torsion elements in FIG. 80.
Figure 150:
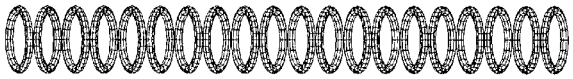

FIG. 150 is a side view of a plurality of pairs of toroidal elements with the orientation shown in FIG. 82 connected in a linear array to form a straight cylindrical rod, post or tube.

Figure 151:
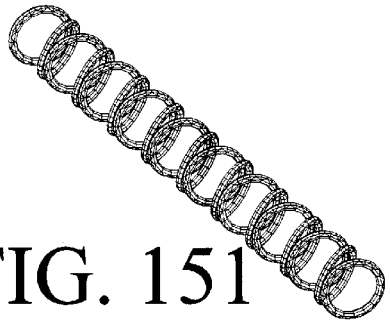

FIG. 151 is a perspective view of the linear array shown in FIG. 150.

Figure 152:
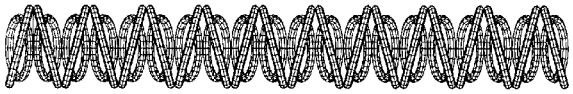

FIG. 152 is a side view of the linear array shown in FIG. 148 which coaxially encloses the linear array shown FIG. 150.

Figure 153:
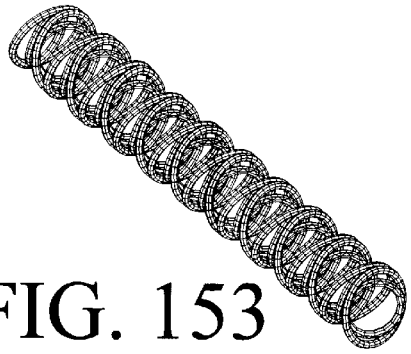
Figure 154:
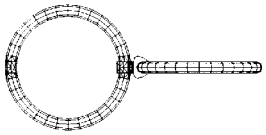
Figure 155:
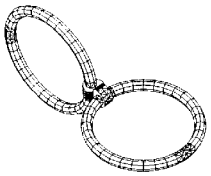
Figure 156:
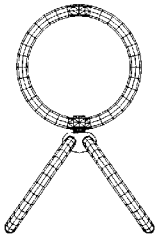
Figure 157:
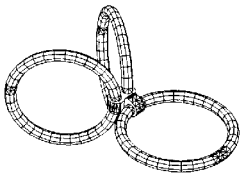
Figure 158:
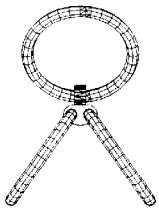
Figure 159:
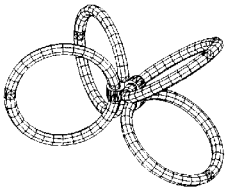
Figure 160:
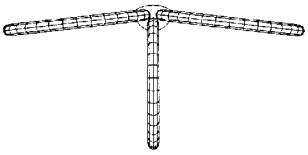
Figure 161:
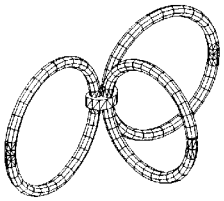
Figure 162:
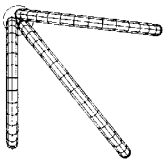
Figure 163:
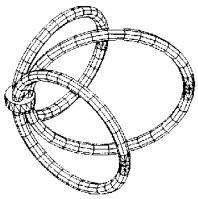
Figure 164:
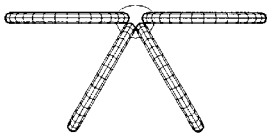
Figure 165:
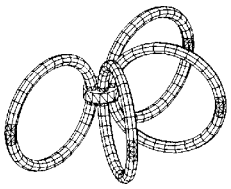
Figure 166:
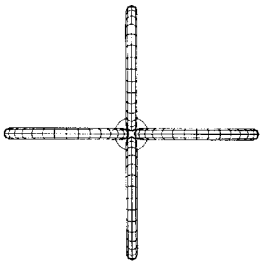
Figure 167:
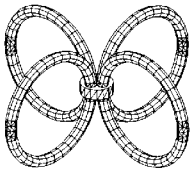

FIG. 153 is a perspective view of the coaxial linear arrays shown in FIG. 152.

FIGS. 154 through 167 show various connections between toroidal elements (even numbered showing the plan view and odd numbered showing a perspective view).

Figure 168:
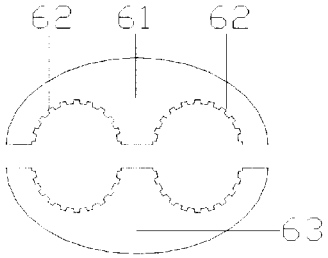
Figure 169:
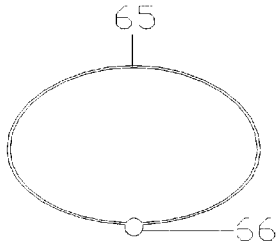
Figure 170:
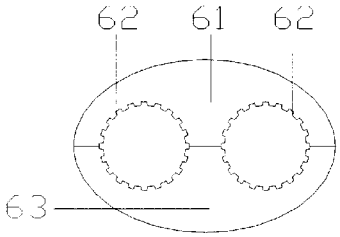

FIGS. 168, 169, and 170 are plan views of a coupling with splined grips for connecting two elements showing, respectively, the coupling open, the coupling compression band, and the coupling closed.

Figure 171:
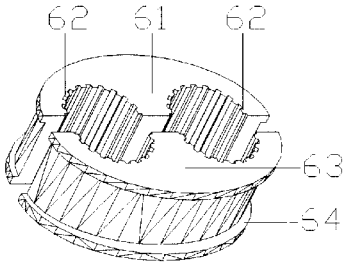
Figure 172:
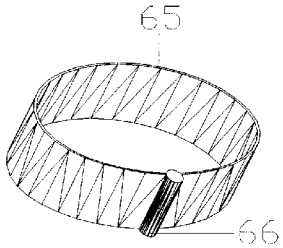
Figure 173:
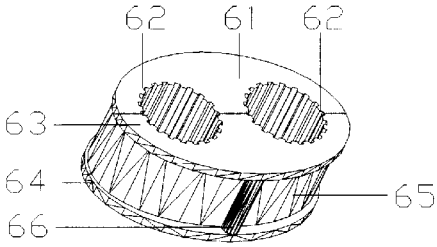

FIGS. 171, 172, and 173 are perspective views of a coupling with splined grips showing for connecting two elements showing, respectively, the coupling open, the compression band, and the coupling closed with the compression band applied.

Figure 174:
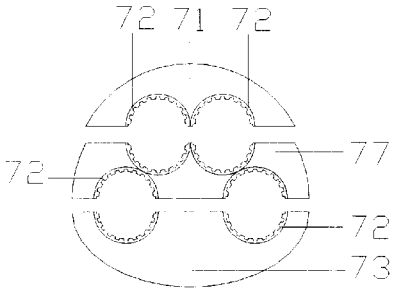
Figure 175:
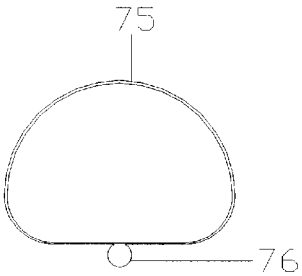
Figure 176:
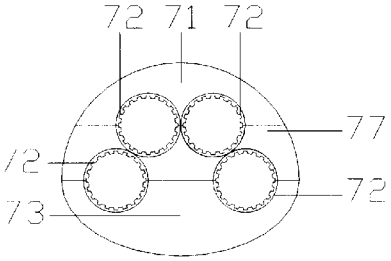

FIGS. 174, 175, and 176 are plan views of a coupling with splined grips for connecting four elements showing, respectively, the coupling open, the coupling compression band, and the coupling closed.

Figure 177:
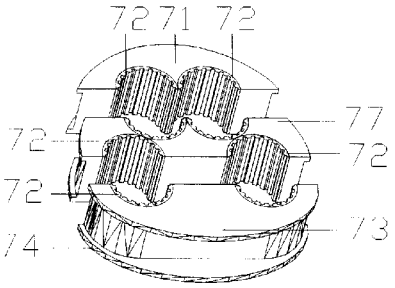
Figure 178:
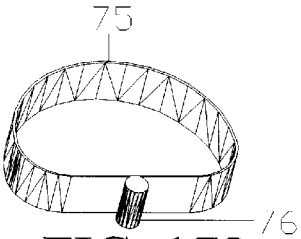
Figure 179:
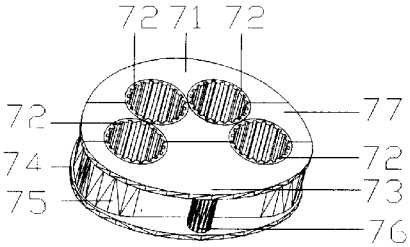
Figure 180:
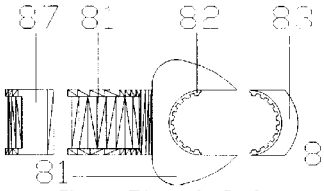
Figure 181:
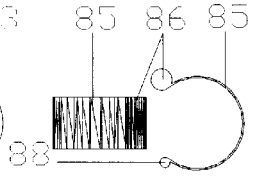
Figure 182:
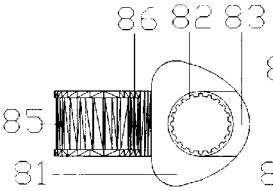
Figure 183:
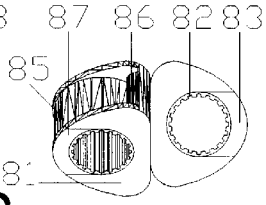
Figure 184:
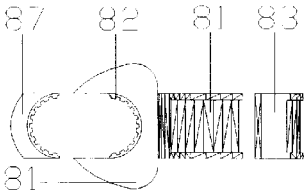
Figure 185:
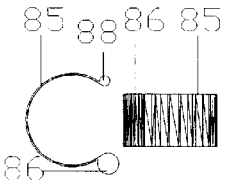
Figure 186:
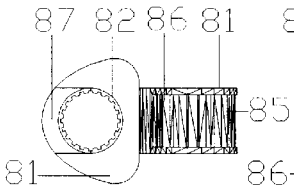
Figure 187:
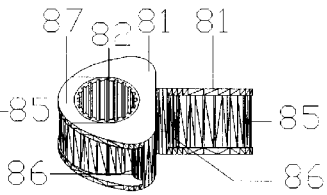
Figure 188:
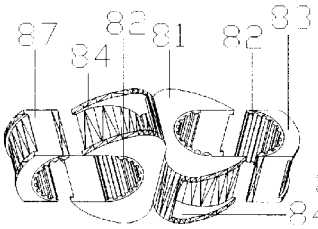
Figure 189:
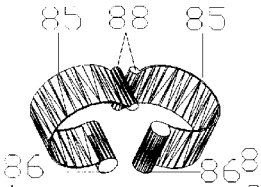
Figure 190:
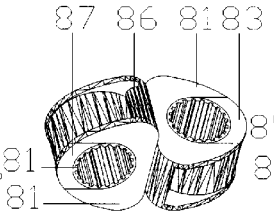
Figure 191:
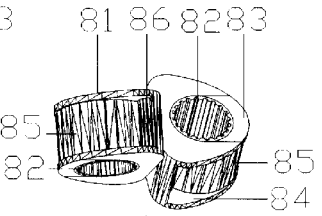

FIGS. 177, 178, and 179 are perspective views of a coupling with splined grips showing for connecting four elements showing, respectively, the coupling open, the compression band, and the coupling closed with the compression band applied.

FIGS. 180, 181, 182, and 183 are plan views of a coupling with splined grips for connecting two axially askew toroidal elements showing respectively, the coupling open, the compression bands, the coupling closed with compression bands applied, and the coupling with an arbitrary angle between the grip axes (also with compression bands applied).

FIGS. 184, 185, 186, and 187 are side views of a coupling with splined grips for connecting two axially askew toroidal elements showing respectively, the coupling open, the compression bands, the coupling closed with compression bands applied, and the coupling with an arbitrary angle between the grip axes (also with compression bands applied).

FIGS. 188, 189, 190, and 191 are perspective views of a coupling with splined grips for connecting two axially askew toroidal elements showing, respectively, the coupling open, the compression bands. the coupling closed with compression bands applied, and the coupling with an arbitrary angle between the grip axes (also with compression bands applied).

Figure 192:
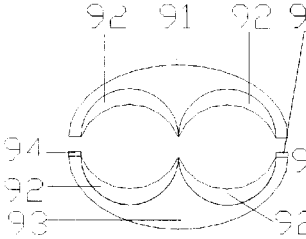
Figure 194:
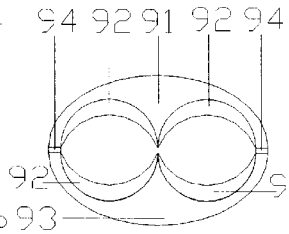

FIGS. 192 and 194 are plan views of a two element coupling with compression foam grips for connecting two elements showing, respectively, the coupling open and the coupling closed.

Figure 193:
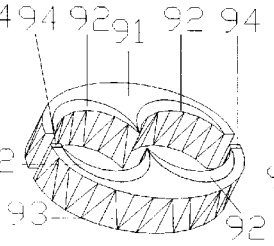
Figure 195:
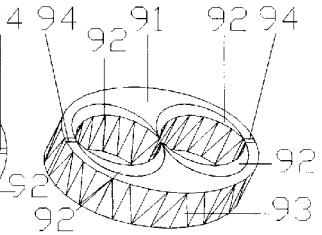
Figure 196:
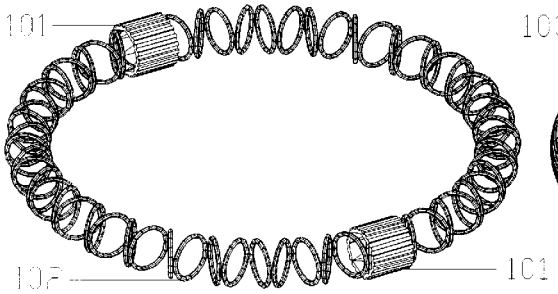
Figure 197:
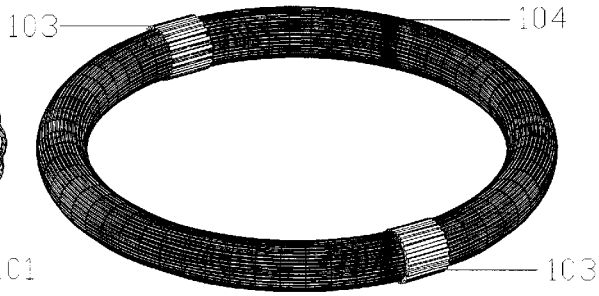
Figure 198:
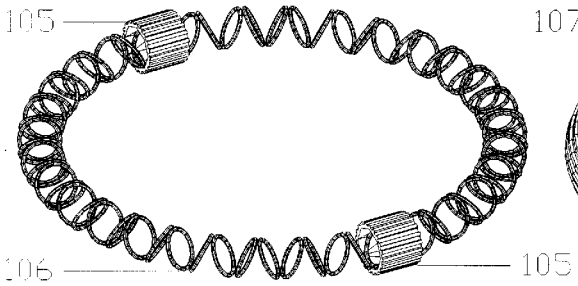
Figure 200:
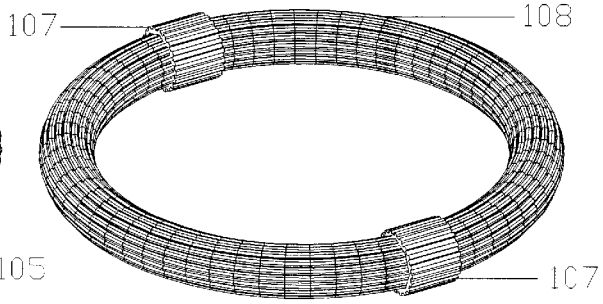

FIGS. 193 and 195 are perspective views of a two element coupling with compression foam grips for connecting two elements showing, respectively, the coupling open and the coupling closed.

FIGS. 196–198, 200 are perspective views of a toroidal elements as shown in FIGS. 86, 113, 99, and 120 respectively with two spline collars on opposite sides of the element bonded to the toroidal elements of which they are comprised.

Figure 201:
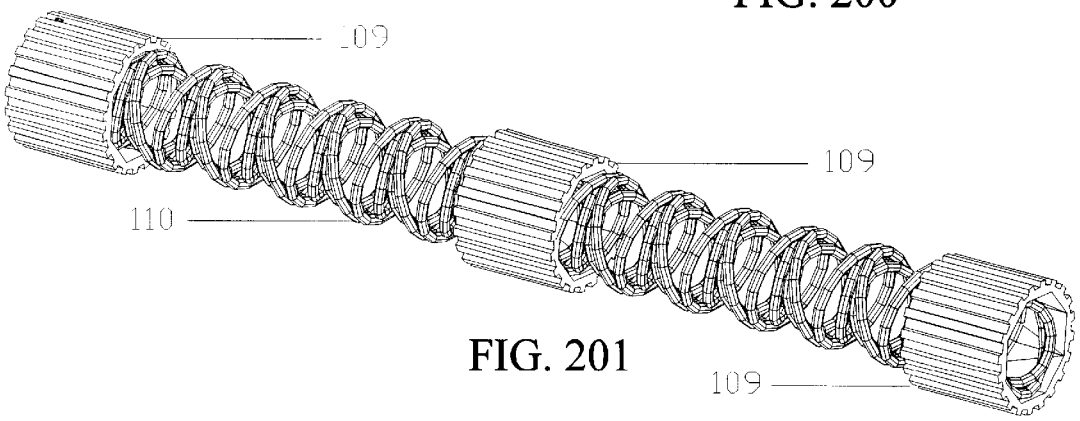

FIG. 201 is a perspective view of the linear array as shown in FIG. 152 with three spline collars bonded to toroids which comprise the element.

Figure 202:
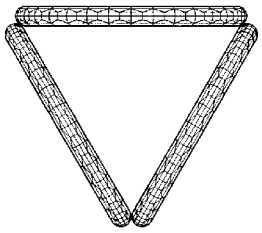

FIG. 202 is a side view of a structural module comprised of three toroidal elements connected to form a triangle.

Figure 203:
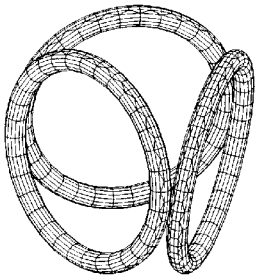

FIG. 203 is a perspective view of the structural module shown in FIG. 202.

Figure 204:
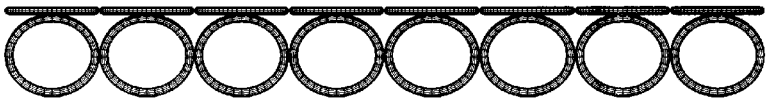

FIG. 204 is a side view linear array of 8 of the structural modules shown in FIG. 202 forming the structure of a post, beam or rod with triangular cross section.

Figure 205:
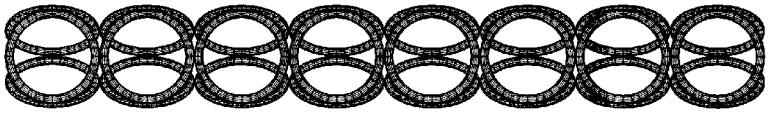

FIG. 205 is a top view of the linear array shown in FIG. 204.

Figure 206:
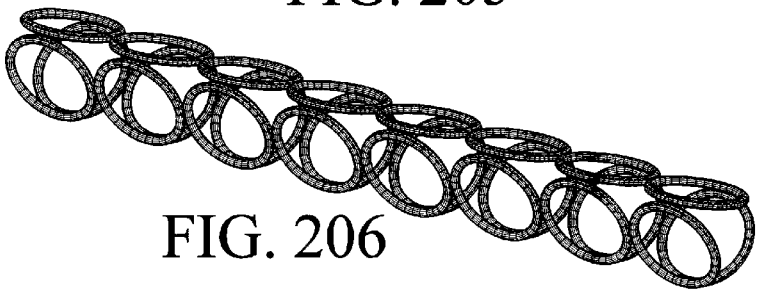

FIG. 206 is a perspective view of the linear array shown in FIG. 204.

Figure 207:
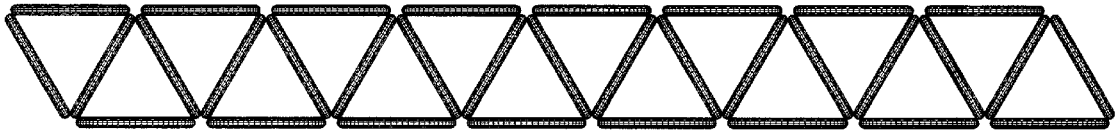

FIG. 207 is a side view of another linear array of 8 of the modules shown in FIG. 202 forming a truss-like structure.

Figure 208:
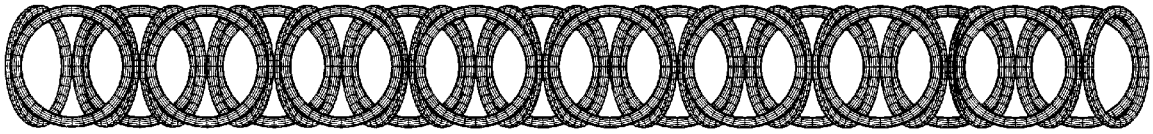

FIG. 208 is a top view of the linear array shown in FIG. 207.

Figure 209:
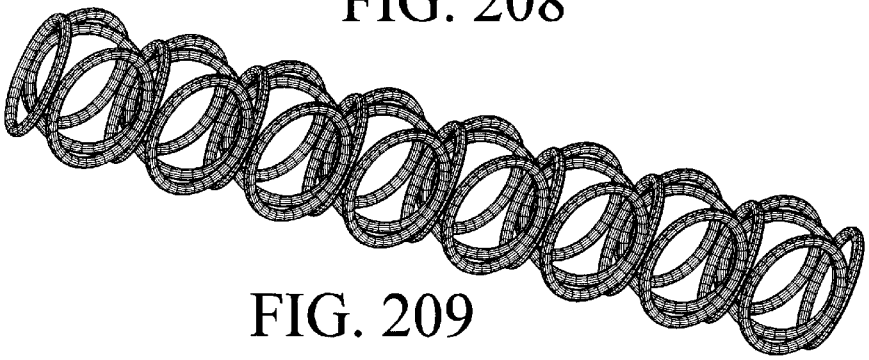

FIG. 209 is a perspective view of the linear array shown in FIG. 207.

Figure 210:
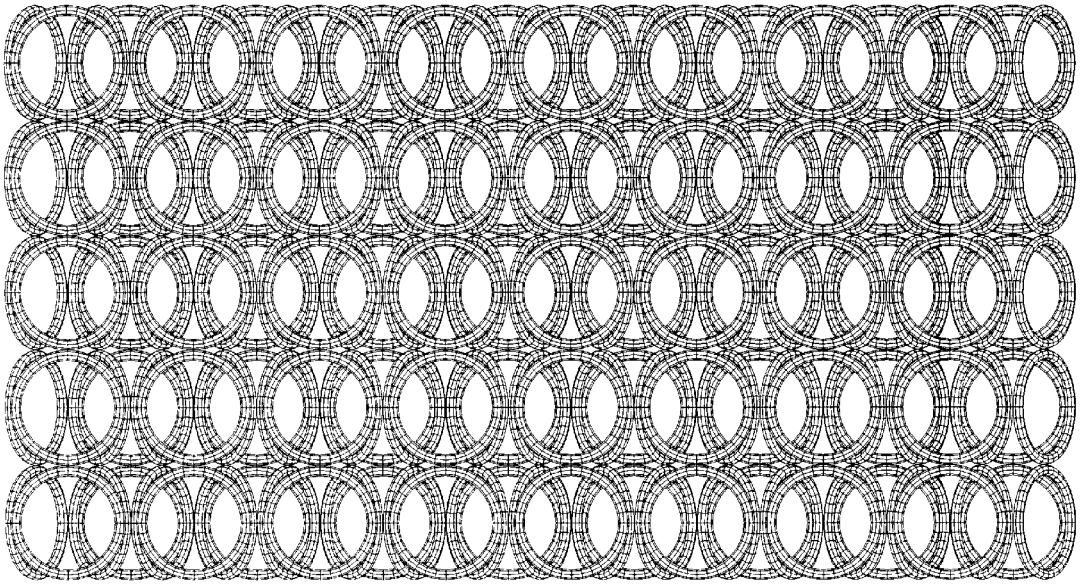

FIG. 210 is a plan view of a 5 wide array of the linear array shown in FIG. 208 to form the structure of a sheet, plate or deck.

Figure 211:
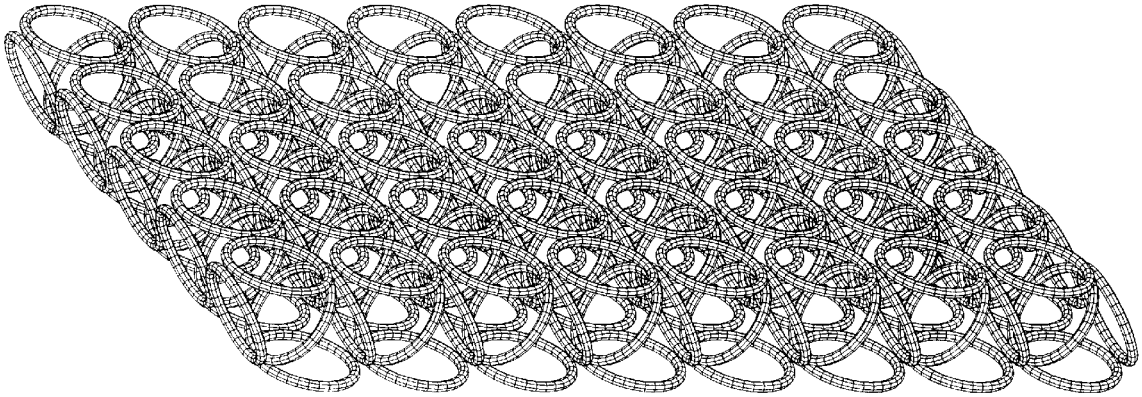

FIG. 211 is a perspective view of the structure shown in FIG. 210.

Figure 212:
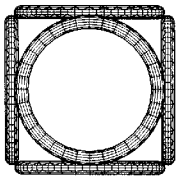

FIG. 212 is a side view of a structural module comprised of six toroidal elements connected to form a rectangular box.

Figure 213:
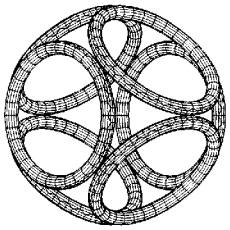

FIG. 213 is a perspective view of the structural module in FIG. 212.

Figure 214:
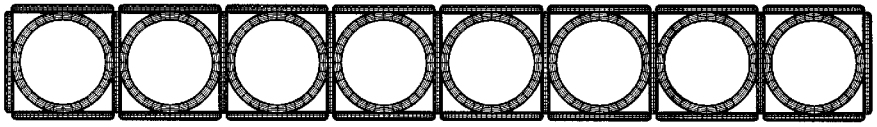

FIG. 214 is a side view of a linear array of 8 of the structural modules shown in FIG. 212 forming the structure of a post, beam or rod with rectangular cross section.

Figure 215:
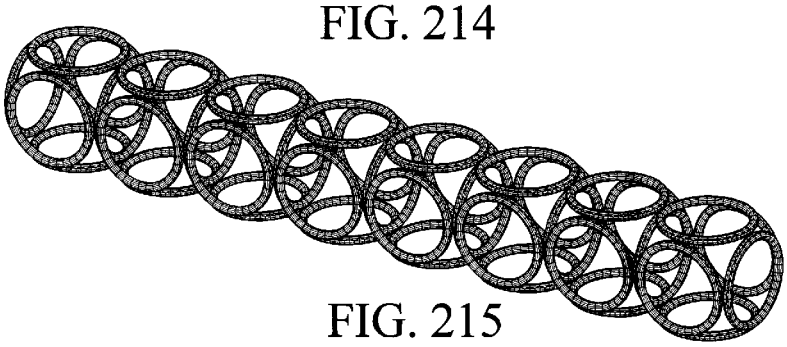

FIG. 215 is a perspective view of the structure shown in FIG. 214.

Figure 216:
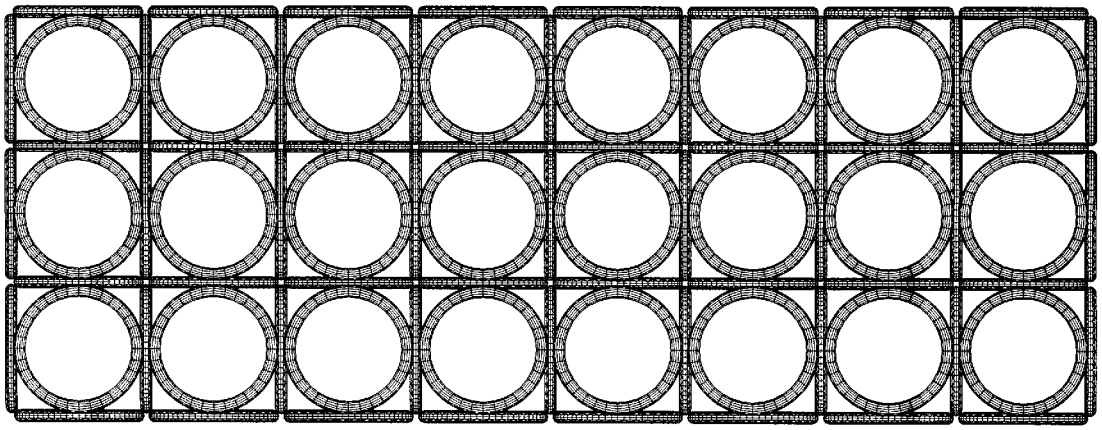

FIG. 216 is a plan view of a 3 deep array of the structure shown in FIG. 214 to form the structure of a joist or beam.

Figure 217:
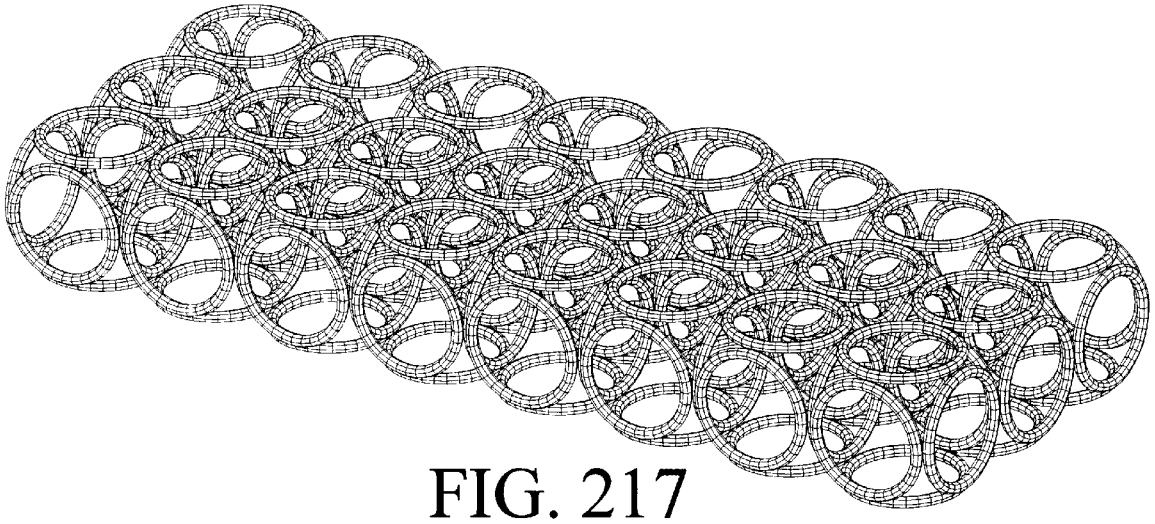

FIG. 217 is a perspective view of the structure shown in FIG. 216.

Figure 218:
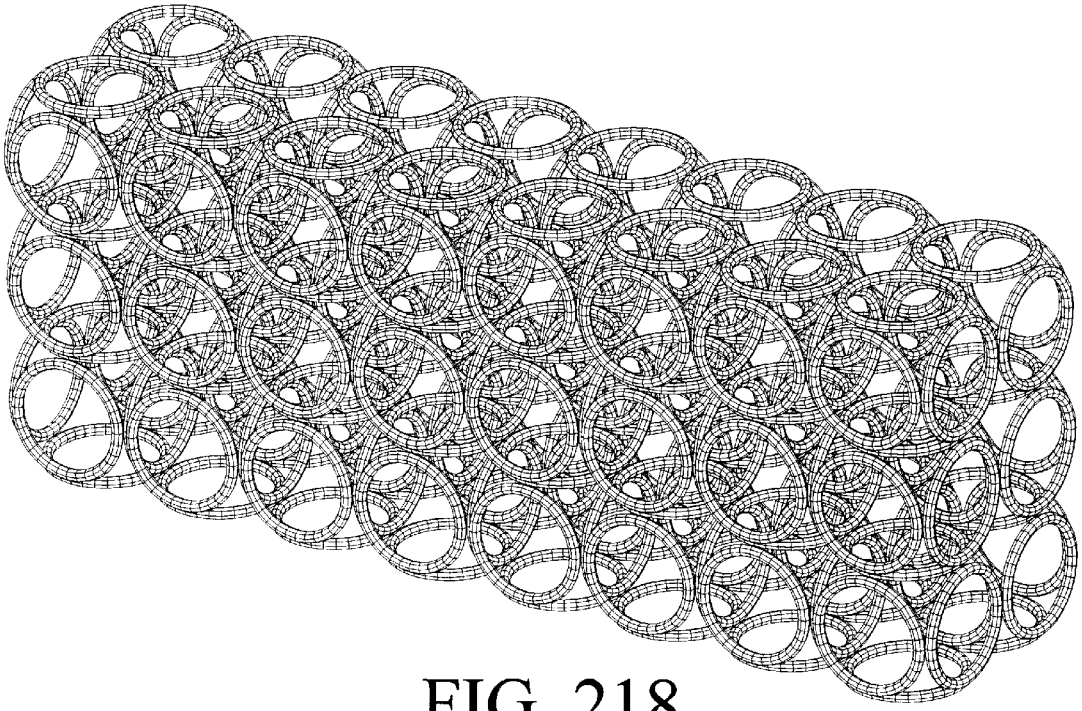
Figure 219:
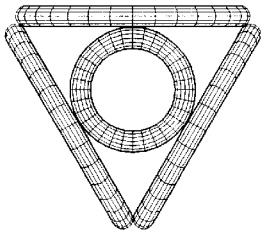
Figure 221:
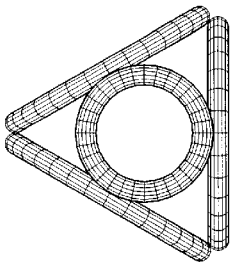
Figure 223:
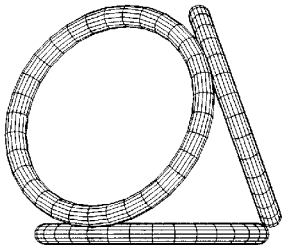
Figure 220:
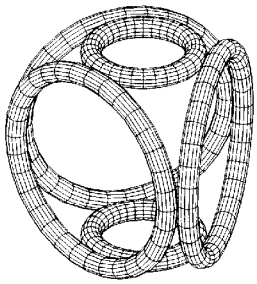
Figure 222:
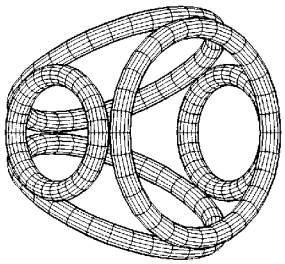
Figure 224:
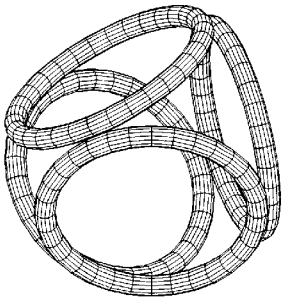

FIG. 218 is a perspective view of a double width of the structure shown in FIG. 216.

FIGS. 219 through 230 show various structural modules comprised of a plurality of connected toroidal elements (odd numbered showing the plan view and even numbered showing a perspective view).

Figure 229:
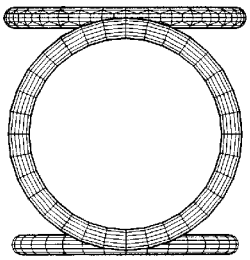
Figure 226:
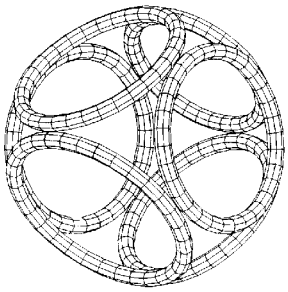
Figure 228:
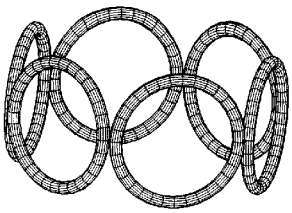
Figure 230:
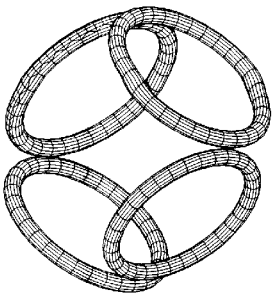
Figure 231:
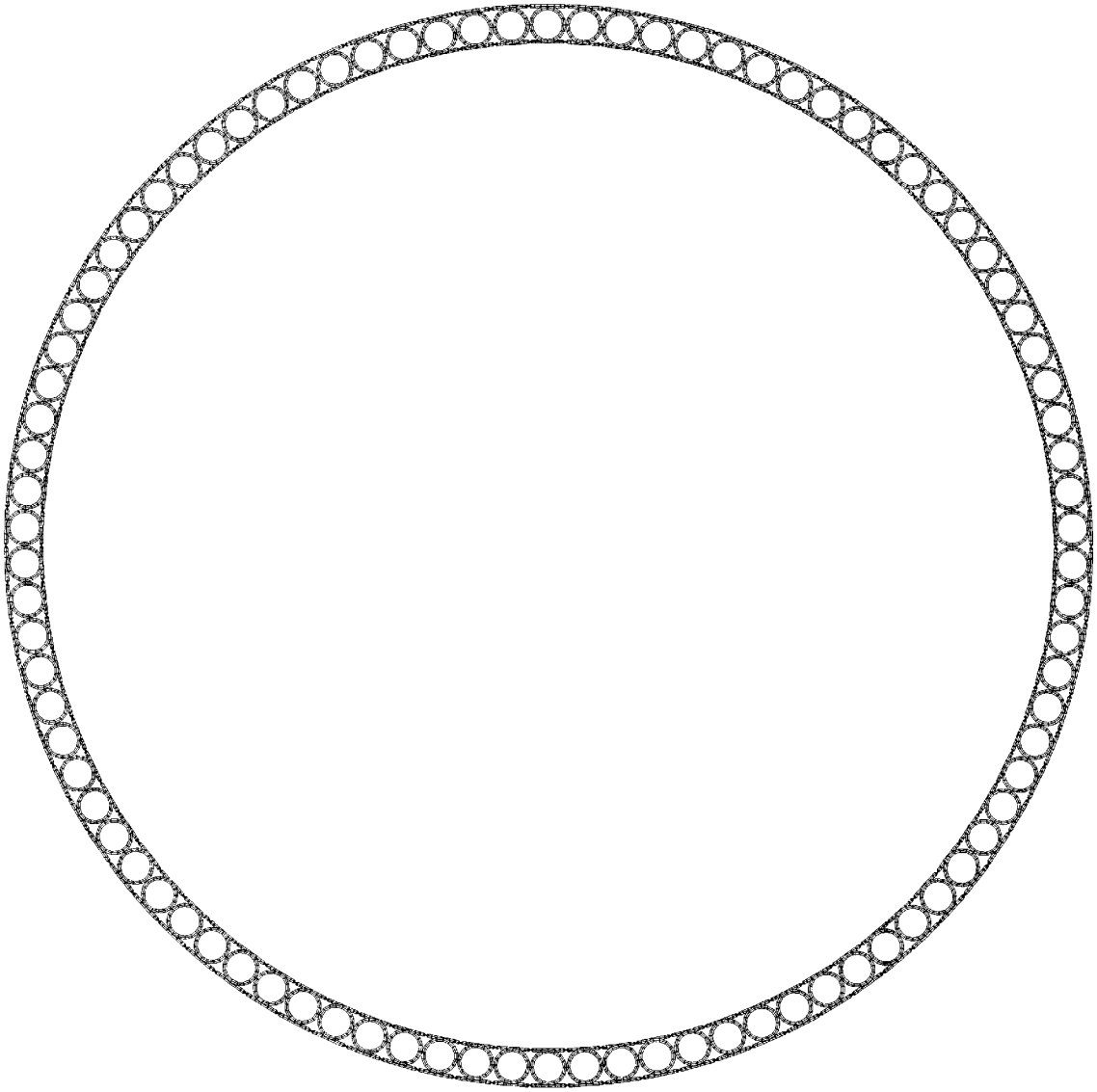

FIG. 231 is a side view of 90 of the structural modules shown in FIG. 229 connected in a circular array.

Figure 232:
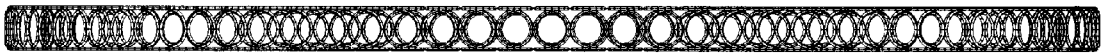

FIG. 232 is a top view of the circular array shown in FIG. 231.

Figure 233:
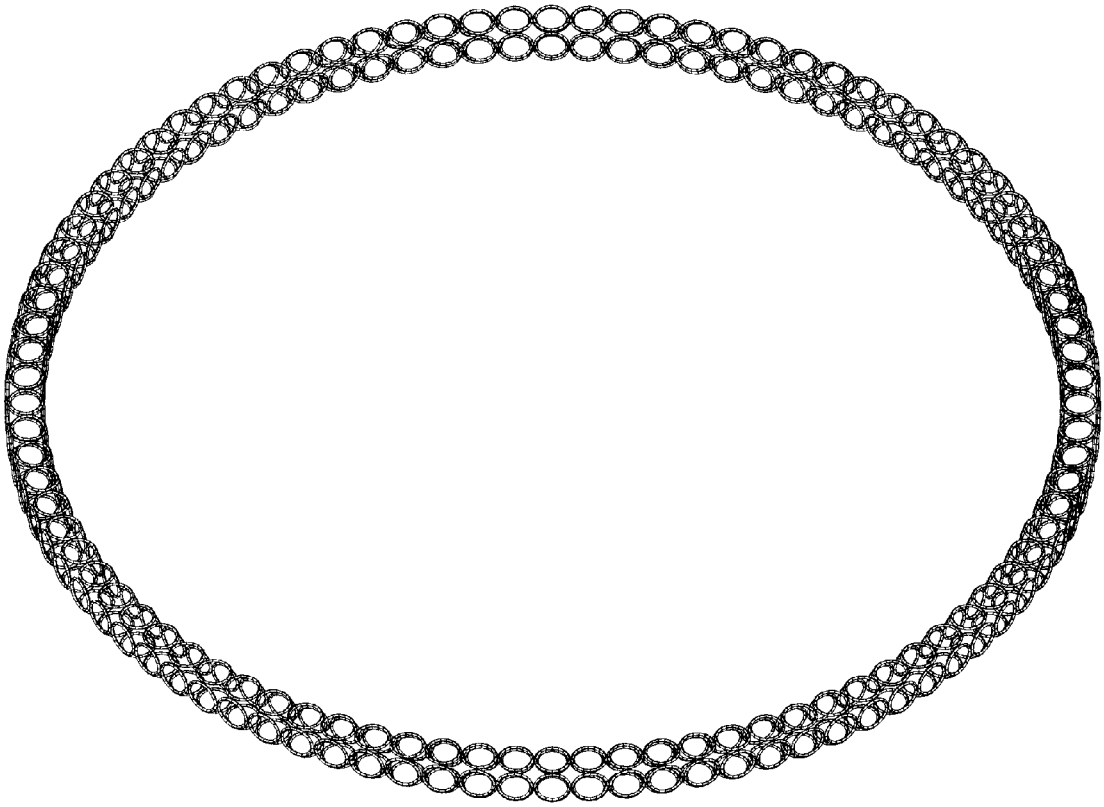

FIG. 233 is a perspective view of the circular array shown in FIG. 231.

Figure 234:
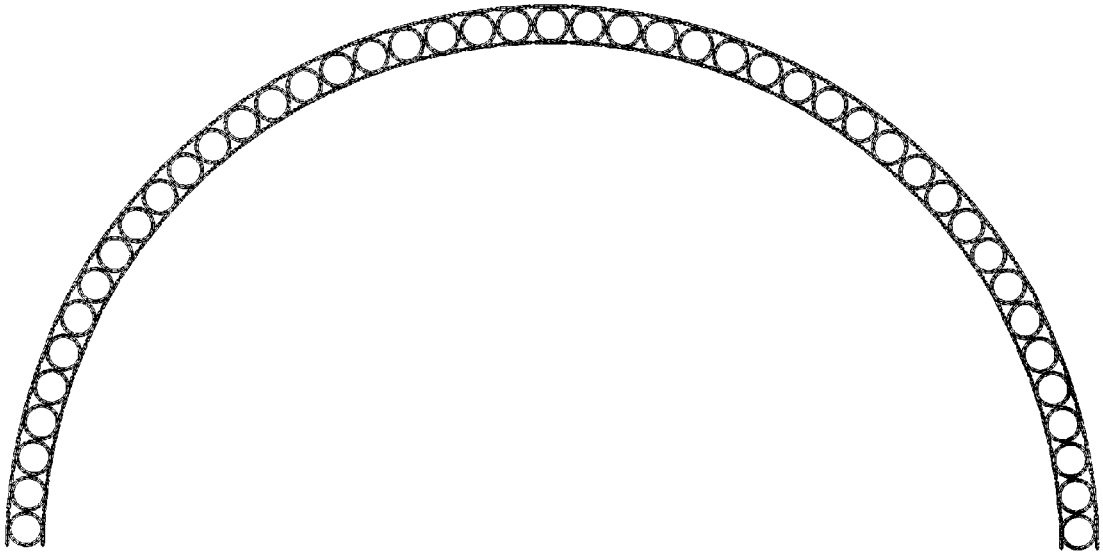

FIG. 234 is a side view of 45 of the structural modules shown in FIG. 229 connected in a semicircular array to form an arch.

Figure 235:
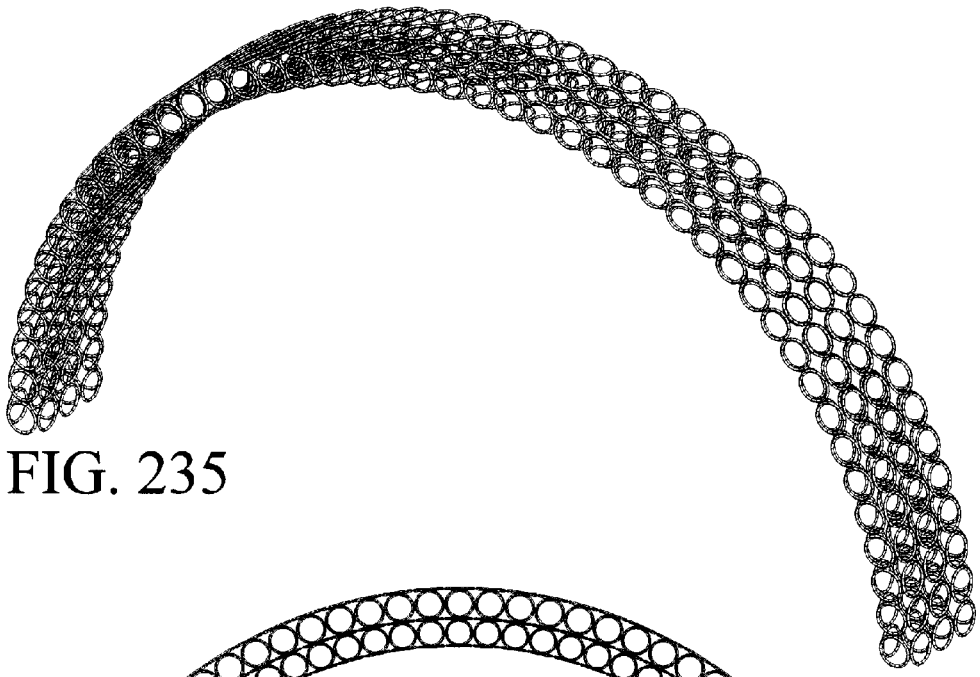

FIG. 235 is a perspective view of a triple width semicircular array as shown in FIG. 234.

Figure 236:
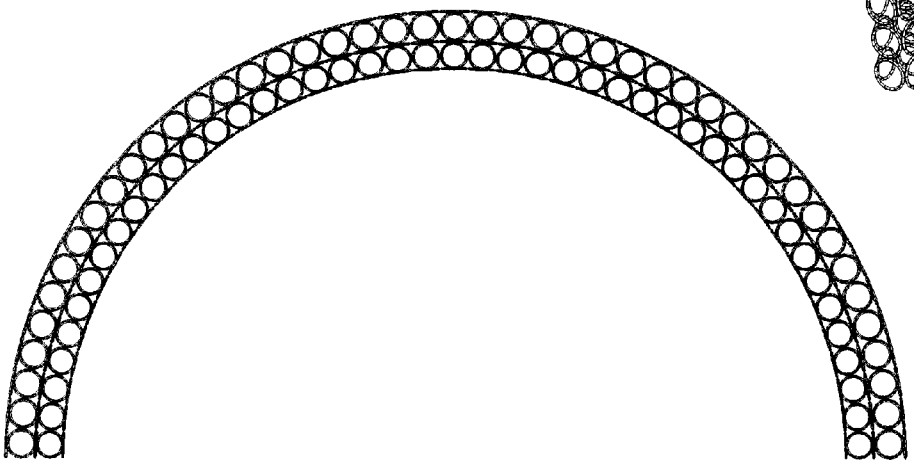

FIG. 236 is a side view of a 2 deep semicircular array shown in FIG. 234.

Figure 237:
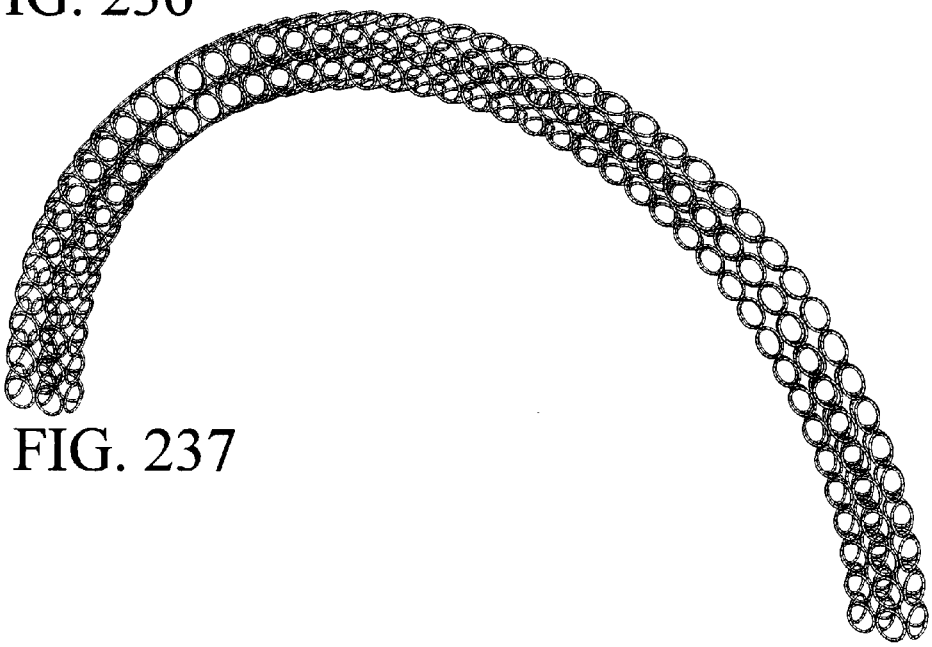

FIG. 237 is a perspective view of the arch structure shown in FIG. 236.

Figure 238:
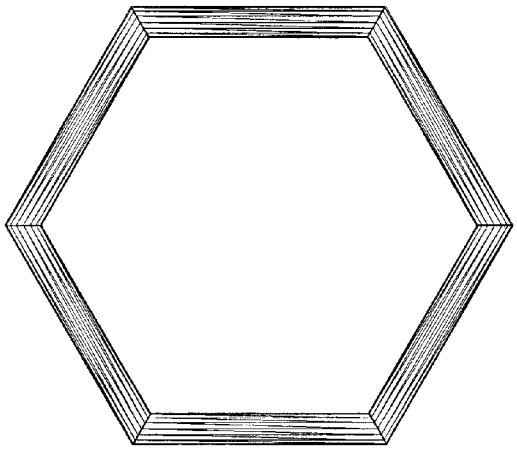

FIG. 238 is a plan view of a hexagonal toroidal element.

Figure 239:
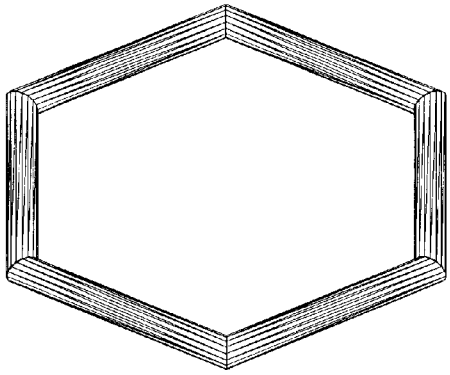

FIG. 239 is a perspective view of the toroidal element shown in FIG. 238.

Figure 240:
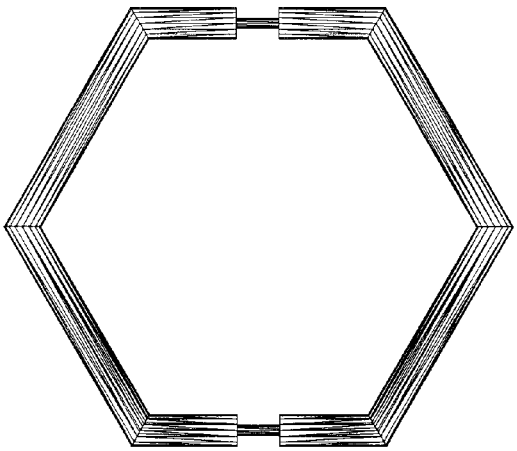

FIG. 240 is a plan view of a hexagonal toroidal element with internal shafts.

Figure 241:
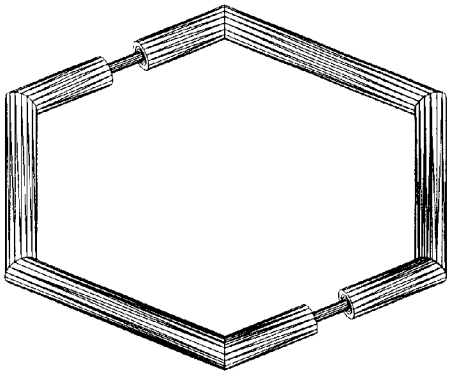

FIG. 241 is a perspective view of the toroidal element in FIG. 240.

Figure 242:
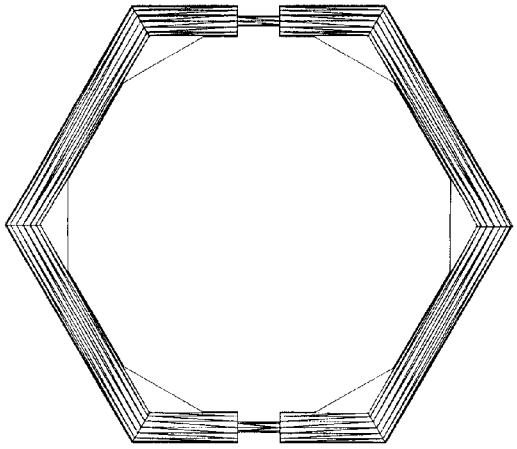

FIG. 242 is a plan view of the toroidal element shown in FIG. 240 with interior corner bracing.

Figure 243:
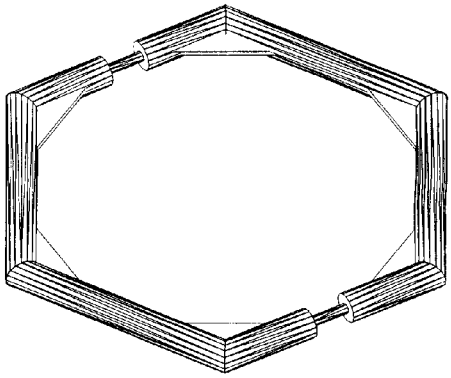

FIG. 243 is a perspective view of the toroidal element in FIG. 242.

Figure 244:
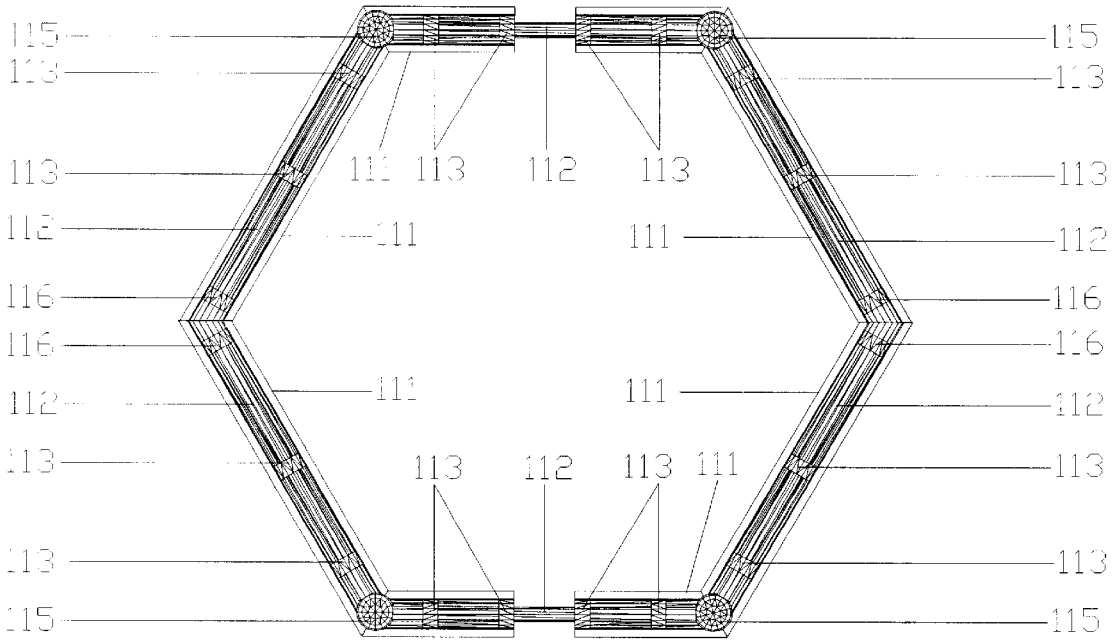

FIG. 244 is a cutaway plan view of a hexagonal toroidal element with 2 sets of 3 rotationally joined internal shafts, one in each opposing half of the hexagon.

Figure 245:
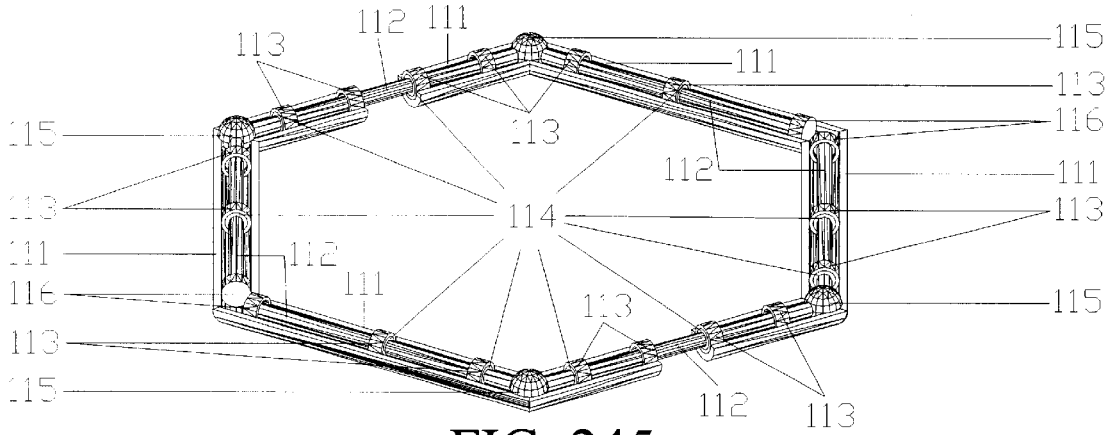

FIG. 245 is a cutaway perspective view of the toroidal element in FIG. 244.

Figure 246:
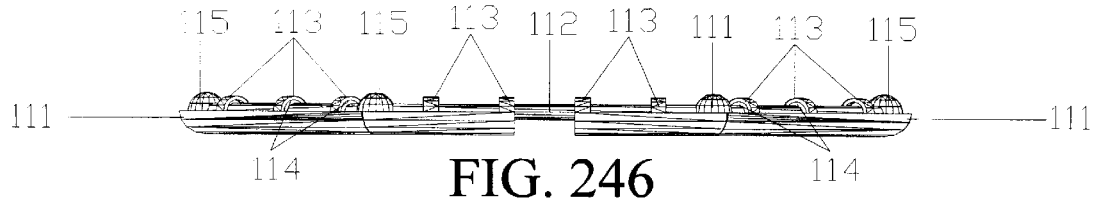

FIG. 246 is a cutaway side view of the toroidal element in FIG. 244.

Figure 247:
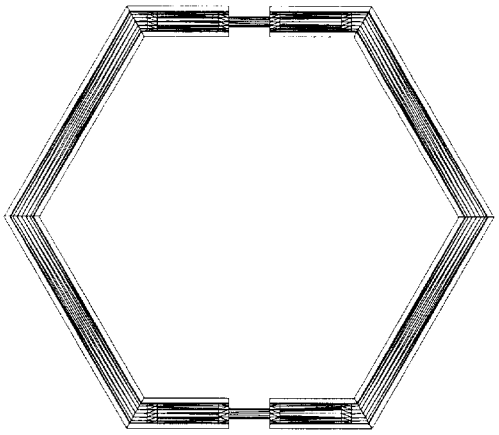

FIG. 247 is a cutaway plan view of a hexagonal toroidal element with 2 internal shafts, one in each opposing half of the hexagon.

Figure 248:
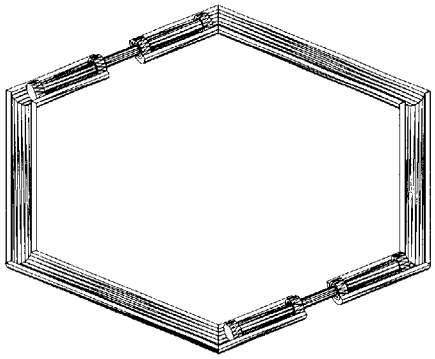

FIG. 248 a cutaway perspective view of the toroidal element in FIG. 247.

Figure 249:
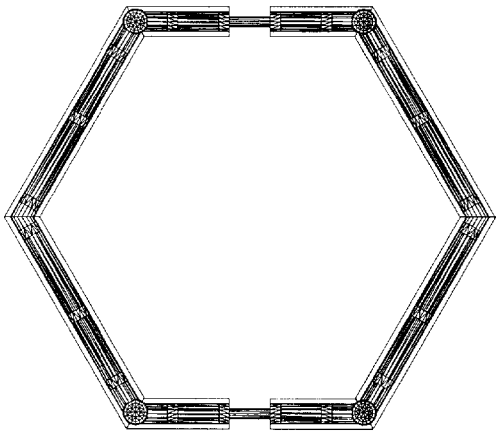

FIG. 249 is a cutaway plan view of a hexagonal toroidal element with 2 sets of 3 rotationally joined internal shafts, one in each opposing half of the hexagon (same as FIG. 244).

Figure 250:
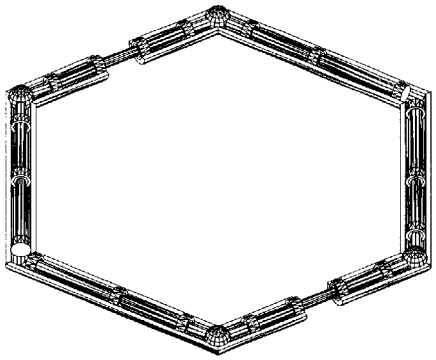

FIG. 250 is a cutaway perspective view of the toroidal element in FIG. 249 (same as FIG. 245).

Figure 251:
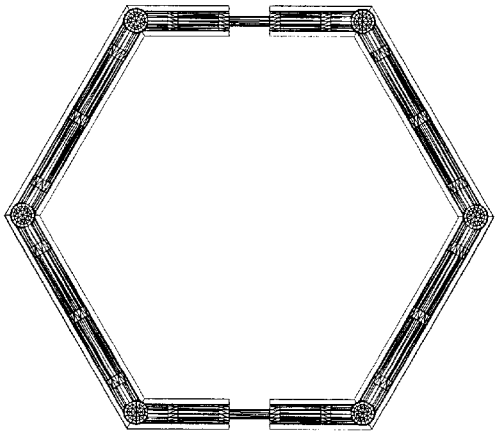

FIG. 251 is a cutaway plan view of a hexagonal toroidal element with 6 internal shafts, all rotationally joined.

Figure 252:
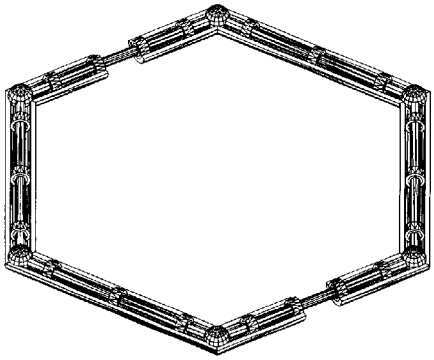

FIG. 252 is a cutaway perspective view of the toroidal element in FIG. 251.

Figure 253:
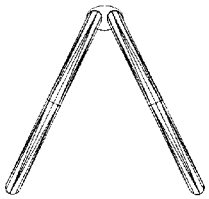

FIG. 253 is a side view of two hexagonal toroidal elements shown in FIG. 242 angularly connected by one coupling.

Figure 254:
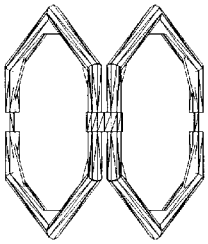

FIG. 254 is a plan view of the two toroidal elements in FIG. 253.

Figure 255:
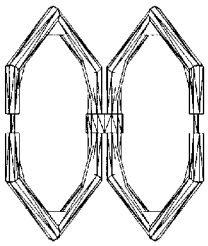

FIG. 255 is a bottom view of the two toroidal elements in FIG. 253.

Figure 256:
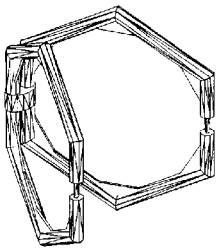

FIG. 256 is a perspective view of the toroidal elements in FIG. 253.

Figure 257:
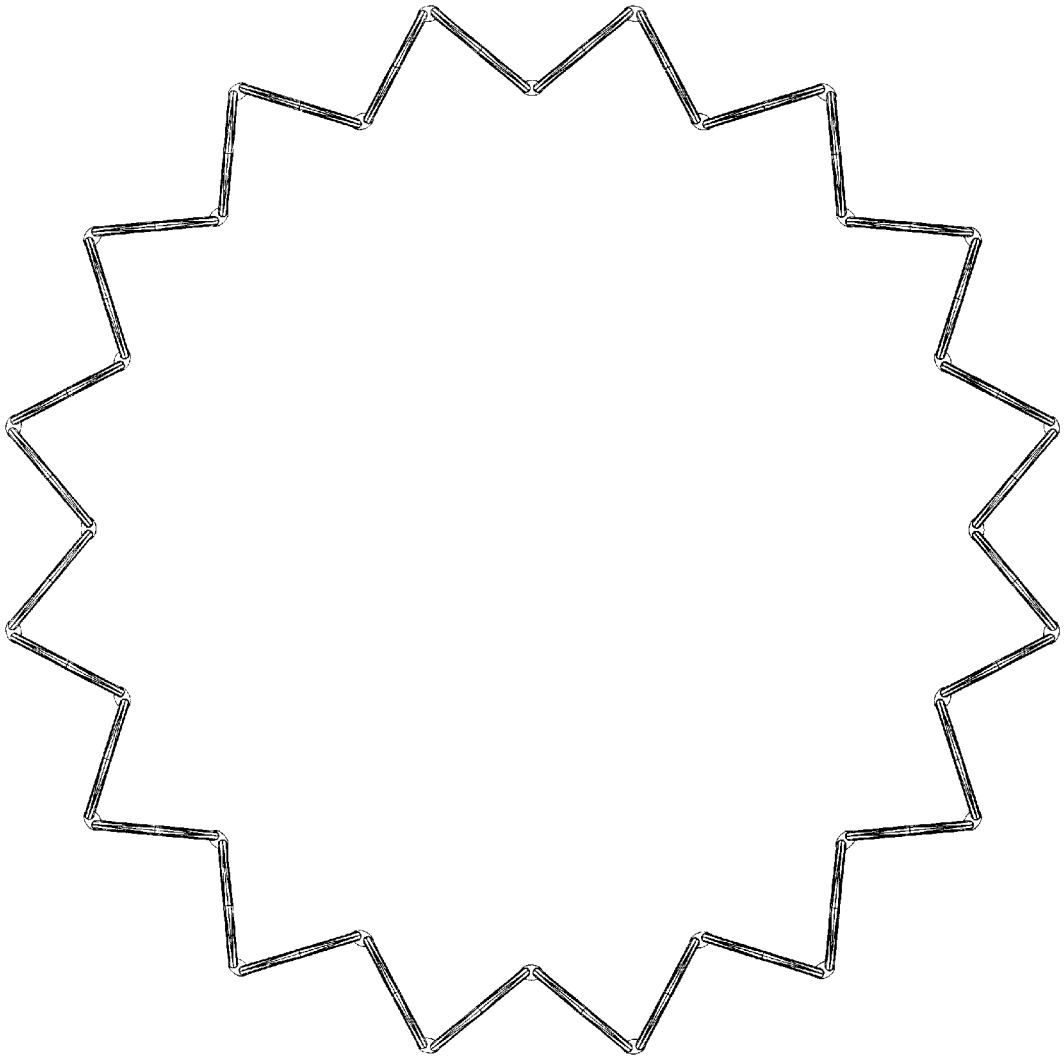

FIG. 257 a plan view of 16 pairs of hexagonal toroidal elements as shown in FIG. 253 connected to form a toroid.

Figure 258:
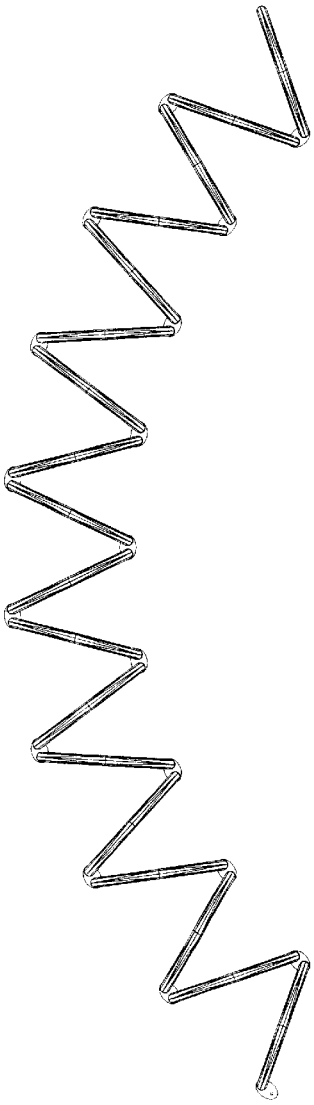

FIG. 258 is a plan view of a part (approximately one-quarter) of a circular array of 32 pairs of hexagonal toroidal elements as shown in FIG. 257.

Figure 259:
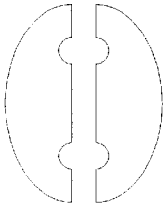
Figure 260:
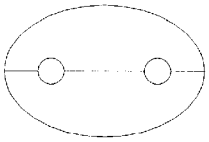

FIG. 259 and 260 are plan views of a two element coupling for polygonal toroids with axles showing, respectively, the coupling open and the coupling closed.

Figure 261:
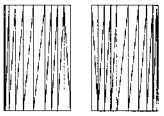
Figure 262:
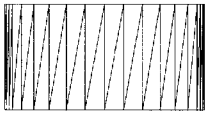

FIG. 261 and 262 are side views of the coupling in FIGS. 259 and 260 showing, respectively, the coupling open and the coupling closed.

Figure 263:
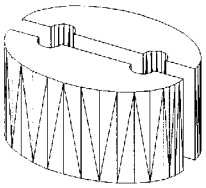
Figure 264:
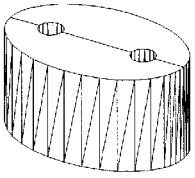

FIG. 263 and 264 are perspective views of the coupling in FIGS. 259 and 260 showing, respectively, the coupling open and the coupling closed.

Figure 265:
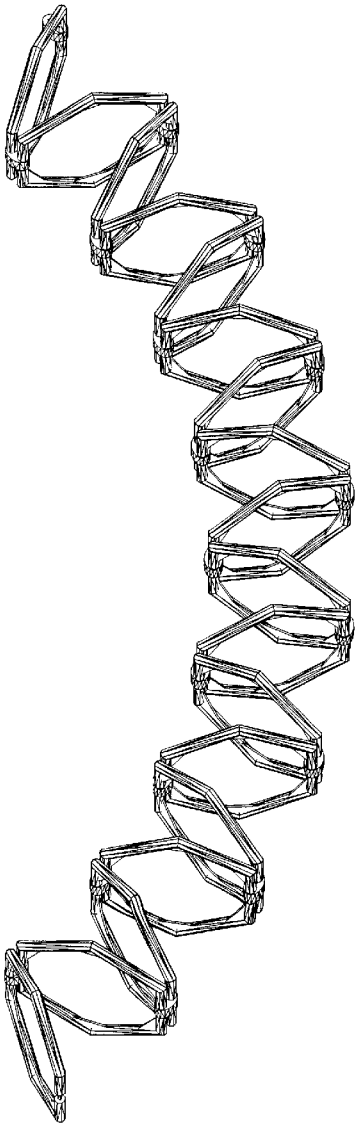

FIG. 265 is a perspective view of the partial circular array shown in FIG. 258.

Figure 266:
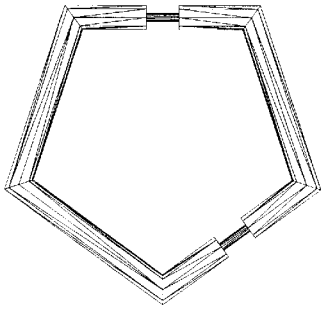

FIG. 266 is a plan view of a pentagonal toroidal element with internal shafts.

Figure 267:
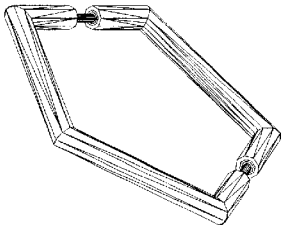

FIG. 267 is a perspective view of the toroidal element in FIG. 266.

Figure 268:
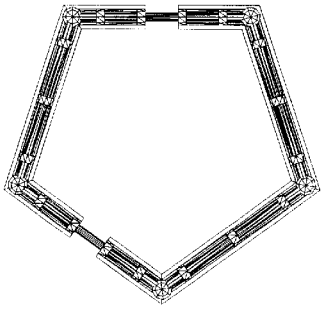

FIG. 268 is a cutaway plan view of a pentagonal toroidal element, as shown in FIG. 266, with 5 internal shafts, all rotationally joined.

Figure 269:
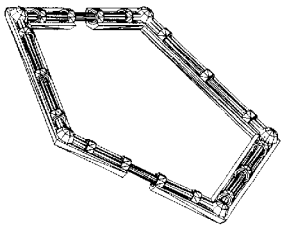

FIG. 269 is a cutaway perspective view of the toroidal element in FIG. 268.

Figure 270:
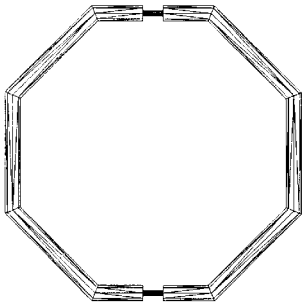

FIG. 270 is a plan view of a octagonal toroidal element with internal shafts.

Figure 271:
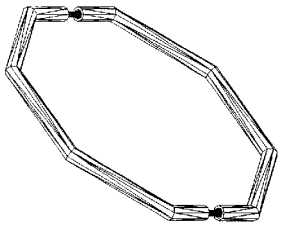

FIG. 271 is a perspective view of the toroidal element in FIG. 270.

Figure 272:
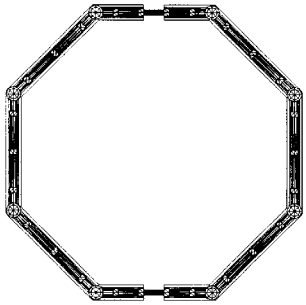

FIG. 272 is a cutaway plan view of an octagonal toroidal element, as shown in FIG. 270, with 8 internal shafts, all rotationally joined.

Figure 273:
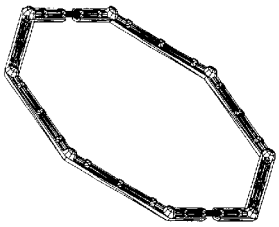

FIG. 273 is a cutaway perspective view of the toroidal element in FIG. 272.

Figure 274:
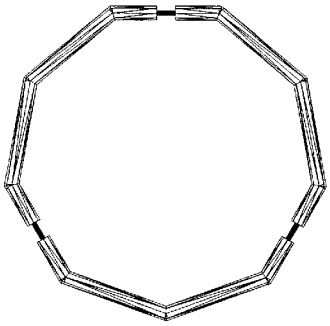

FIG. 274 is a plan view of a nonagonal toroidal element with internal shafts.

Figure 275:
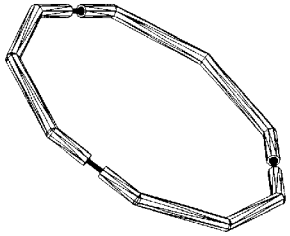

FIG. 275 is a perspective view of the toroidal element in FIG. 274.

Figure 276:
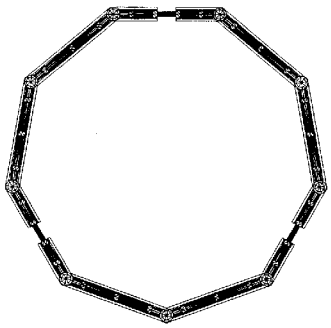

FIG. 276 is a cutaway plan view of a nonagonal toroidal element, as shown in FIG. 274, with 9 internal shafts, all rotationally joined.

Figure 277:
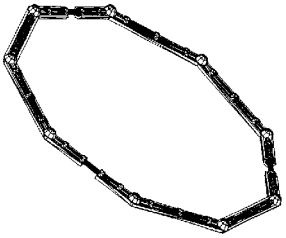

FIG. 277 is a cutaway perspective view of the toroidal element in FIG. 276.

Figure 278:
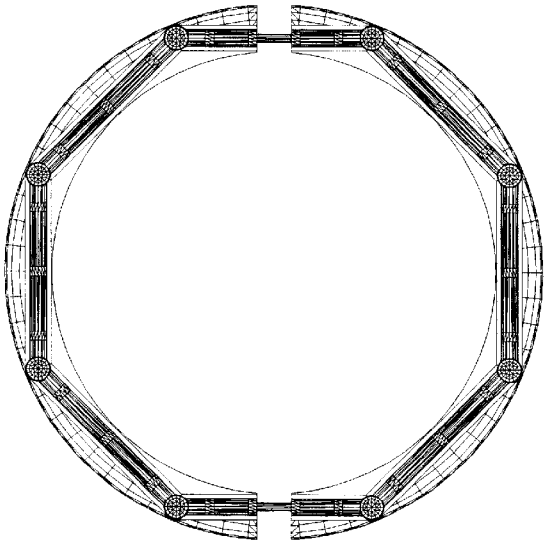

FIG. 278 is a cutaway plan view of a circular toroidal element with internal shafts rotationally joined in an octagonal core.

Figure 279:
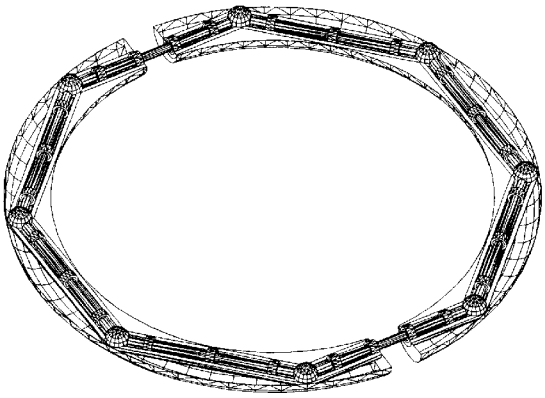

FIG. 279 is a cutaway perspective view of the toroidal element shown in FIG. 278.

Figure 84:
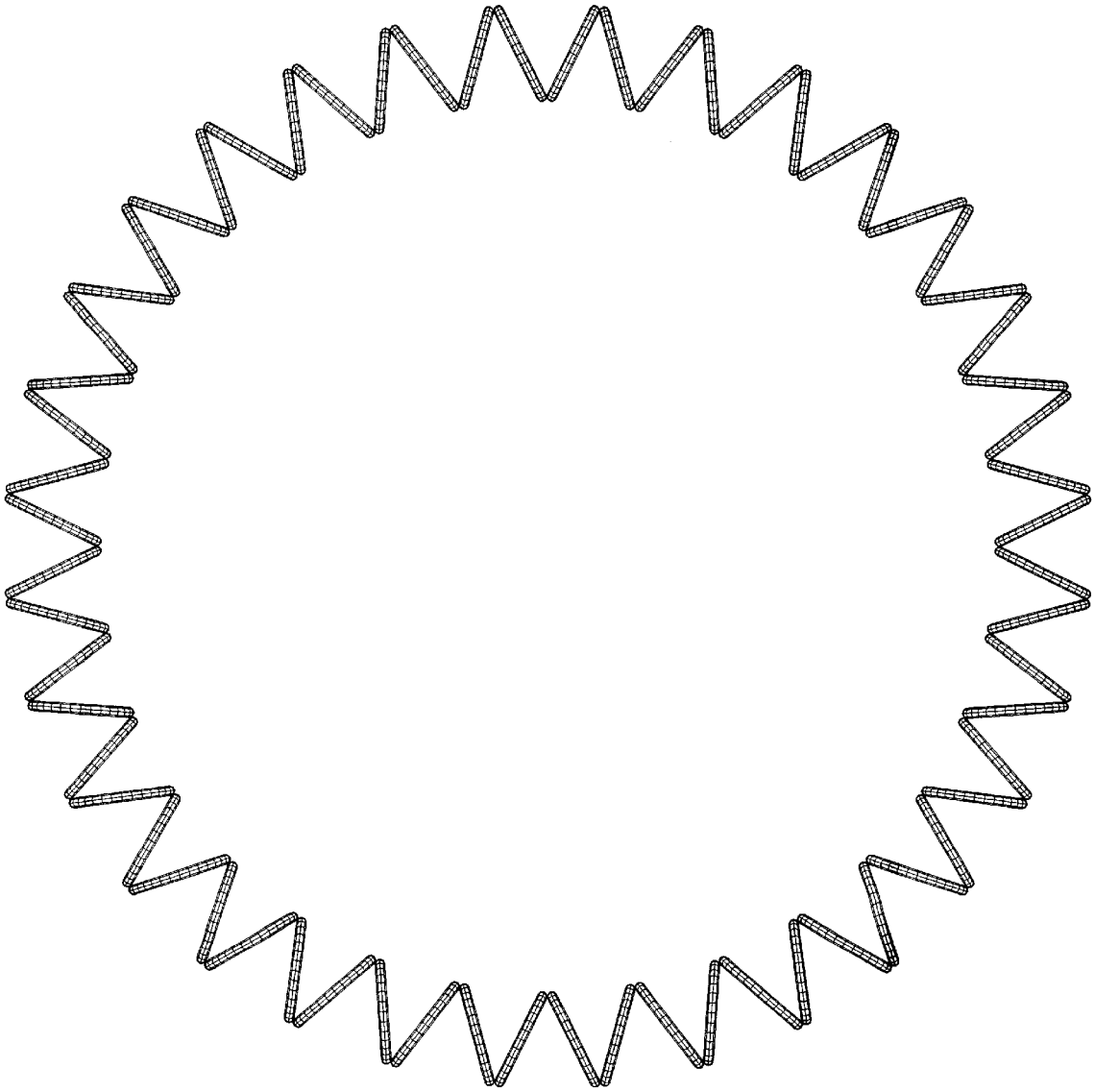
FIG. 84 is a plan view of 32 pairs of toroidal torsional elements shown in FIG. 81 connected in a circular array forming a toroid.
Figure 280:
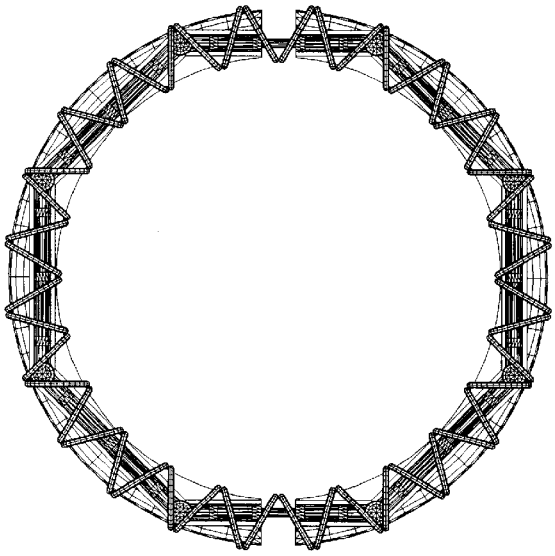

FIG. 280 is a plan view of the toroidal element shown in FIG. 278 the tube of which is enclosed by the tube of another toroidal element of the type shown in FIG. 84 but with 24 pairs of elements.

Figure 281:
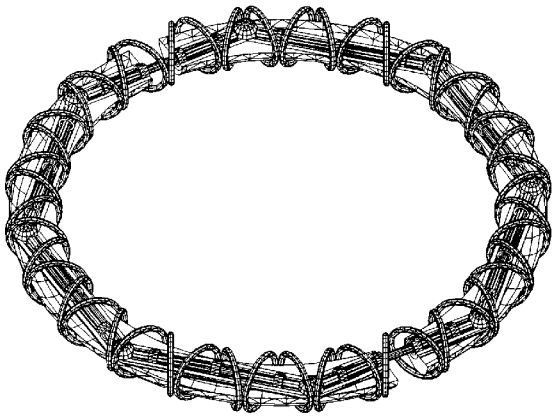

FIG. 281 is a perspective view of the toroidal element shown in FIG. 280.

Figure 282:
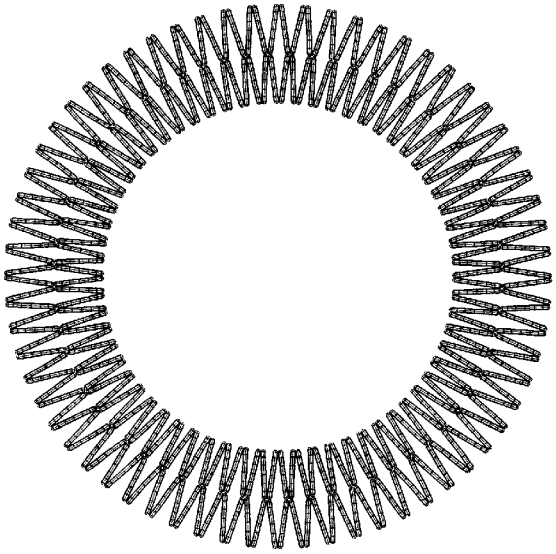

FIG. 282 is a plan view of a toroidal element as shown in FIG. 87 connected to a similar concentric toroidal element within it, the radii of the tubes of the inner and outer toroidal elements being equal.

Figure 283:
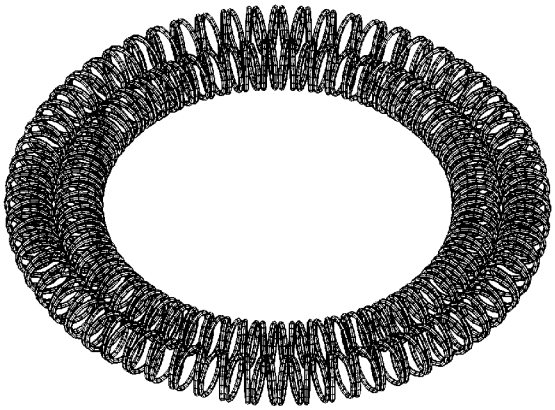

FIG. 283 is a perspective view of the toroid structure in FIG. 282.

Figure 284:
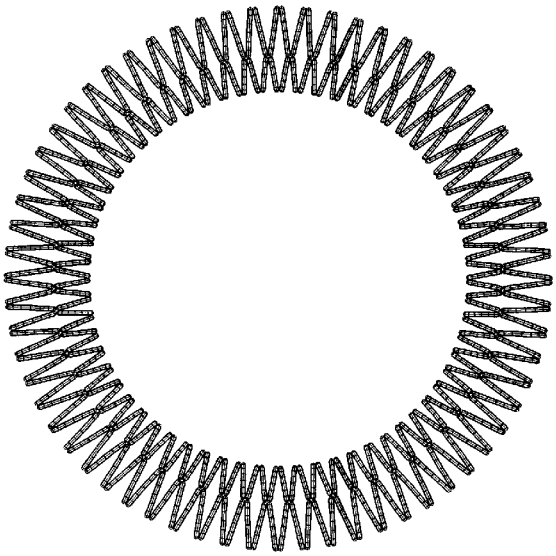

FIG. 284 is a plan view of a toroidal element as shown in FIG. 87 connected to a similar concentric toroidal element within it, the angulation of the inner and outer pairs of toroidal elements being equal.

Figure 285:
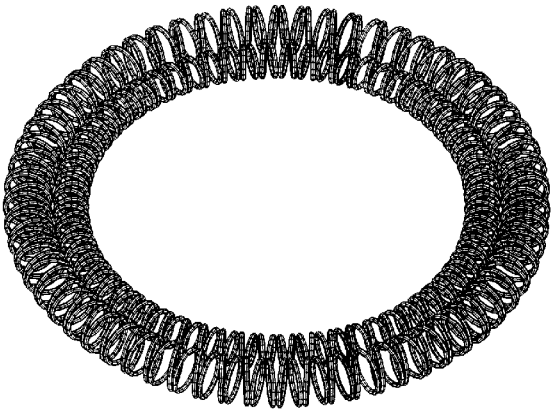

FIG. 285 is a perspective view of the toroid structure in FIG. 284.

Figure 286:
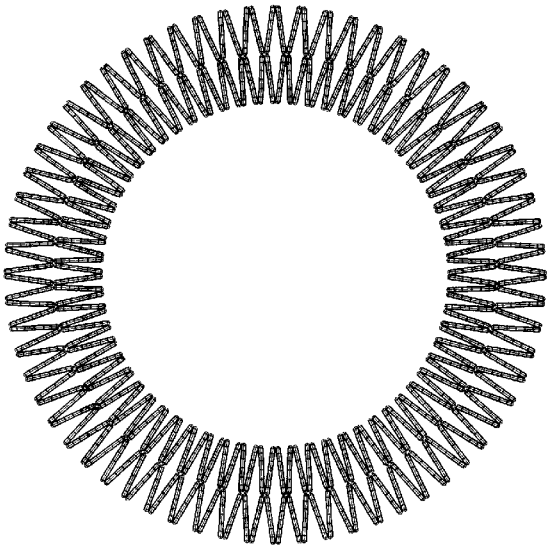

FIG. 286 is a plan view of a toroidal element as shown in FIG. 87 connected to a similar concentric toroidal element within it, the radii of the toroidal elements comprising the inner and outer toroidal elements being equal.

Figure 287:
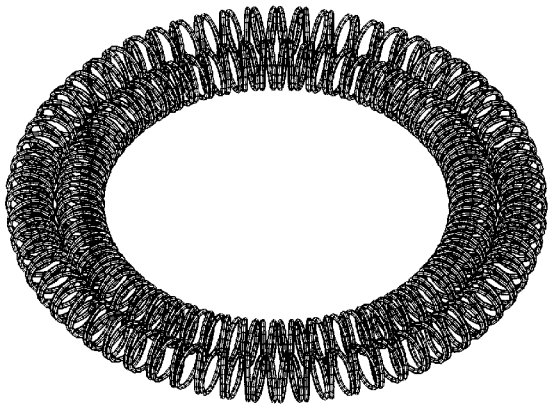

FIG. 287 is a perspective view of the toroid structure in FIG. 286.

Figure 97:
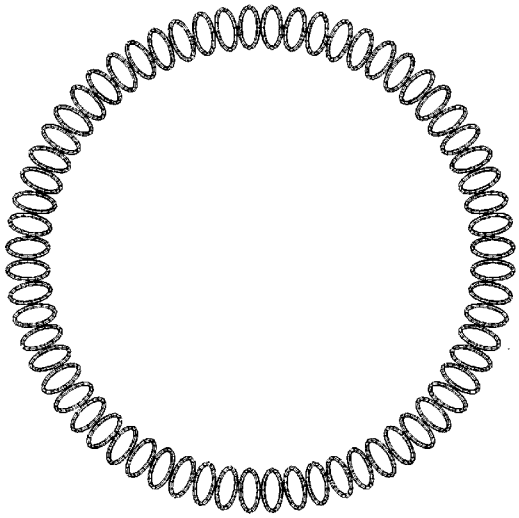
FIG. 97 is a plan view of a toroid formed by 32 pairs of the angularly connected toroidal torsional elements oriented as shown in FIG. 82 connected in a circular array.
Figure 288:
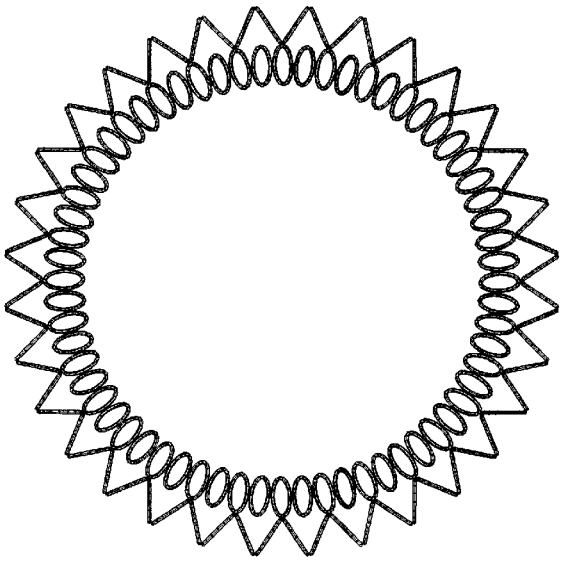

FIG. 288 is a plan view of a toroidal element as shown in FIG. 84 connected to a concentric inner toroidal element as shown in FIG. 97.

Figure 289:
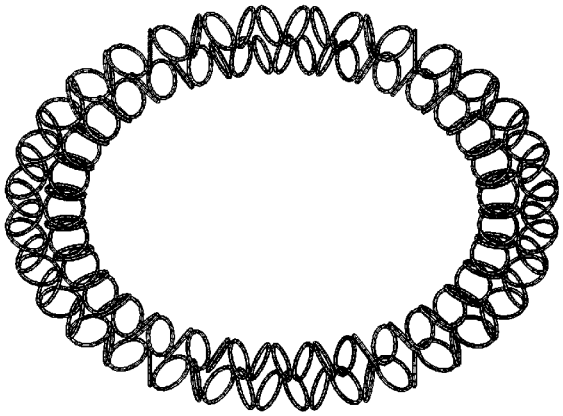

FIG. 289 is a perspective view of the toroid structure in FIG. 288.

Figure 290:
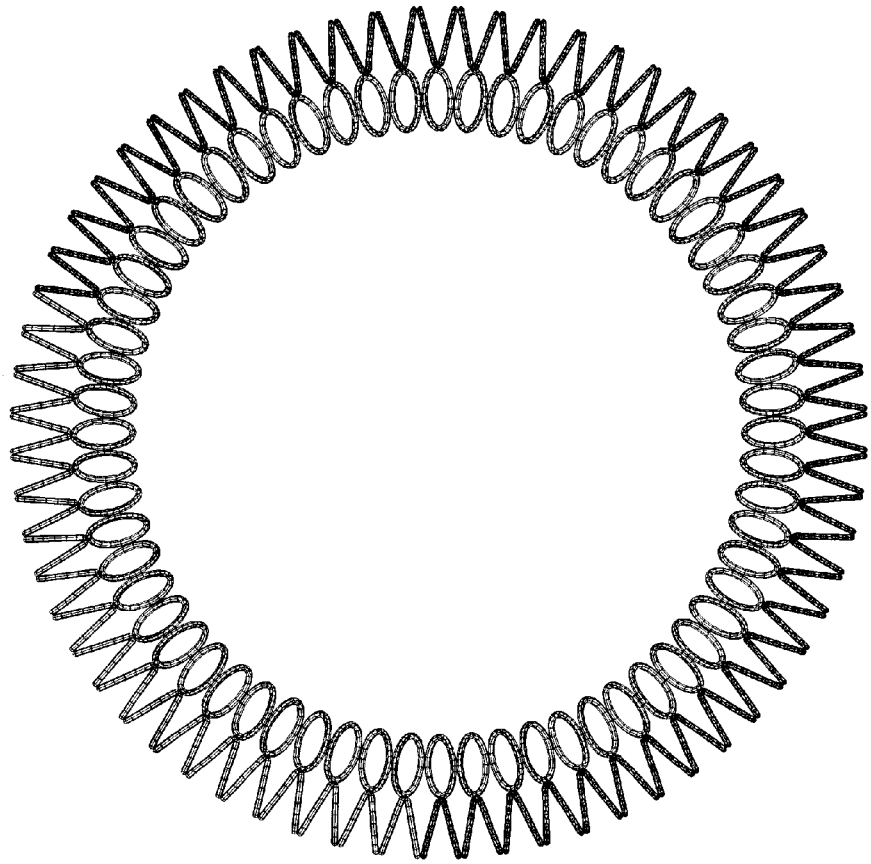

FIG. 290 is a plan view of a toroidal element as shown in FIG. 87 connected to a concentric inner toroidal element as shown in FIG. 97.

Figure 291:
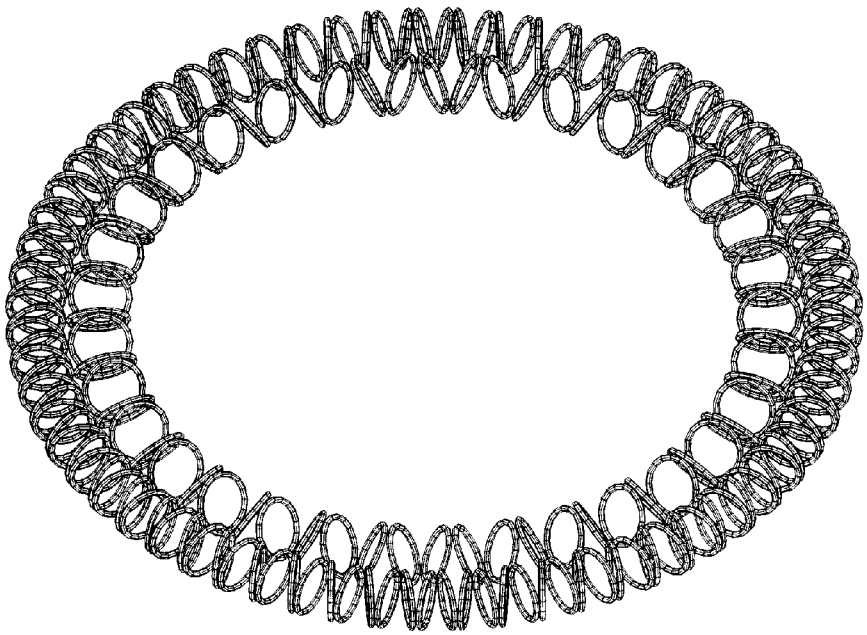
Figure 292:
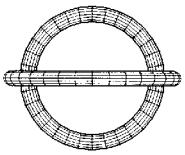
Figure 293:
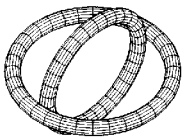
Figure 302:
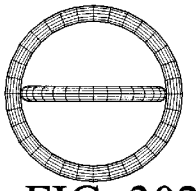
Figure 303:
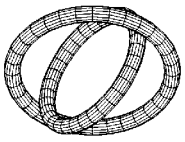
Figure 294:
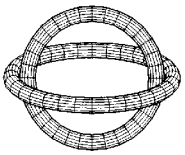
Figure 295:
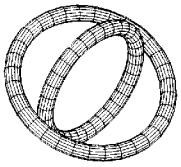
Figure 304:
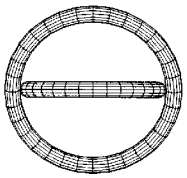
Figure 305:
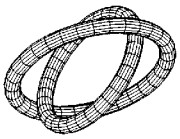
Figure 296:
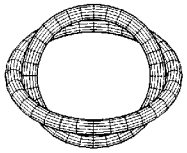
Figure 297:
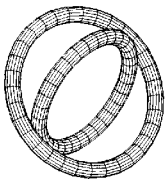
Figure 306:
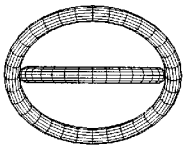
Figure 307:
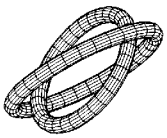
Figure 298:
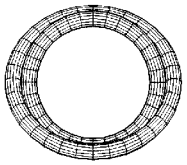
Figure 299:
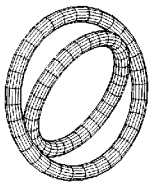
Figure 308:
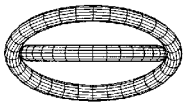
Figure 309:
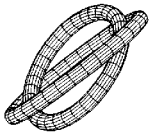
Figure 300:
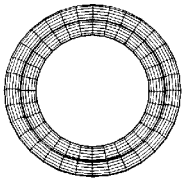
Figure 301:
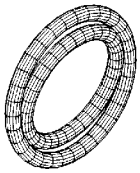
Figure 310:
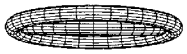
Figure 311:
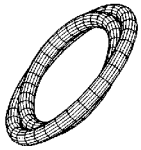

FIG. 291 is a perspective view of the toroid structure in FIG. 290.

FIGS. 292 through 301 show various concentric connections of two toroidal elements at different angles (even numbered showing the plan view and odd numbered showing a perspective view).

FIGS. 302 through 311 show the various concentric connections of the toroidal elements shown in FIGS. 292 through 301 with the pairs rotated 90 degrees about the horizontal (even numbered showing the side (rotated) view and odd numbered showing a further perspective view).

Figure 312:
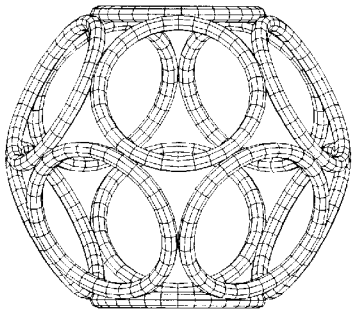

FIG. 312 is a side view of a spherical/icosohedral structure comprised of twelve connected toroidal elements.

Figure 313:
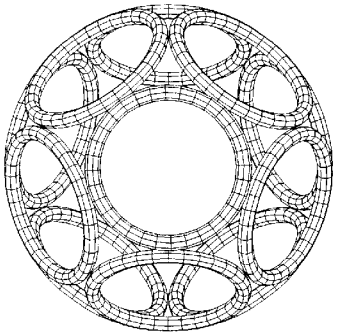

FIG. 313 is a plan view of the structure shown in FIG. 312.

Figure 314:
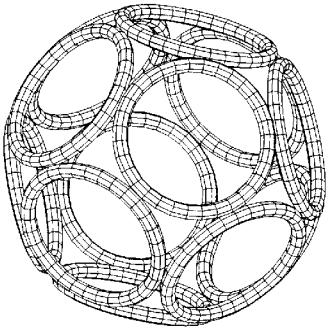

FIG. 314 is a perspective view of the structure shown in FIG. 312.

Figure 315:
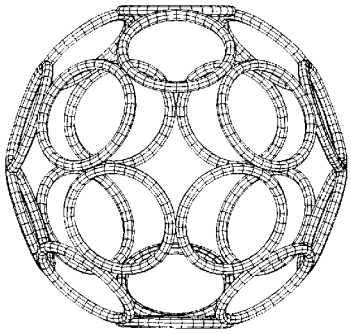

FIG. 315 is a side view of a spherical/dodecahedral structure comprised of twenty connected toroidal elements.

Figure 316:
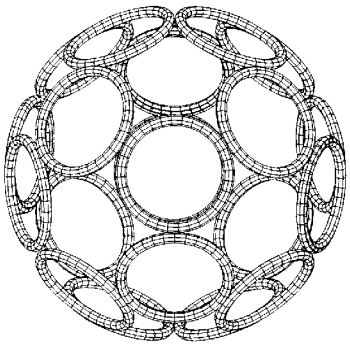

FIG. 316 is a plan view of the structure shown in FIG. 315.

Figure 317:
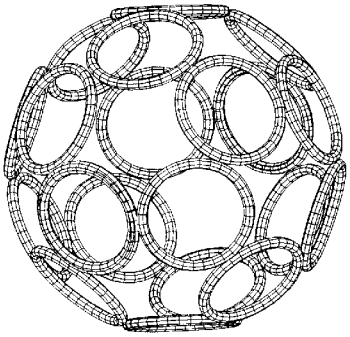

FIG. 317 is a perspective view of the structure shown in FIG. 315.

Figure 318:
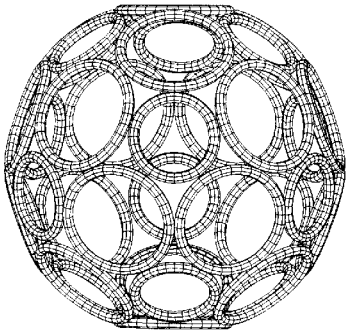

FIG. 318 is a side view of the structure shown in FIG. 315 with the gaps bridged by toroidal elements of lesser diameter.

Figure 319:
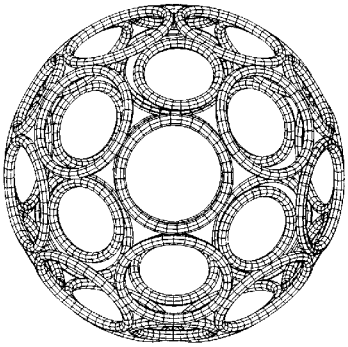

FIG. 319 is a plan view of the structure shown in FIG. 318.

Figure 320:
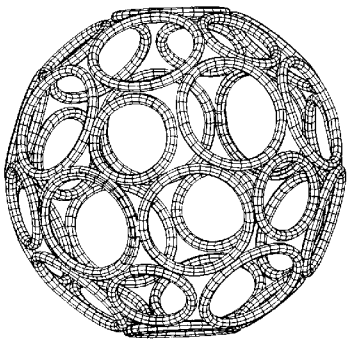

FIG. 320 is a perspective view of the structure shown in FIG. 318.

Figure 225:
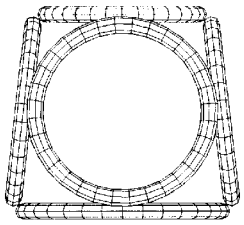
Figure 227:
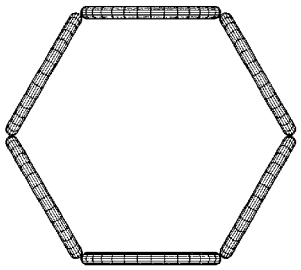
Figure 321:
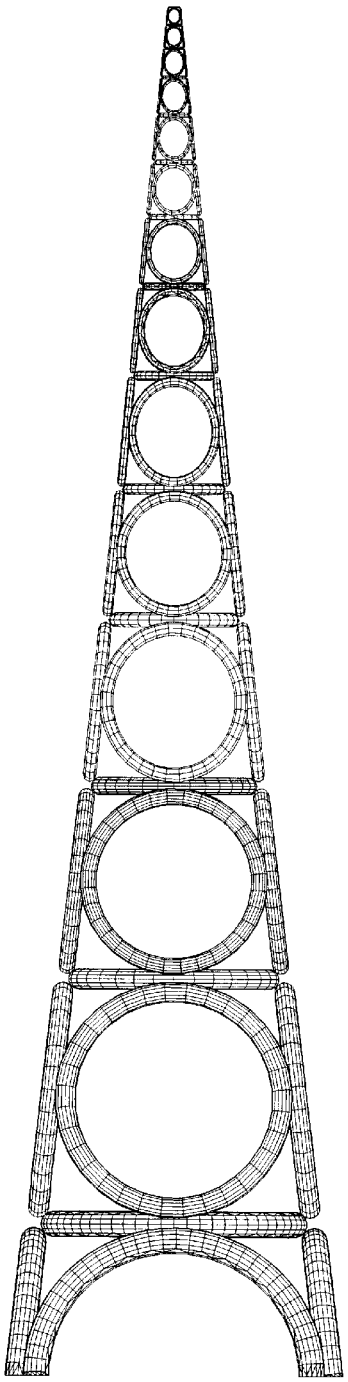

FIG. 321 is an elevation of a tower structure formed by a vertical array of connected prismatic structural modules as shown in FIG. 225 of upwardly diminishing dimension.

Figure 322:
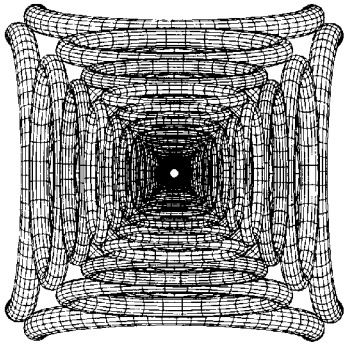

FIG. 322 is a plan view of the structure shown in FIG. 321.

Figure 323:
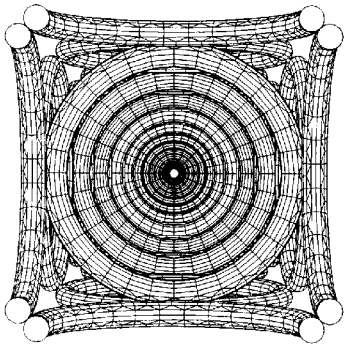

FIG. 323 is a bottom view of the structure shown in FIG. 321.

Figure 324:
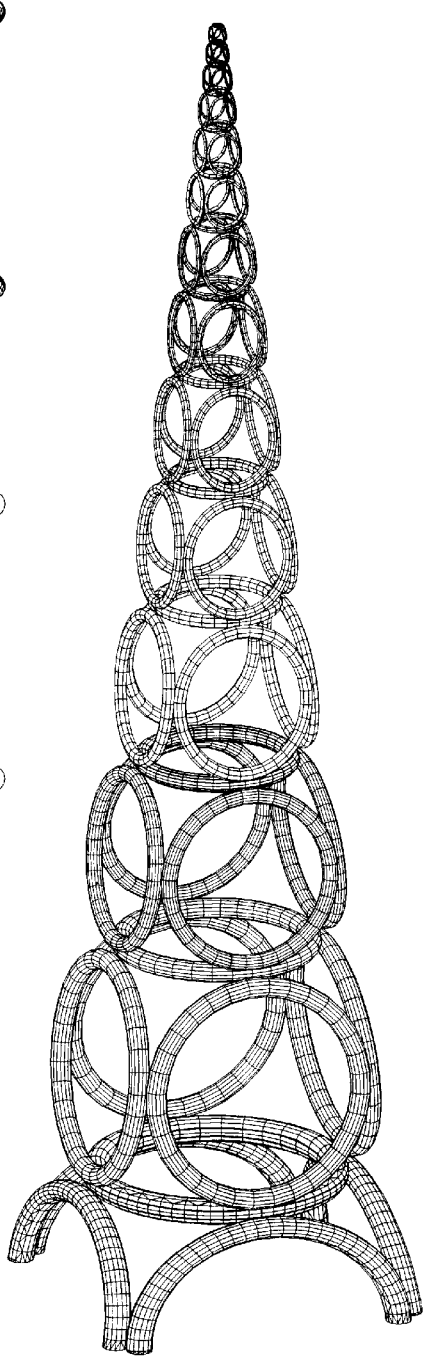

FIG. 324 is a perspective view of the structure shown in FIG. 321.

Figure 325:
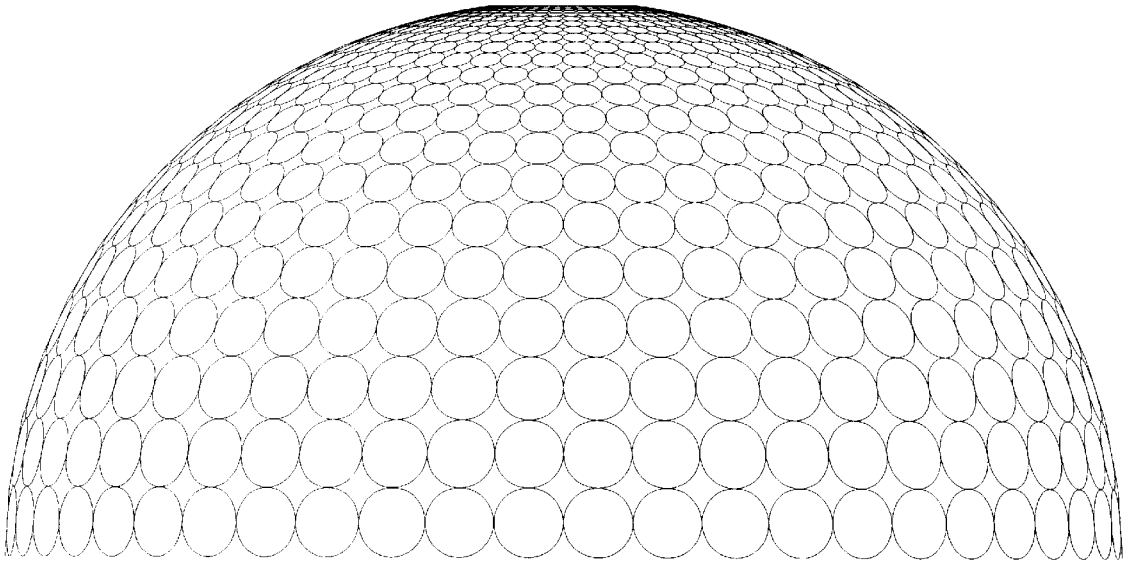

FIG. 325 is an schematic elevation of a dome structure formed by successive layers of equal numbers of toroidal elements of upwardly diminishing diameter, each toroidal element connected at four points to those adjacent.

Figure 326:
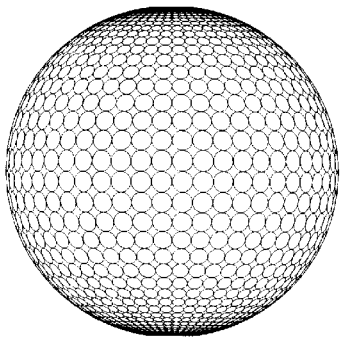

FIG. 326 is a schematic elevation of a spherical structure formed by two of the dome structures shown in FIG. 325 connected in opposite polar orientation.

Figure 327:
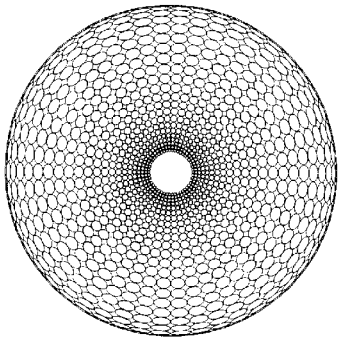

FIG. 327 is a schematic plan view of the spherical structure in FIG. 326.

Figure 328:
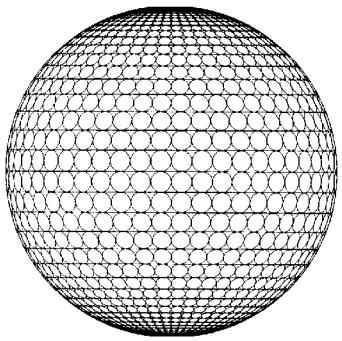

FIG. 328 is a schematic elevation of a spherical structure as shown in FIG. 326 with the toroidal elements within each layer connected to other layers via intermediate latitudinal toroidal elements.

Figure 329:
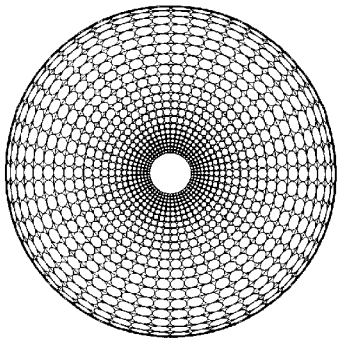

FIG. 329 is a schematic plan view of the spherical structure in FIG. 328.

Figure 330:
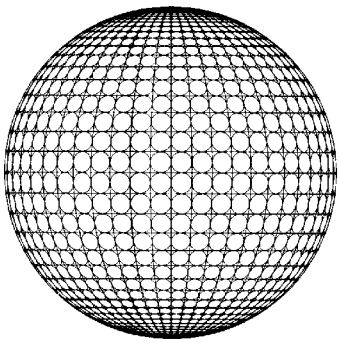

FIG. 330 is a schematic elevation of a spherical structure as shown in FIG. 328 with the toroidal elements connected to the left and right via intermediate longitudinal toroidal elements.

Figure 331:
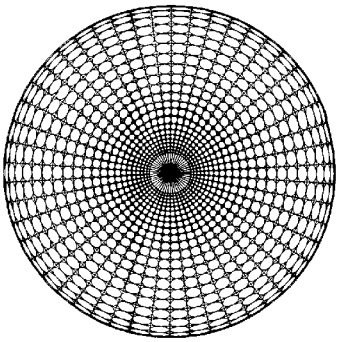

FIG. 331 is a schematic plan view of the spherical structure in FIG. 330.

Figure 332:
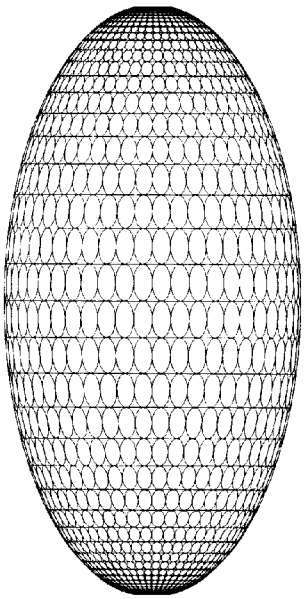

FIG. 332 is a schematic elevation of a prolate spherical structure of the same type as the spherical structure shown in FIG. 328.

Figure 333:
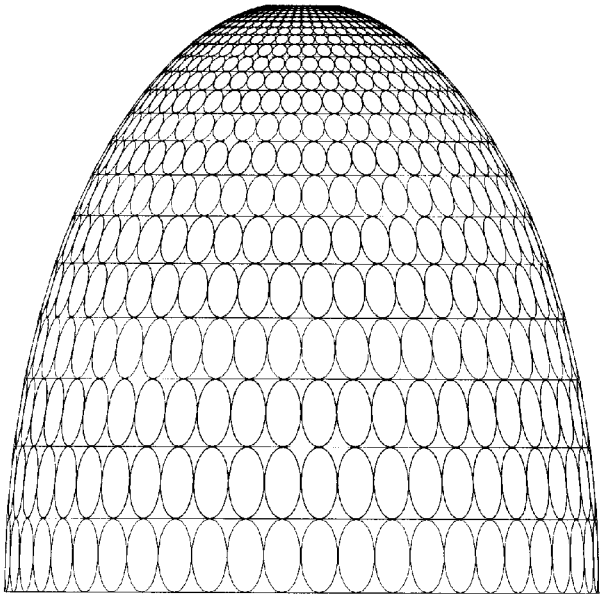

FIG. 333 is a schematic elevation of a prolate spherical dome structure identical with the upper half of the prolate spherical structure shown in FIG. 332.

Figure 334:
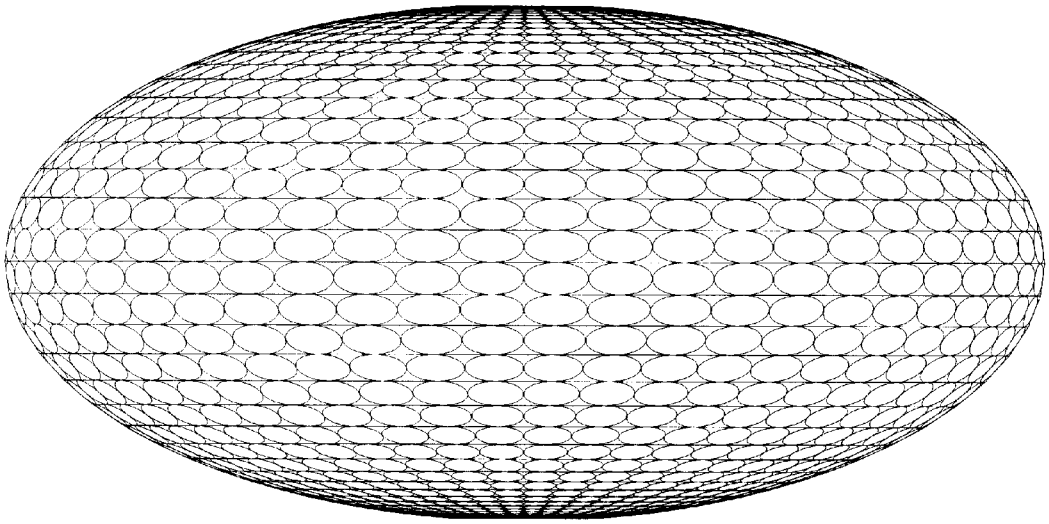

FIG. 334 is a schematic elevation of an oblate spherical structure of the same type as the spherical structure shown in FIG. 328.

Figure 335:
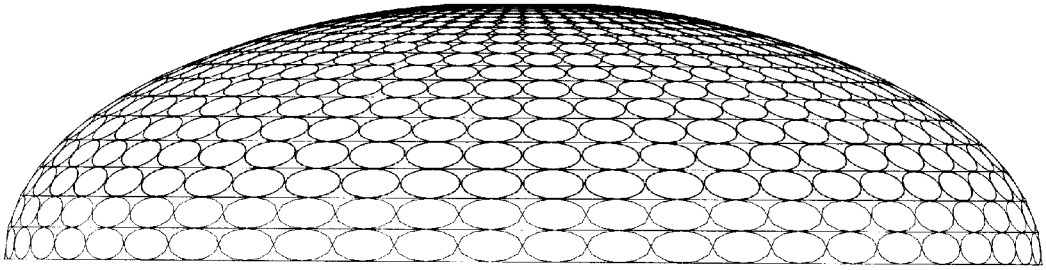

FIG. 335 is a schematic elevation of an oblate spherical dome structure identical with the upper half of the oblate spherical structure shown in FIG. 334.

Figure 336:
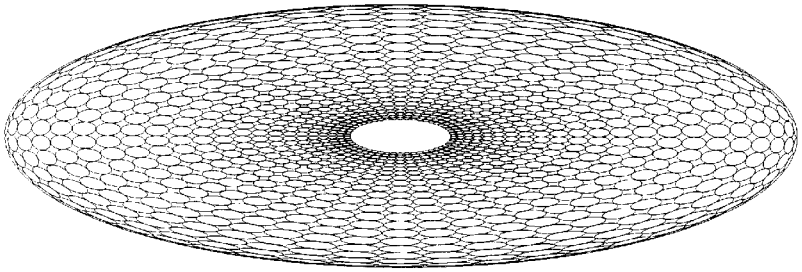

FIG. 336 is a schematic plan view of a structure of the same type as the spherical structure shown in FIG. 326 but which is prolate along one horizontal axis and oblate along the other perpendicular horizontal axis.

Figure 337:
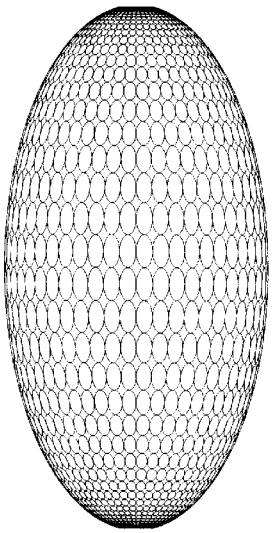

FIG. 337 is a schematic elevation of the view of prolation of the structure shown in FIG. 336.

Figure 338:
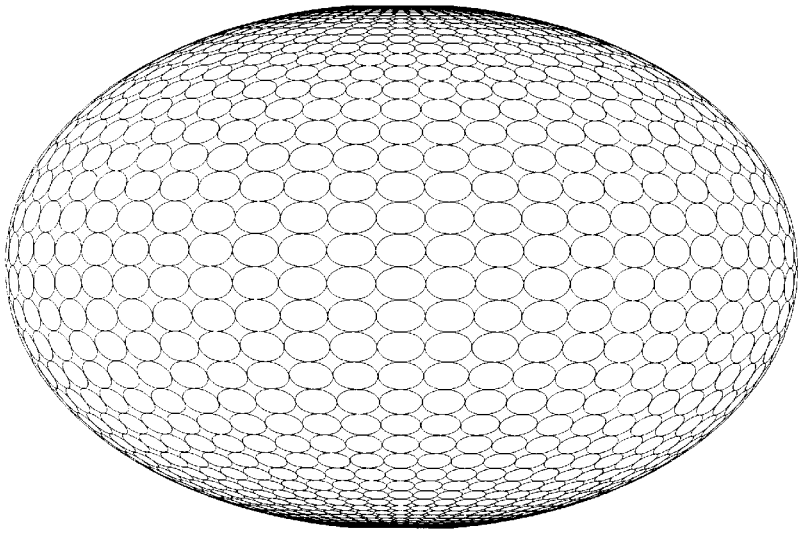

FIG. 338 is a schematic elevation of the view of oblation of the structure shown in FIG. 336.

Figure 339:
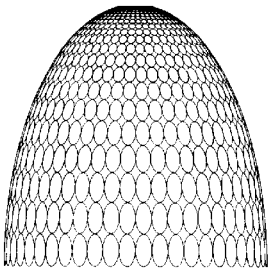

FIG. 339 is a schematic elevation of the view of prolation of a dome structure which is identical to the upper half of the structure shown in FIG. 337.

Figure 340:
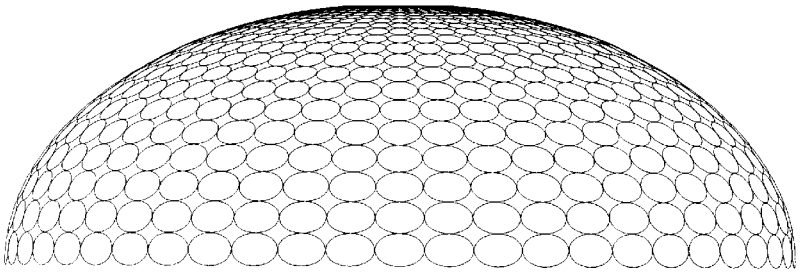

FIG. 340 is a schematic elevation of the view of oblation of a dome structure which is identical to the upper half of the structure shown in FIG. 338.

Figure 341:
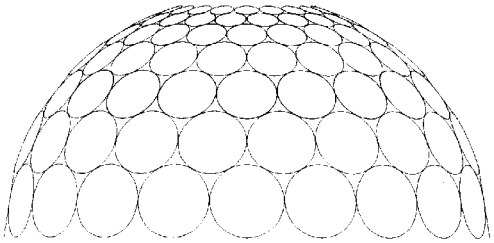

FIG. 341 is an schematic elevation of a dome structure formed by successive interleaved layers of equal numbers of toroids of upwardly diminishing diameter, each toroid connected at six points to those adjacent.

Figure 342:
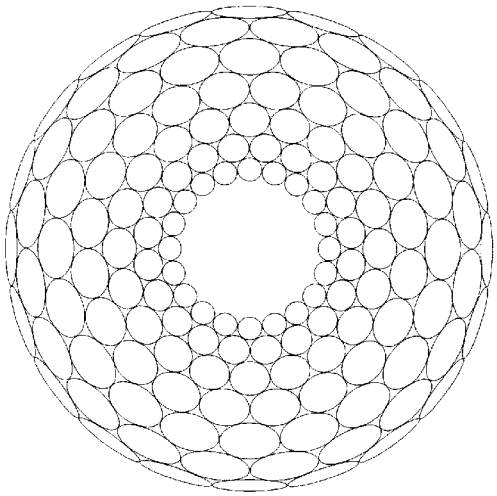

FIG. 342 is a schematic plan view of the dome structure in FIG. 341.

Figure 343:
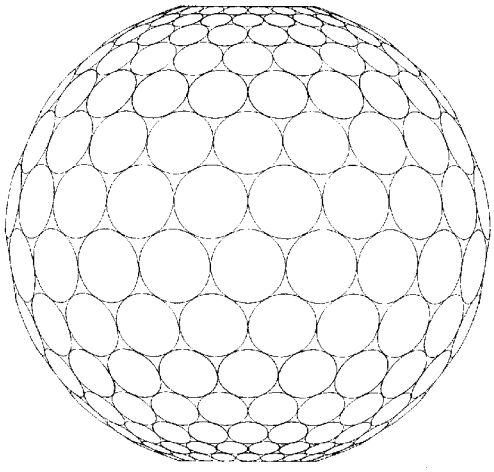

FIG. 343 is a schematic elevation of a spherical structure formed by two of the dome structures shown in FIG. 341 connected convexly opposite.

Figure 344:
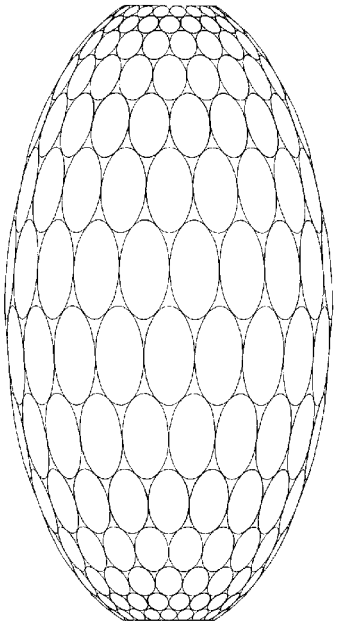

FIG. 344 is a schematic elevation of a prolate spherical structure of the same type as the spherical structure shown in FIG. 343.

Figure 345:
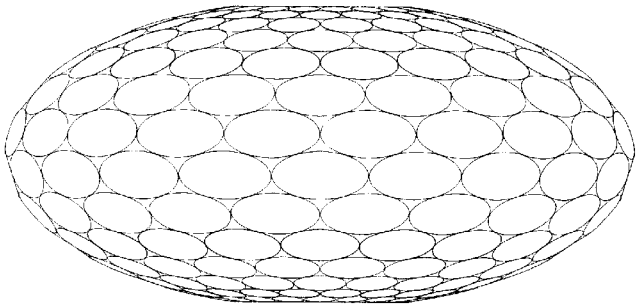

FIG. 345 is a schematic elevation of an oblate spherical structure of the same type as the spherical structure shown in FIG. 343.

Figure 346:
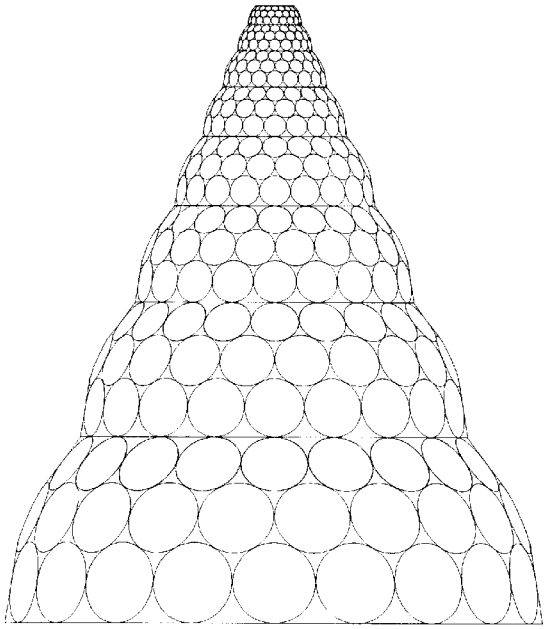

FIG. 346 is a schematic elevation of a tower structure comprised of successive layers of diminishing diameter of the first three layers of the dome structure shown in FIG. 341, with the tower layers connected to intermediate latitudinal toroidal elements.

Figure 347:
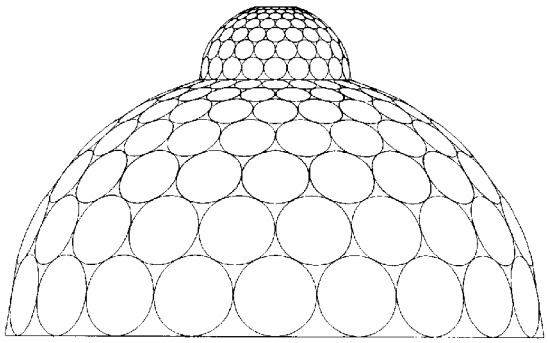

FIG. 347 is schematic elevation of the dome structure shown in FIG. 341 capped by a similar dome structure of lesser diameter to form a compound dome structure.

Figure 348:
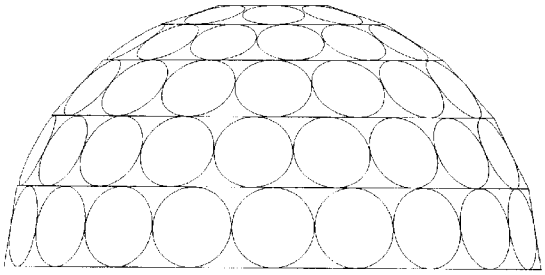

FIG. 348 is a schematic elevation of a dome structure formed by successive layers of connected toroids of upwardly diminishing number but of approximately the same diameter, with the toroids connected within each layer connected to other layers via intermediate upper and lower latitudinal toroids.

Figure 349:
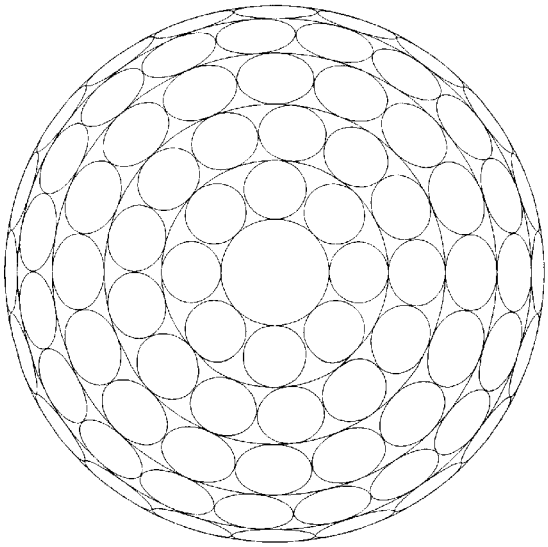

FIG. 349 is a schematic plan view of the dome structure shown in FIG. 348.

Figure 350:
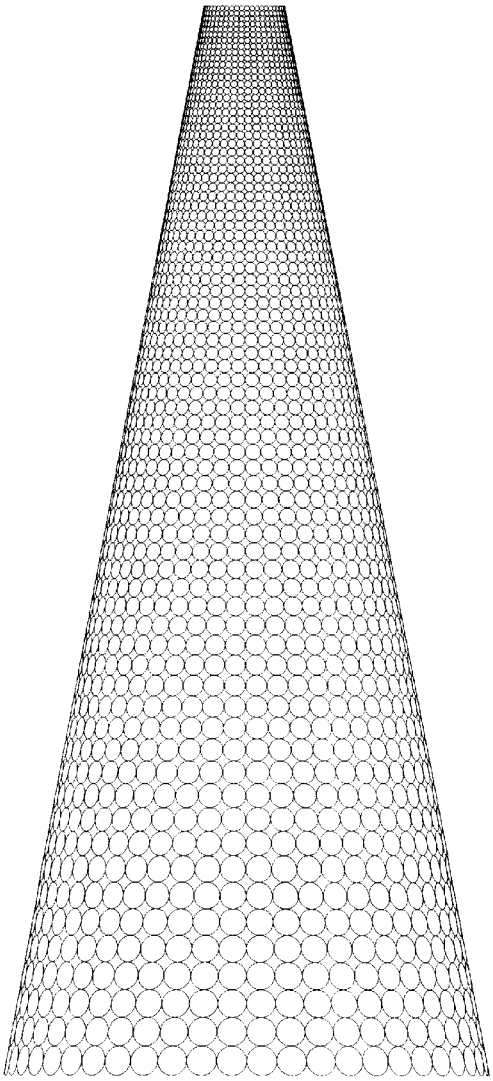

FIG. 350 is a schematic elevation of a conical tower structure formed by successive layers of equal numbers of toroids of upwardly diminishing diameter, each toroid connected at four points to those adjacent.

Figure 351:
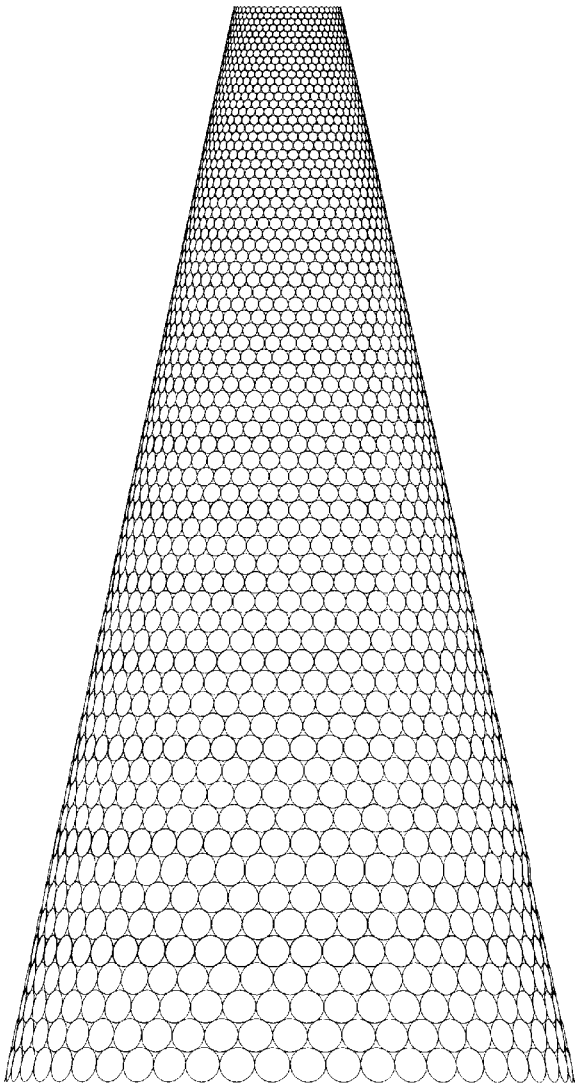

FIG. 351 is a schematic elevation of a conical tower structure formed by successive interleaved layers of equal numbers of toroids of upwardly diminishing diameter, each toroid connected at six points to those adjacent.

Figure 352:
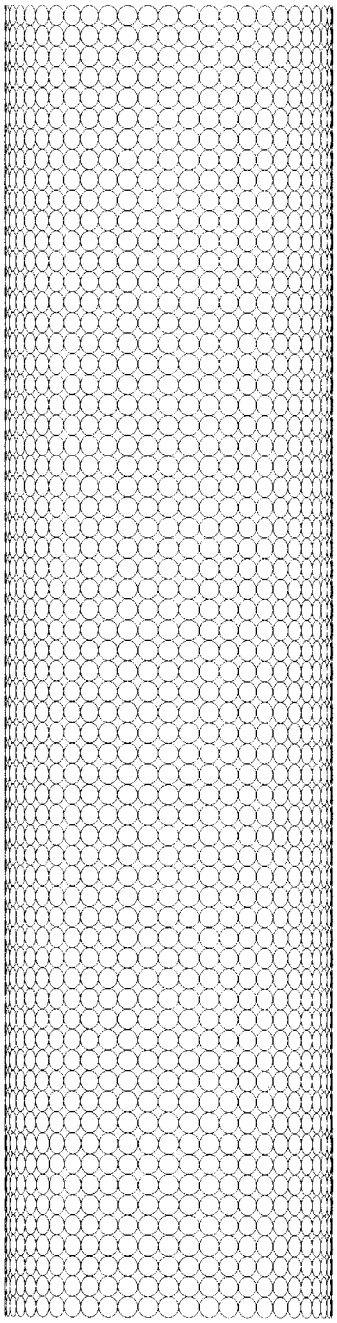

FIG. 352 is a schematic elevation of a cylindrical tower structure formed by successive layers of equal numbers of toroids of the same diameter, each toroid connected to 4 adjacent toroids.

Figure 353:
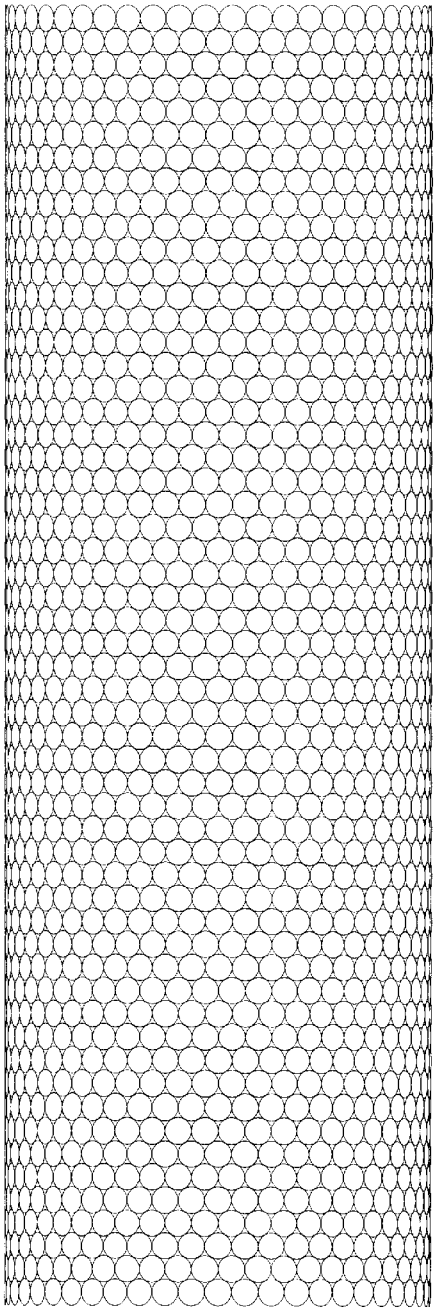

FIG. 353 is a schematic elevation of a cylindrical tower structure formed by successive interleaved layers of equal numbers of toroids of the same diameter, each toroid connected to six adjacent toroids.

Figure 354:
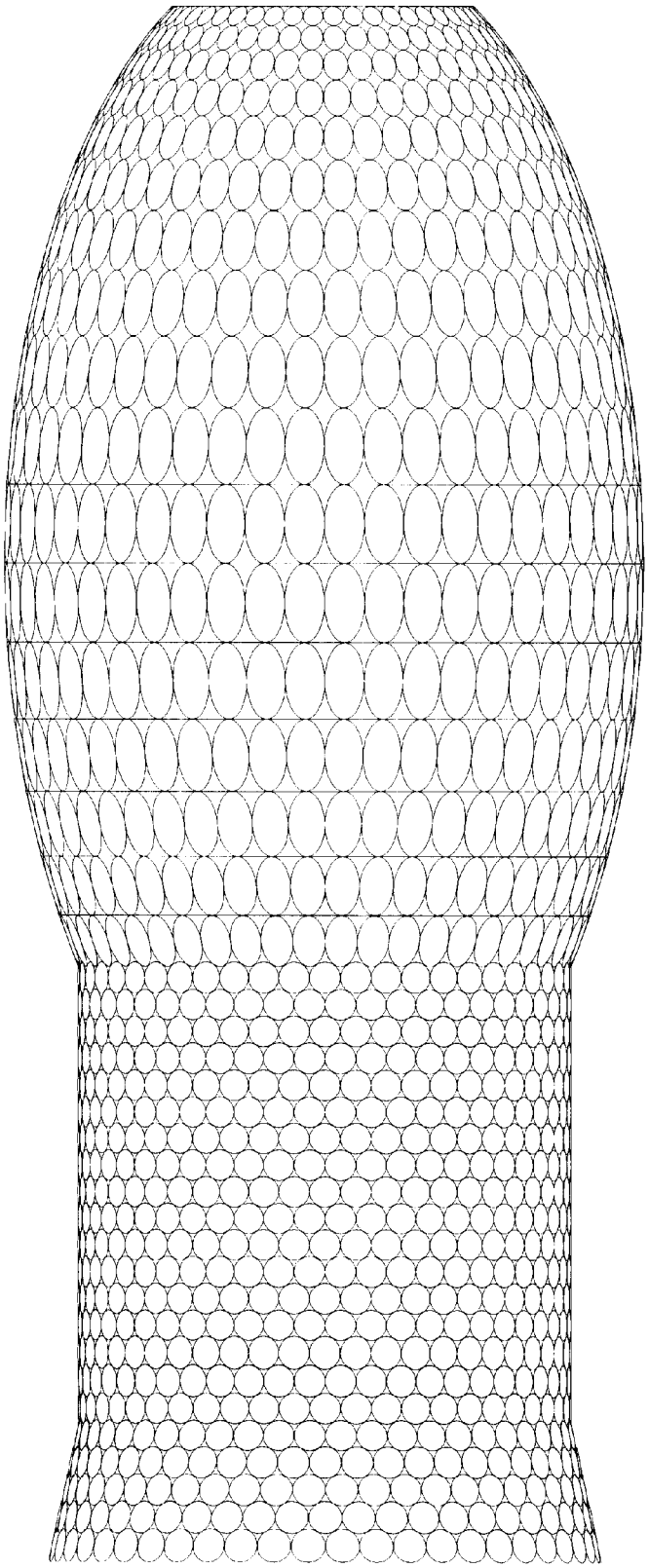

FIG. 354 is a schematic elevation of a tower structure comprised of a conical base of the same type as the conical structure shown in FIG. 351, with interleaved connection to a section of cylindrical tower structure as shown in FIG. 353, topped by an interleaved connection to a trunkated section of a prolate spherical structure as shown in FIG. 332.

Figure 355:
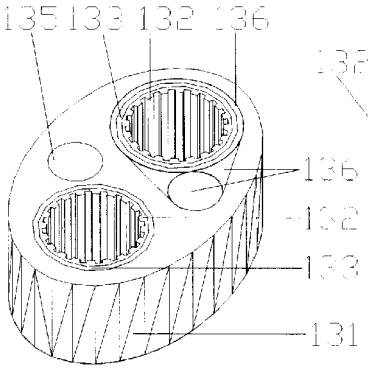
Figure 356:
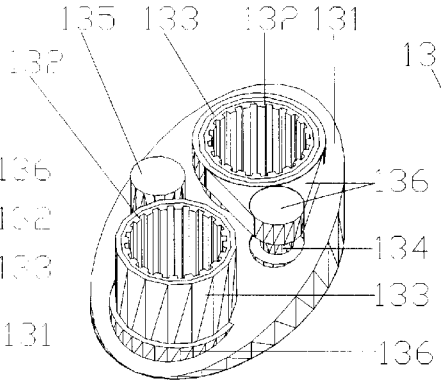
Figure 357:
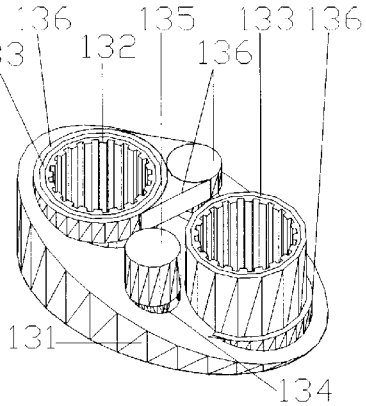

FIGS. 355, 356, and 357 are perspective views of an actuated two element coupling with spline grips, the latter two being cutaway views showing the motors, transmissions and drives for each of the spline grips within the body of the coupling.

Figure 358:
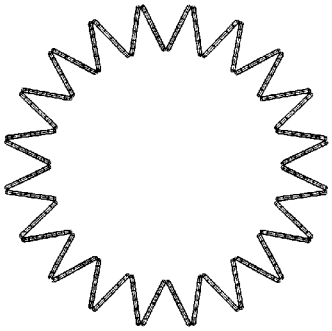
Figure 359:
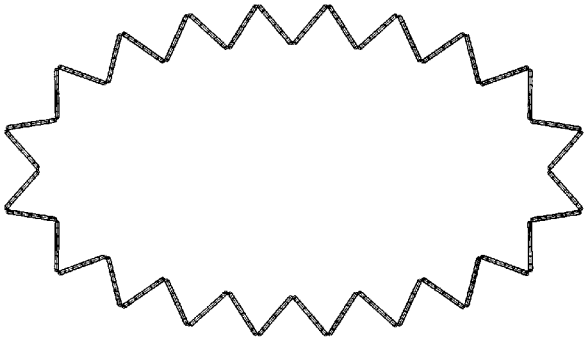
Figure 360:
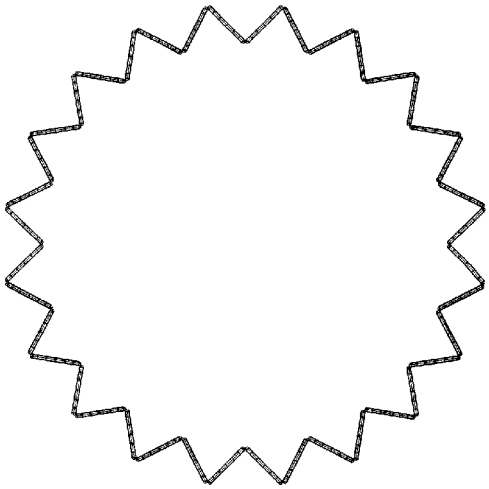
Figure 361:
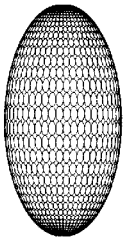
Figure 362:
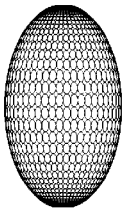
Figure 363:
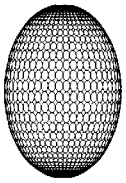
Figure 364:
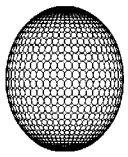
Figure 365:
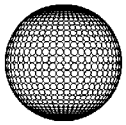
Figure 366:
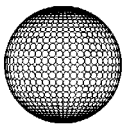
Figure 367:
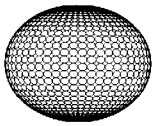
Figure 368:
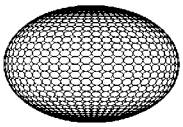
Figure 369:
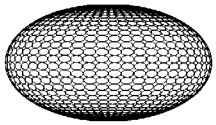
Figure 370:
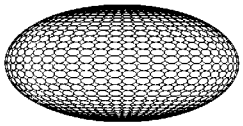
Figure 371:
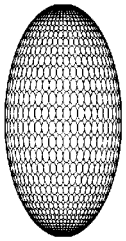
Figure 372:
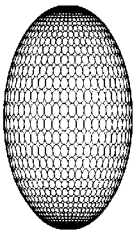
Figure 373:
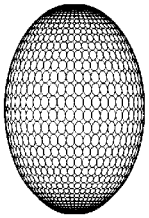
Figure 374:
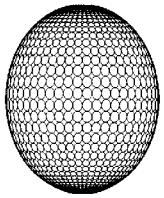
Figure 375:
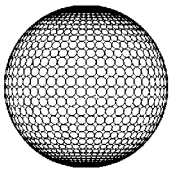
Figure 376:
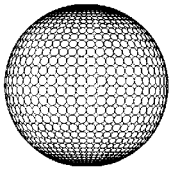
Figure 377:
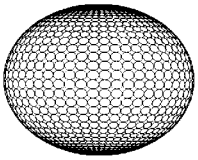
Figure 378:
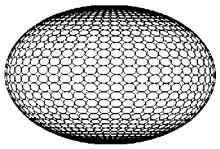
Figure 379:
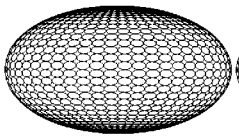
Figure 380:
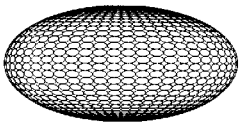

FIGS. 358, 359, and 360 show a series of plan views of a toroidal element shifting shape from that of a circular array of 40 toroidal elements forming a circular toroid to that of an elliptical array forming an elliptical toroid.

FIGS. 361 through 370 show a series of schematic elevations of the shifting of shape of a prolate spherical structure to an oblate spherical structure in phases through intermediate structures of lesser volume.

FIGS. 371 through 380 show a series of schematic elevations of the shifting of shape of a prolate spherical structure to an oblate spherical structure in phases through intermediate structures of approximately equal volume.

FIG. 381 is a schematic plan view of an 18 by 18 array of circular toroidal elements connected in a plane.

FIG. 382 is a schematic perspective view of the array of the circular toriodal elements in FIG. 381.

FIG. 383 is a schematic side view of the array of circular toriodal elements in FIG. 381 (essentially a line because the schematic has no depth).

FIG. 384 is a schematic plan view of the 18 by 18 array of the toroidal elements in FIG. 381 after having undergone shape change by actuated couplings forming a paraboloidal section.

FIG. 385 is a schematic perspective view of the paraboloid section in FIG. 384.

FIG. 386 is a schematic side view of the paraboloid section in FIG. 384.

FIG. 387 is a group of 6 connected toroidal elements which comprise the frontmost section of the spherical/dodecahedral structure in FIG. 315.

FIG. 388 is a plan view of the group of toroidal elements in FIG. 387.

FIG. 389 is a perspective view of the group of toroidal elements in FIG. 387.

FIG. 390 is a side view of the spherical/dodecahedral structure in FIG. 315 with a group of elements as shown in FIG. 387 scaled to connect to the topmost toroidal element of the structure, with a similar connection of a similar group similarly scaled to connect to the topmost toroidal element of the first group.

FIG. 391 is a top view of the structure in FIG. 390.

FIG. 392 is a perspective view of the structure in FIG. 390.

Figure 393:
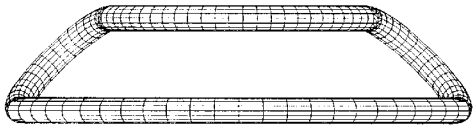

FIG. 393 is a side view of an irregular toroidal element.

Figure 394:
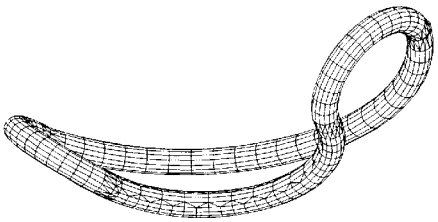

FIG. 394 is a perspective view of the toroidal element shown in FIG. 393.

Figure 395:
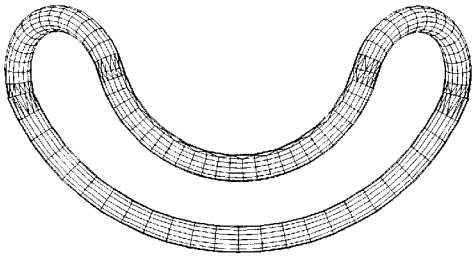

FIG. 395 is a plan view of the toroidal element shown in FIG. 393.

Figure 396:
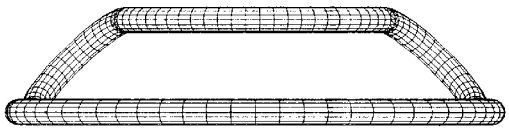

FIG. 396 is a side view of an irregular toroidal element.

Figure 397:
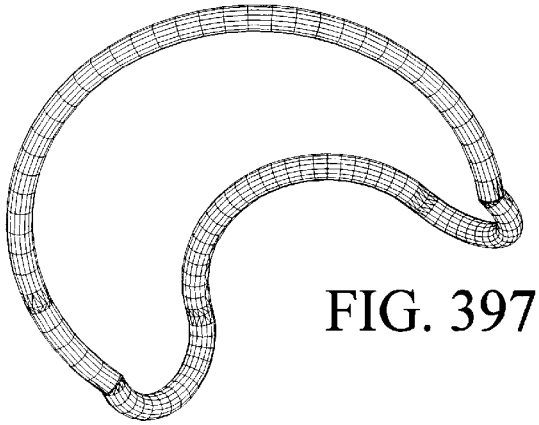

FIG. 397 is a perspective view of the toroidal element shown in FIG. 396.

Figure 398:
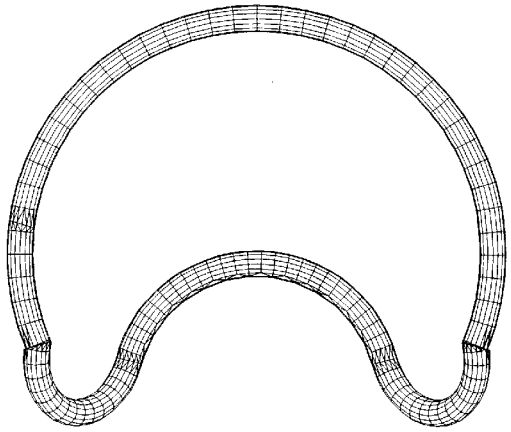

FIG. 398 is a plan view of the toroidal element shown in FIG. 396.

DETAILED DESCRIPTION OF THE INVENTION

The present invention is a structural system which employs "torsion elements" which are connected to form structures, and includes a method of construction therewith. The principle of the invention is the transmission of torsional loads by the connection of "torsion elements". As used in this description and the appended claims the term "torsion element" means a structural element that functions with torsion as its principal load bearing mode. Torsion elements use the torsional strength of materials and have the capacity to bear the torsion loads distributed to them by the connections of the structural system of which they are a part. That is, torsion elements bear loading principally as torsional load. The structural system converts most compression, tension and flexion loading of constructions using the system to torsional loading of the torsion elements of which the constructions are comprised. Thus the construction is distinguished from conventional constructions employing elements which function primarily in compression, tension or flexion, such as beams, struts, joists, decks, trusses, etc., for which torsional effects are design defects that can lead to catastrophic structural failure. However, when elements which function in compression, tension or flexion are constructed using the present invention, the same structural benefit of torsional load distribution applies.

The objects of the present invention are:

1. To provide a universal structural system for all types of immobile and mobile structures comprised of connected torsion elements and having a high degree of structural integrity, strength, efficiency, and flexibility.
2. To provide a structural system in which structural loading in the form of compression, tension and flexion is converted to torsional loading of the torsion elements of which it is constructed so that such torsion elements bear the greatest part of the structural loading.
3. To provide a structural system in which a structure constructed of torsion elements is uniformly loaded so that the material of which such torsion elements are composed is uniformly stressed, thereby achieving a high strength-to-weight ratio.
4. To provide a structural system in which loads are well distributed over all of the torsion elements.
5. To provide a structural system which is integrated and attractive in appearance, allowing for aesthetic design with self-supporting toroidal torsion elements in which curved structures are architecturally natural.
6. To provide a structural system with dynamic shape shifting and dynamic redistribution of loading by adjustable and/or actuated structural connections while maintaining structural strength and integrity.
7. To provide a structural system which is economical, adaptable to automated design, automated fabrication, and efficient in ultimate assembly, in its smallest elements and its largest structural forms.
8. To provide a structural system in which all structural characteristics of all elements can be precisely predicted, designed, and known.
9. To provide a structural system in which conventional structural elements such as beams, joists, decks, trusses, etc. can be constructed of torsion elements and incorporated in conventional structures as conventional structural elements.
10. To provide a structural system in which various torsion elements may be standardized and databased with all dimensional, material and loading characteristics so as to provide for automated selection of components for structural design therewith.
11. To provide a structural system that is compatible with conventional structural systems.

The present invention contemplates that torsion elements may be constructed of yet other torsion elements, so that a given torsion element so constructed functions to bear loads torsionally by the bearing of structural loads by its constituent substructures. Such substructures may be structural elements, torsional, conventional, or otherwise, which are part of a combination of structural elements of a scale similar to the given torsion element; or structural elements, torsional, conventional, or otherwise, of a scale significantly smaller than the given torsion element and fundamentally underlying the torsion bearing capacity of the given torsion element. In the latter case the structure of a given torsion element may be the replication of small substructures of torsional elements, which in turn may be replications of still smaller substructures of torsion elements. This process of structural replication can be continued to microscopic, and even molecular, levels of smallness.

The system also includes the construction of conventional elements using torsion elements which may be used in combination with other torsion structures in constructions. Moreover, it is one of the features of the present system that conventional elements, such as beams, joists, decks, trusses, etc., so constructed using torsion elements, may be engineered with arching camber and prestressing. Although some torsion elements may bear some resemblance to conventional trusses, the structural integrity and strength of torsion elements is ultimately dependent on torsion elements bearing torsion loads, and is not fundamentally (in the sense of originally underlying) dependent on elements such as chords and struts bearing loads in compression, tension or flexion.

Torsion elements can be made of virtually any material suitable for the loads to which the structure may be subjected and for the environment in which the structure may be utilized.

It is the fundamental principle of the structural system which is the present invention that torsion elements bear as torsional load the greatest part of the load placed on the structures of which they are a part, excepting localized forces existing in the connection of the torsion elements, and evenly distribute such loading among the connected torsion elements of which the structures are ultimately and fundamentally constructed.

The present invention contemplates that structures constructed of connected torsion elements may be incorporated in yet other structures together with conventional structural elements in order to bear compression, tension and flexion loads with such torsion structures.

Torsion elements may have virtually any shape that allows them to be connected and thereby function by torsional loading. However, the preferred embodiment of the present invention employs torsion elements which are toroidal in shape. Such toroidal torsion elements may be used to create a variety of new structural forms for both stationary and moveable structures. The toroidal shape facilitates replication of structured toroidal torsion elements to produce larger and larger toroidal torsion elements which may be suitable for the dimension of the ultimate structural application.

As used in this description and the appended claims the term "toroidal" means of or pertaining to a "toroid". The term "toroid" is not intended to limit the present invention to employment of elements that are in the shape of a torus, which is mathematically defined as a surface, and the solid of rotation thereby bounded, obtained by rotating a circle which defines the cross section of the tube of the torus about an axis in the plane of the circular cross section. As used in this description and the appended claims the term "toroid" means any form with the general features of a torus, i.e. a tube, cylinder or prism closed on itself, without regard to any regularity thereof, and further means any tubular, cylindrical or prismatic form which is closed on itself in the general configuration of a torus, thus completing a mechanical circuit forming the "tube" of a "toroid", regardless of the shape of the cross section thereof, which may even vary within a given "toroid". A toroid may be formed by the connection of cylindrical or prismatic sections, straight or curved, or by the connection of straight and curved sections in any combination or order; and may be of any shape which the closed tube may form: elliptical, circular, polygonal, whether regular or irregular, symmetrical, partially symmetrical, or even asymmetrical, whether convex or concave outward, partially or completely. Moreover, as used in this description and the appended claims, the term "toroid" applies to and includes: (a) the continuous surfaces of toroids, tube walls of finite thickness, the exterior of which are bounded by the toroidal surface, and the solids that are bounded by the toroidal surface; (b) any framework of elements which if sheathed would have the shape of a toroid; (c) any framework of elements which lays in the locus of a toroidal surface; (d) a bundle or coil of fibers, wires, threads, cables, or hollow tubing that are, bound, wound, woven, twisted, glued, welded, or otherwise bonded together in such a manner as to form in their plurality or individuality a toroidal shape. The principal feature of a toroidal structural element is that it has no non-toroidal conventional cross-bracing, diametrical or chordal, within the interior perimeter of its tube that functions by compression, tension or other loading. However, a toroidal torsional element may be reinforced within the interior perimeter of its tube by other toroidal elements, which may be torsional, conventional or otherwise.

A large variety of structures made feasible by origination of the replication process with torsion elements on the order of nanostructures or larger may themselves be considered as materials which can be utilized in conventional structures, such as decking, plates, skins, and sheeting of arbitrary curvature.

Erection of structural frames using the present invention requires only connection of the torsion elements, and may use connectors which are prepositioned and even integrated in the design of the torsion elements.

The structural system is comprised of a plurality of torsion elements connected together so that there is no substantial movement of the torsion elements in relation to one another in the connection. Two or more torsion elements may be connected in the same connection. The connection of the torsion elements is the means by which torsion loading is transmitted between and distributed among the torsion elements.

As used in this disclosure and the appended claims the term "connected" means, in addition to its ordinary meaning, being in a "connection" with torsion/toroidal elements; and the term "connection" as used in this disclosure includes, in addition to its ordinary meaning, any combination of components and processes that results in two or more structural elements being connected, and further includes the space actually occupied by such components, the objects resulting from such processes, and the parts of the structural elements connected by contact with such components or objects.

As just indicated the term "connection" as used as in this disclosure includes, in addition to its ordinary meaning, any combination of components and processes that results in two or more structural elements being connected, and further includes the space actually occupied by such components, the objects resulting from such processes, and the parts of the structural elements connected by contact with such components or objects.

Torsion elements may be connected by any means that does not permit unwanted movement in the connection. Such means may be any type of joining, such as welding, gluing, fusing, or with the use of fasteners, such as pins, screws and clamps. However, the preferred means for connection is by use of a "coupling". The term "coupling" is used in this disclosure to mean a device which connects two or more torsion elements by holding them in a desired position relative to one another, so that when the desired positions of the torsion elements are achieved, the torsion elements will not be able to unwantedly move relative to each other within the coupling. The coupling may itself be constructed of torsion elements, or may be solid or have some other structure. The term "coupling" also includes a device which connects a torsion element to a conventional structural element by holding both the torsion element and the conventional structural element so that when the desired position is achieved, the elements will not be able to unwantedly move relative to each other within the coupling. Although, the function of couplings is to hold torsion elements in position in relation to each other, there may be motion of the torsion elements outside the connection associated with the structural loading of the elements, including rotation of the elements with respect to each other about the axis defined by the grip within the coupling, and sliding of the elements through the grip of the coupling.

The function of couplings in holding the elements in position may be combined with prior positional adjustment and actuation of such adjustment. In this respect the position of torsion elements connected by a coupling may be changed or adjusted with respect to one another and then held in the desired position. Accordingly, the coupling must be designed to have the capability for such adjustment, and may also be designed to have such adjustment actuated by some motive power. Such actuation may implement dynamic distribution of torsional loading among the elements affected, or implement dynamic shape shifting, or both. This can be achieved by making one or more connections of the torsion structure adjustable, with or without the use of actuation. Moreover, such powered actuation of adjustable coupled connections may be computer controlled in order to precisely determine the shape changes and structural effects desired. The function of such a coupling, therefore, is to adjust the coupled connections, with or without the use of such controlled actuation, so that a torision element may be moved within a connection in relation to other structural elements connected therein, and then firmly held by the connection in the position resulting from such movement so that the torsion element will not have substantial movement within the connection in relation to any other torsion element in the connection unless deliberately moved again by the coupling.

The use of the invention includes every conceivable structure: bridges, towers, furniture, aircraft, land and sea vehicles, appliances, instruments, buildings, domes, airships, space structures and vehicles, and planetary and space habitats. The magnitude of such structures contemplated and made structurally and economically feasible by the system range from the minute to the gigantic. The structures that are possible with the use of the present invention are not limited to any particular design, and may even be freeform.

Some of the structural forms can be applied to construct buildings for unstable foundation conditions and which can survive foundation movement and failure. The use of toroidal torsion elements may also be applied to create structures which are dynamic, with the constituent elements capable of movement by design, not only by deflection as a result of loading, but also by the active management of structural stresses. Toroidal torsion elements may also be varied in shape dynamically so as to achieve alteration of the shape, size and volume of the structure of which they are constituent.

To present the details of the system, the function of its elements, and the method by which structures are constructed using the system, reference is made to the drawings.

FIGS. 1–4 show an embodiment which demonstrates the fundamental principles of the structural system. In FIGS. 1–4 two torsion elements 3, 4 are connected by two couplings 1, 6 to form a torsional structural module. The torsion elements 3 and 4 are shown as open rectangles with a circular cross section to demonstrate the principle, but any cross sectional shape and any element shape may be used with couplings having compatible openings.

The couplings shown 1, 6 have cylindrical openings, coupling 6 having bearings 7 which allow for free rotational movement of the torsion elements 3, 4 within the coupling 1, and coupling 1 having spline grips 2 to engage the spline ends 5 of the torsion elements 3, 4. The purpose of the spline ends 5 being engaged by corresponding spline grips 2 is to hold the torsion element firmly in relation to the coupling 1 so as to prevent movement of the torsion element 3, 4 within the coupling 1. The purpose of the couplings 6 with bearings is to constrain the arms of the torsion elements 3 and 4 to be in alignment under the action of the forces. Thus, when the torsion element 3 is subjected to a force which attempts to rotate the arm of torsion element 3 about its axis in relation to the coupling 1 within which it is engaged, the force will result in a torsion load on the arm where the position of coupling 1 is fixed. Where the position of coupling 1 is not fixed, such an attempt to change the orientation of the torsion element 3 will also result in a rotation of the coupling 1 with torsion element 3 in relation to the torsion arm of the other torsion element 4 which is also engaged within coupling 1. This attempt to rotate the coupling 1, the spline grip 2 of which is engaged to the spline 5 of torsion element 4, will result in a torsion load on the arm of the other torsion element 4 where the position of torsion element 4 is fixed. Thus any change in the position of one torsion element 3 connected to another 4 by an engaged coupling 1 will result in transmission of the torsion load on one torsion element 3 to the other 4. The role of coupling 6 is to assist in maintaining the alignment of the arms of the torsion elements 3 and 4.

Another embodiment which demonstrates the principles of the structural system is shown in FIGS. 5–8. This embodiment uses the same type of torsion elements 13, 14 as in FIGS. 1–4, each having splines 15 at the ends of their arms, but connected in opposite orientation to form a torsion structural module. The couplings 19, are different, however, in that each has one side with a spline grip 12, and one with a bearing 17. The operation of the torsional module is essentially the same as in the one shown in FIGS. 1–4 in that the application of a force on one torsion element 13 connected to another 14 will result in the transmission of the torsional load on one torsion element 13 to the other 14. However, the role of the couplings 19 is somewhat different in that the force applied to one torsion element 13 is not directly transmitted to the other 14 by the bearing 17 side of the coupling 19. When a force is applied to attempt to change the position of one torsion element 13, the lower coupling 19 to which it is engaged by the spline grip 12 will be subjected to a torque. The lower coupling 19, however, is free to rotate about the arm of the other torsion element 14, which is connected on its side of the coupling by a bearing 17. The upper end of the arm of the torsion element 13 to which the force is applied is also free to rotate within the upper coupling 19, but the spline grip 12 thereof is fixed by its engagement with the spline 15 at the upper end of the arm of the other torsion element 14. Therefore, where the torsion element 14 is held in position and a force is applied to change the position of the other torsion element 13 by rotation about the axis of the arm of the other torsion element 13 with which the torsion element 14 is engaged, the bearings 17 of the couplings 19 constrain the motion of the arms of both of the torsion elements 13, 14 in the region of the bearings 17 to such rotation of the arms. This is accomplished by the bearing 17 side of the couplings by maintaining the alignment of the arms of the torsion elements 13 and 14. In this way the torsion load on one arm of the torsion element 13 is transmitted to the connected arm of the other torsion element 14. That is, when a force is applied to rotationally change the position of one torsion element 13, a torsion load is transmitted to the arm of the other torsion element 14 to which it is connected.

Another embodiment which demonstrates the principle is shown in FIGS. 9–12. In this variation the orientation of the torsion elements is the same as that in the torsion module shown in FIGS. 5–8, but with the transmission of torque loading accomplished with couplings 21, 26 similar to those in FIGS. 1–4 through the addition of an intermediate torsion element 28, in this case a cylindrical bar. Again the purpose of the splines 25 is to engage the spline grips 22 of the couplings 21, thus fixing their rotation with that of the torsion elements 23, 24, and the purpose of the couplings 26 with bearings 27 is to constrain the movement of the arms of the torsion elements 23, 24 and the intermediate torsion element 28 to rotation in alignment with each other. In this variation the intermediate torsion element 28 is acted upon with opposing torque by connection at its opposite ends with couplings 21 that transmit the load on the torsion elements 23 and 24. The transmission of load to the intermediate torsion element 28 occurs in the same manner as the transmission of load between the torsion elements 3 and 4 of the module shown in FIGS. 1–4. Therefore, the load transmitted to the intermediate torsion element 28 by one torsion element 23 is opposite to the torsional load transmitted from the other torsion element 24. In this way the intermediate element 28 provides for additional capacity for bearing of torsional loading by the structural module.

Although a means of connection between torsion elements 23 and 24 via a single intermediate torsion element 28 is shown in FIGS. 9–12, the connection between torsion elements 23 and 24 as shown in FIGS. 9–12 may be accomplished using more than one intermediate torsion element and the appropriate combination and placement of couplings in a manner similar to those shown in FIGS. 1–12.

In all three of the foregoing variations torsional load is distributed equally among the connected torsion elements by their action upon each other as understood with Newton's third law, which may be stated in part as: "To every action there is always opposed an equal reaction".

The spline grip couplings and the corresponding spline ends of torsion elements shown in FIGS. 1–12 are not the only means contemplated for achieving fixed connections between torsion elements and couplings. Indeed all means of fixing a coupling to a torsion element, such as welding, gluing, fusing, pinning, screwing, clamping, and the mating of the coupling with a torsion element of any non-circular cross section, are contemplated as appropriate in order for a coupling connecting torsion elements to transmit torsional loading.

Figure 1:
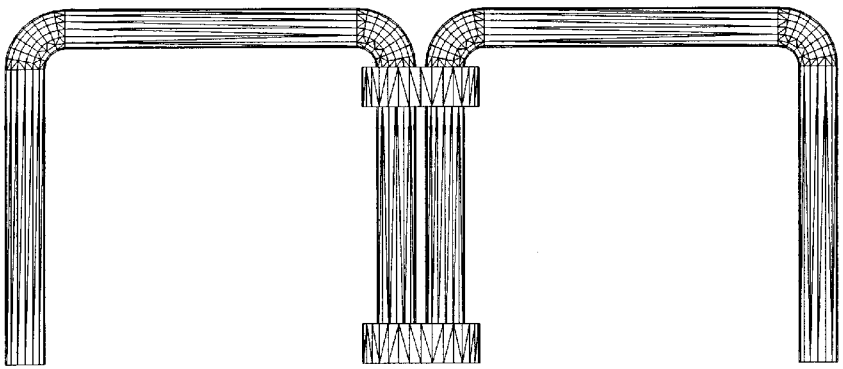
FIG. 1 is a plan view of two open rectangle torsion elements connected in the same orientation by two couplings.
Figure 2:
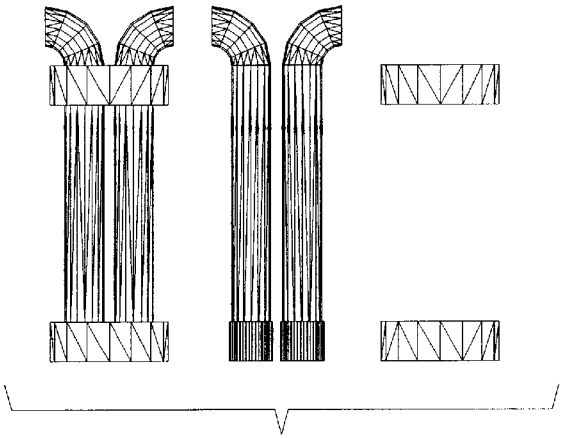
FIG. 2 is an exploded view of the connection of the open rectangle torsion elements shown in FIG. 1.
Figure 3:
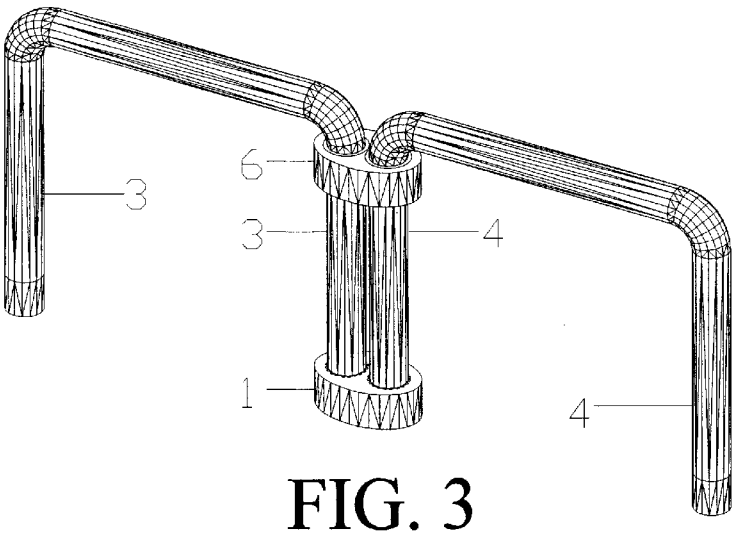
FIG. 3 is a perspective view of the torsion elements in FIG. 1.
Figure 4:
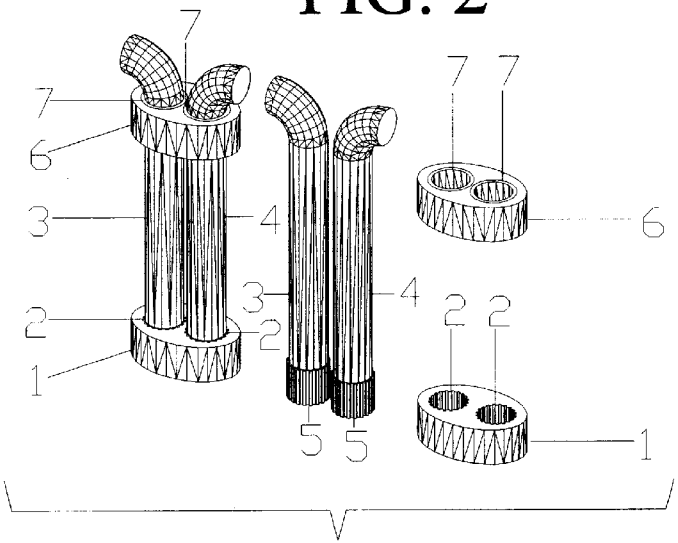
FIG. 4 is an exploded view of the connection of the open rectangle torsion elements shown in FIG. 3.
Figure 5:
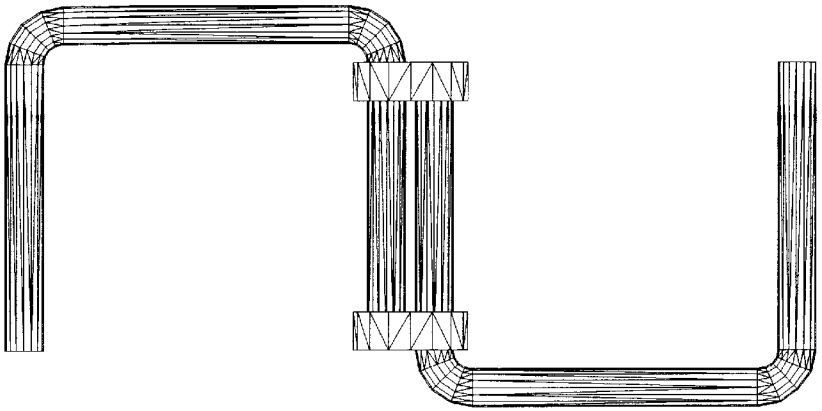
FIG. 5 is a plan view of two open rectangle torsion elements connected in opposite orientation by two couplings.
Figure 6:
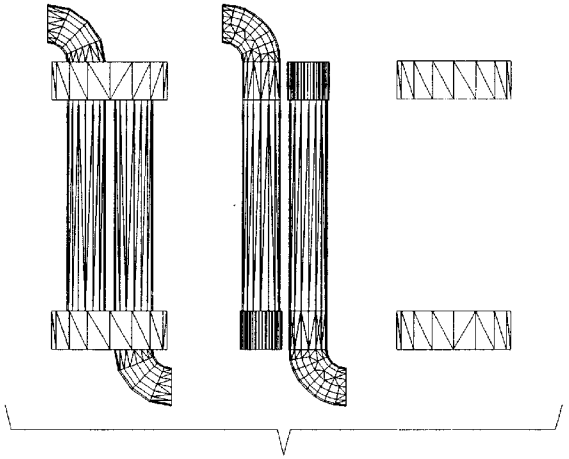
FIG. 6 is an exploded view of the connection of the open rectangle torsion elements shown in FIG. 5.
Figure 7:
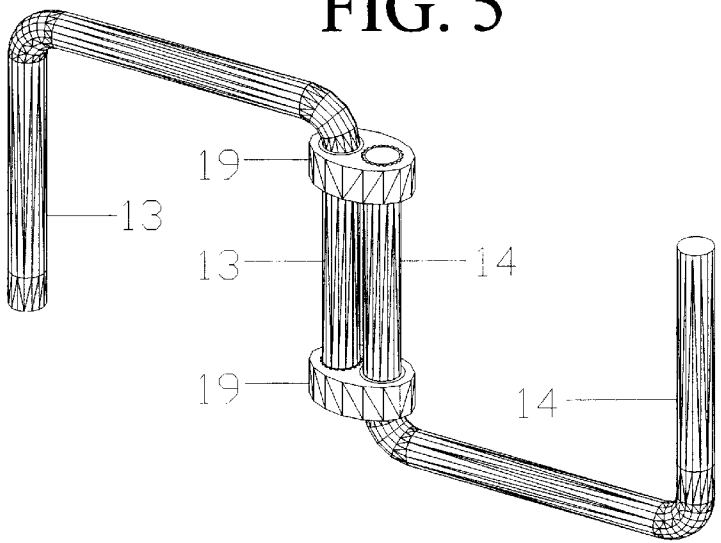
FIG. 7 is a perspective view of the torsion elements in FIG. 5.
Figure 8:
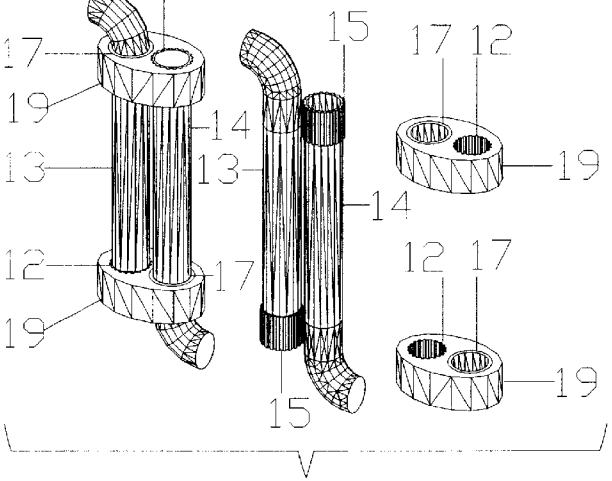
FIG. 8 is an exploded view of the connection of the open rectangle torsion elements shown in FIG. 7.
Figure 10:
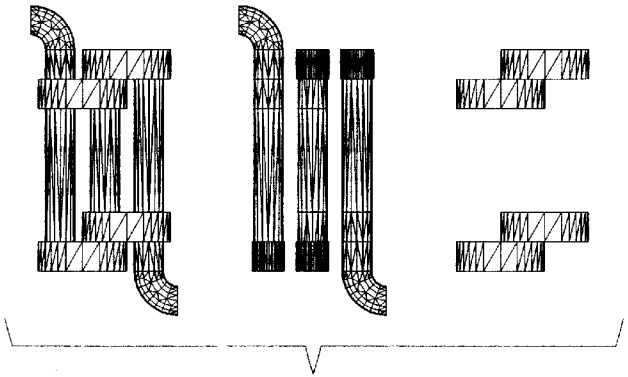
FIG. 10 is an exploded view of the connection of the open rectangle torsion elements shown in FIG. 9.
Figure 9:
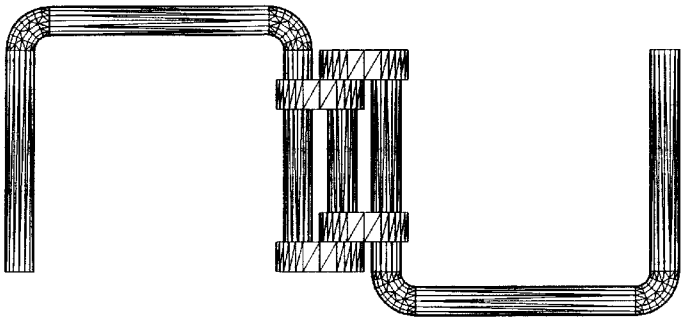
FIG. 9 is a plan view of two open rectangle torsion elements connected in opposite orientation via an intermediate torsion element by four couplings.
Figure 12:
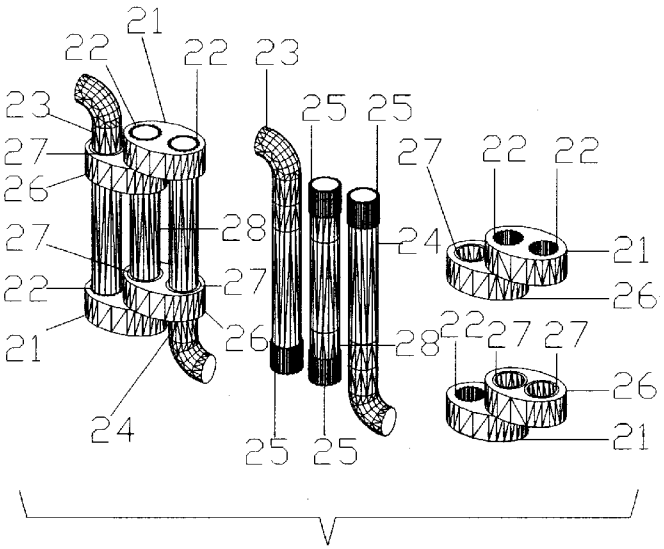
FIG. 12 is an exploded view of the connection of the open rectangle torsion elements shown in FIG. 11.
Figure 11:
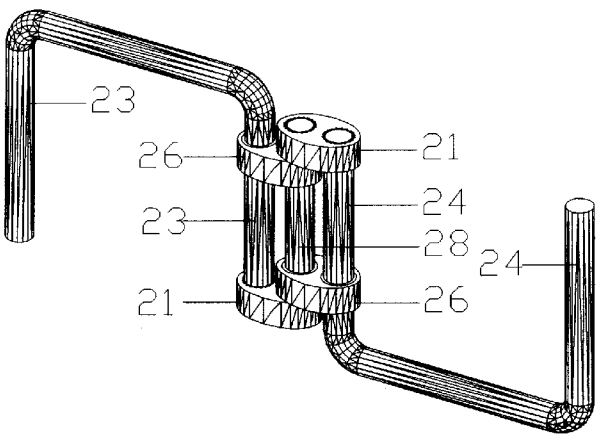
FIG. 11 is a perspective view of the torsion elements in FIG. 9.
Figure 13:
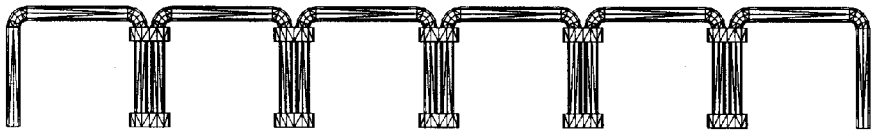
FIG. 13 is a plan view of the open rectangle torsion elements shown in FIG. 1 connected in a linear array.
Figure 14:
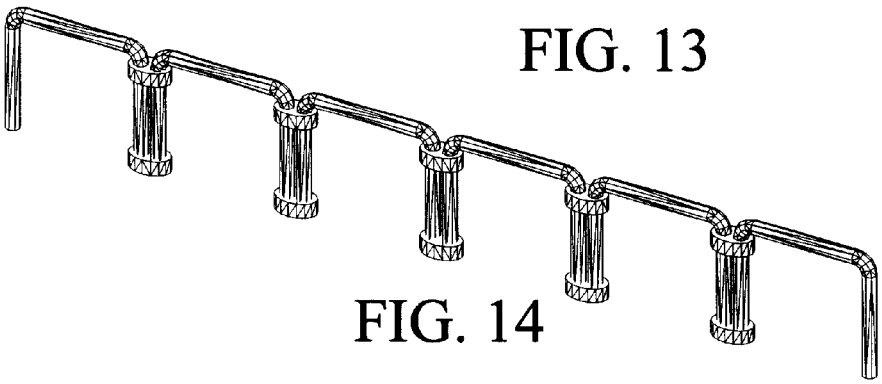
FIG. 14 is a perspective view of the linear array shown in FIG. 13.
Figure 15:
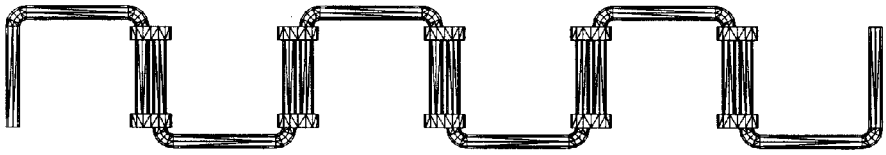
FIG. 15 is a plan view of the open rectangle torsion elements shown in FIG. 5 connected in a linear array.
Figure 16:
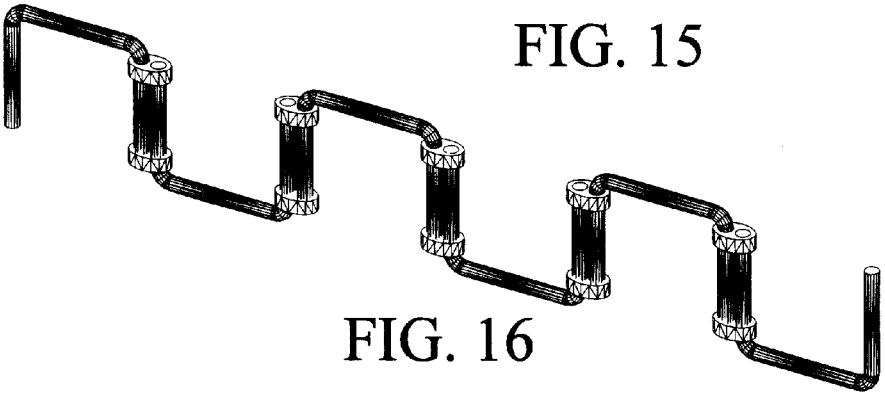
FIG. 16 is a perspective view of the linear array shown in FIG. 15.
Figure 17:
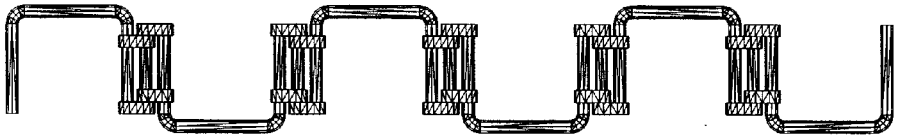
FIG. 17 is a plan view of the open rectangle torsion elements shown in FIG. 9 connected in a linear array.
Figure 18:
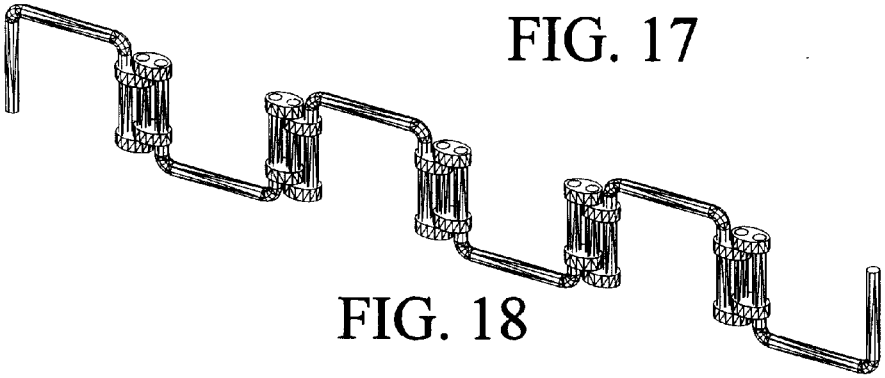
FIG. 18 is a perspective view of the linear array shown in FIG. 17.
Figure 19:
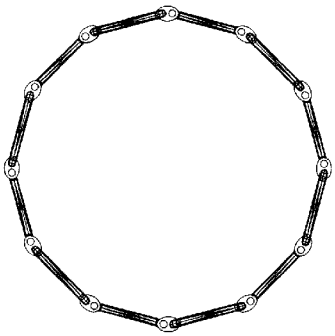
FIG. 19 is a plan view of the open rectangle torsion elements shown in FIG. 5 connected in a circular array.
Figure 20:
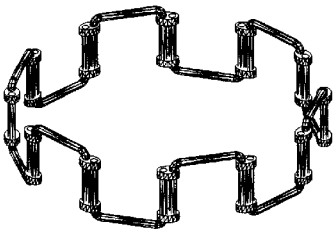
FIG. 20 is a perspective view of the circular array shown in FIG. 19.
Figure 21:
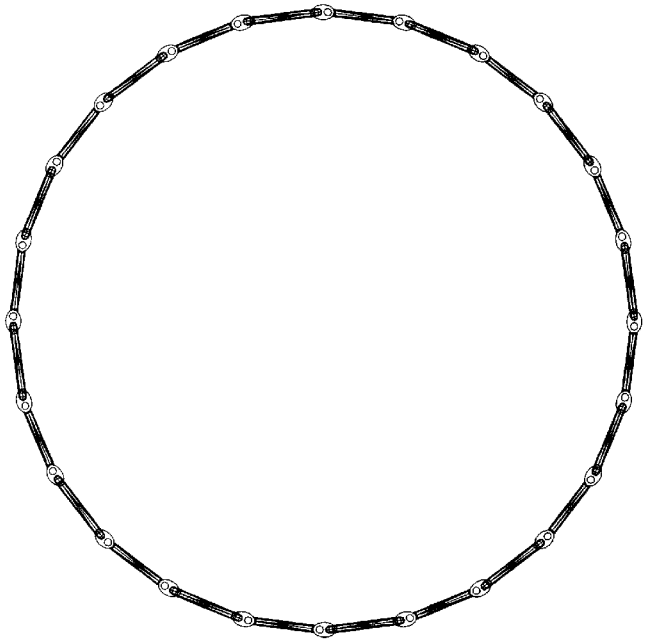
FIG. 21 is also a plan view of the open rectangle torsion elements shown in FIG. 5 connected in a circular array.
Figure 22:
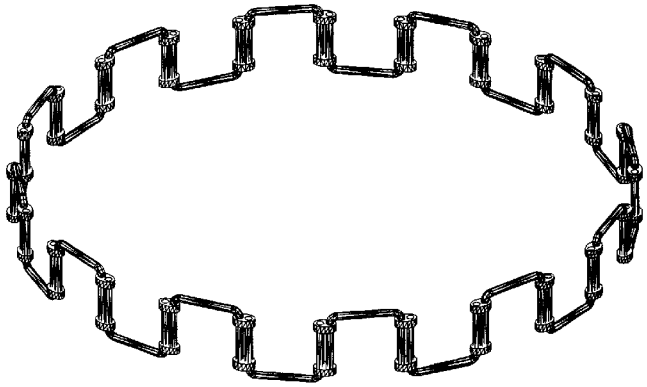
FIG. 22 is a perspective view of the circular array shown in FIG. 21.
Figure 23:
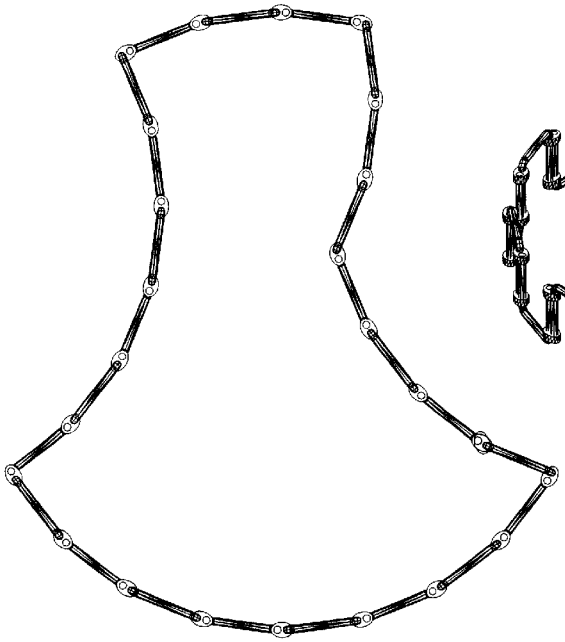
FIG. 23 is a plan view of the open rectangle torsion elements shown in FIG. 5 connected in an irregular array.
Figure 24:
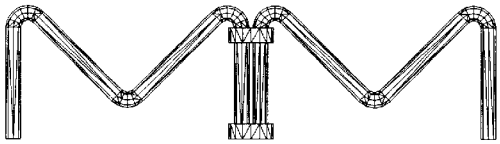
FIG. 24 is a plan view of two 'M'-shaped open rectangle torsion elements connected in the same orientation by two couplings.
Figure 25:
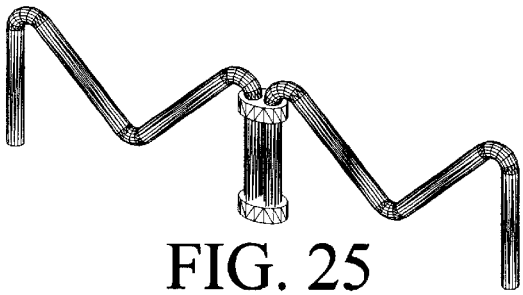
FIG. 25 is a perspective view of the torsion elements in FIG. 24.
Figure 26:
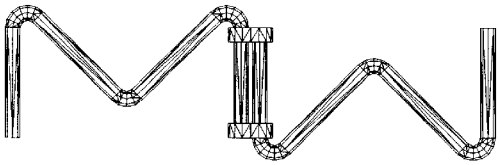
FIG. 26 is a plan view of two 'M'-shaped open rectangle torsion elements connected in opposite orientation by two couplings.
Figure 27:
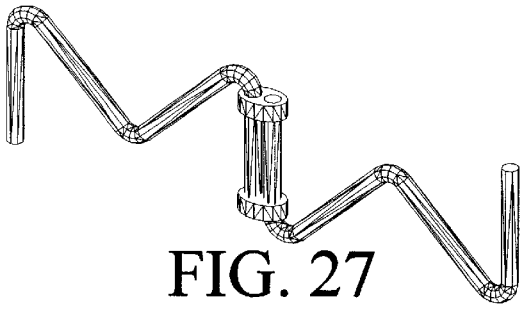
FIG. 27 is a perspective view of the torsion elements in FIG. 26.
Figure 28:
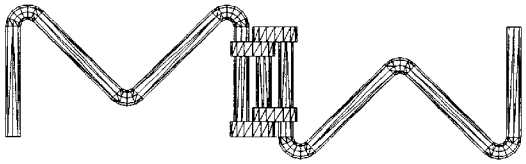
FIG. 28 is a plan view of two 'M'-shaped torsion elements connected in opposite orientation via an intermediate torsion element by four couplings.
Figure 29:
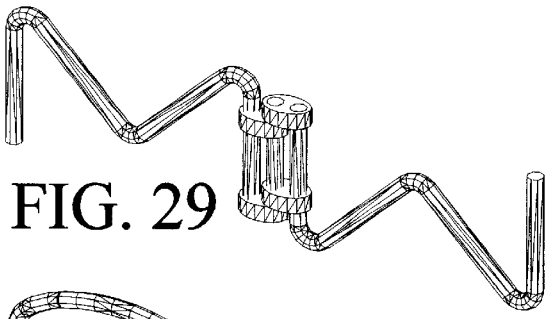
FIG. 29 is a perspective view of the torsion elements in FIG. 28.
Figure 30:
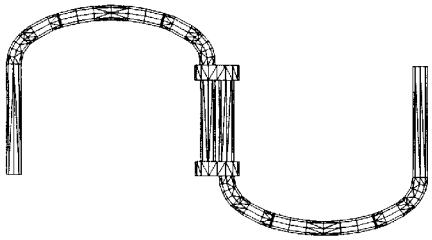
FIG. 30 is a plan view of two 'U'-shaped open rectangle torsion elements connected in opposite orientation by two couplings.
Figure 31:
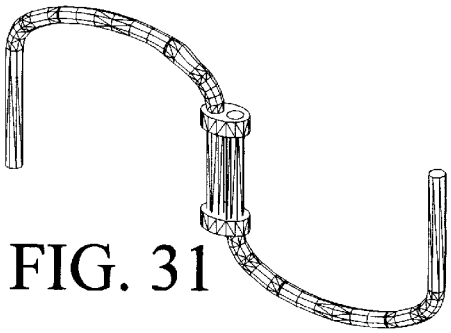
FIG. 31 is a perspective view of the torsion elements in FIG. 30.
Figure 32:
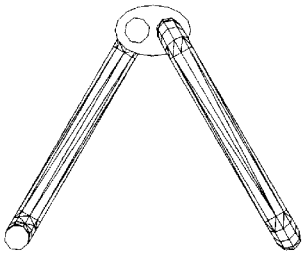
FIG. 32 is a side view of two open rectangle torsion elements shown in FIG. 5 connected to each other at an angle by two couplings.
Figure 33:
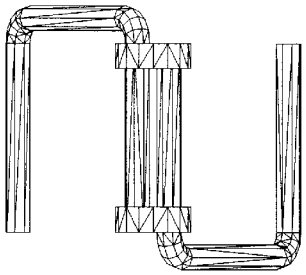
FIG. 33 is a plan view of the torsion elements in FIG. 32.
Figure 34:
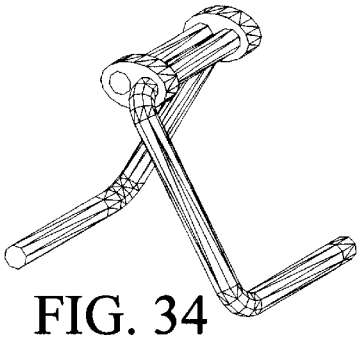
FIG. 34 is a perspective view of the torsion elements in FIG. 32.
Figure 36:
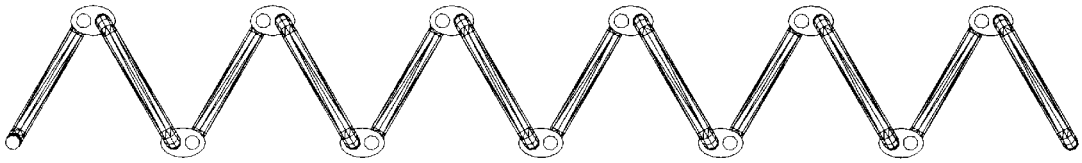
FIG. 36 is a side view of 6 connected pairs of open rectangle torsion elements shown in FIG. 32 connected in a linear array.
Figure 35:
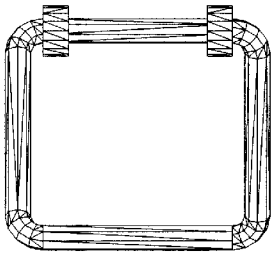
FIG. 35 is an end view of the torsion elements in FIG. 32.
Figure 37:
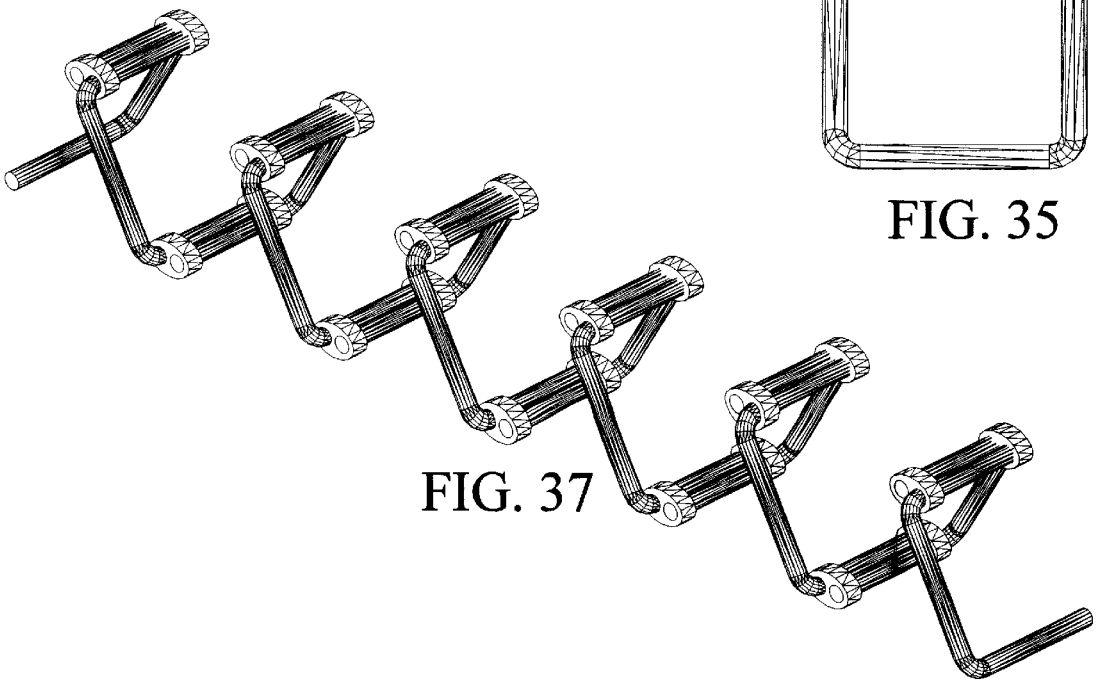
FIG. 37 is a perspective view of the linear array shown in FIG. 36.
Figure 38:
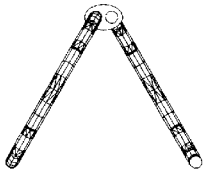
FIG. 38 is a side view of two 'U'-shaped torsion elements shown in FIG. 30 connected at an angle in opposite orientation by two couplings.
Figure 39:
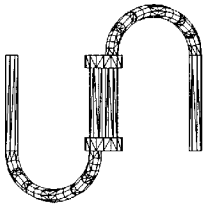
FIG. 39 is a plan view of the torsion elements in FIG. 38.
Figure 40:
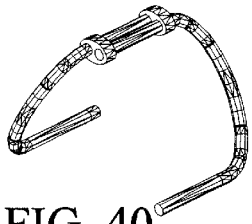
FIG. 40 is a perspective view of the torsion elements in FIG. 38.
Figure 41:
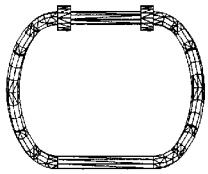
FIG. 41 is an end view of the torsion elements in FIG. 38.
Figure 42:
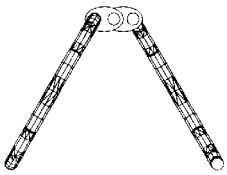
FIG. 42 is a side view of two 'R'-shaped torsion elements shown in FIG. 30 connected at an angle in opposite orientation by four couplings via an intermediate torsion element.
Figure 43:
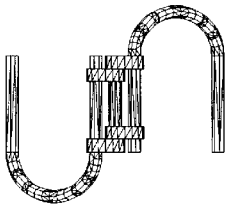
FIG. 43 is a plan view of the torsion elements in FIG. 42.
Figure 44:
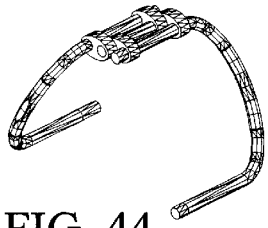
FIG. 44 is a perspective view of the torsion elements in FIG. 42.
Figure 45:
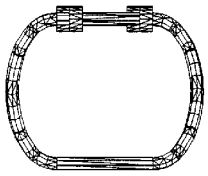
FIG. 45 is an end view of the torsion elements in FIG. 42.
Figure 46:
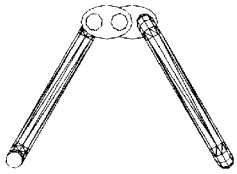
FIG. 46 is a side view of two open rectangle torsion elements shown in FIG. 9 connected at an angle in opposite orientation by four couplings via an intermediate torsion element.
Figure 47:
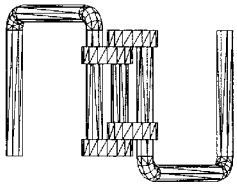
FIG. 47 is a plan view of the torsion elements in FIG. 46.
Figure 48:
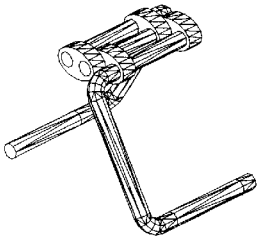
FIG. 48 is a perspective view of the torsion elements in FIG. 46.
Figure 49:
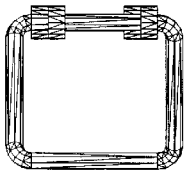
FIG. 49 is an end view of the torsion elements in FIG. 46.
Figure 50:
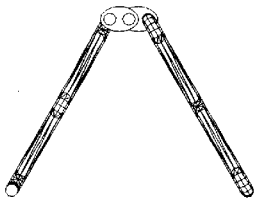
FIG. 50 is a side view of two 'M'-shaped torsion elements shown in FIG. 28 connected at an angle in opposite orientation by four couplings via an intermediate torsion element.
Figure 51:
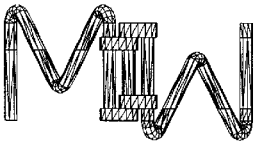
FIG. 51 is a plan view of the torsion elements in FIG. 50.
Figure 52:
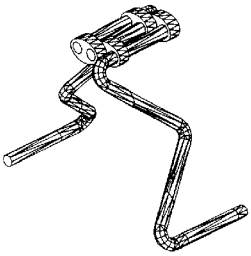
FIG. 52 is a perspective view of the torsion elements in FIG. 50.
Figure 53:
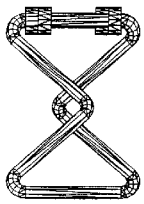
FIG. 53 is an end view of the torsion elements in FIG. 50.
Figure 54:
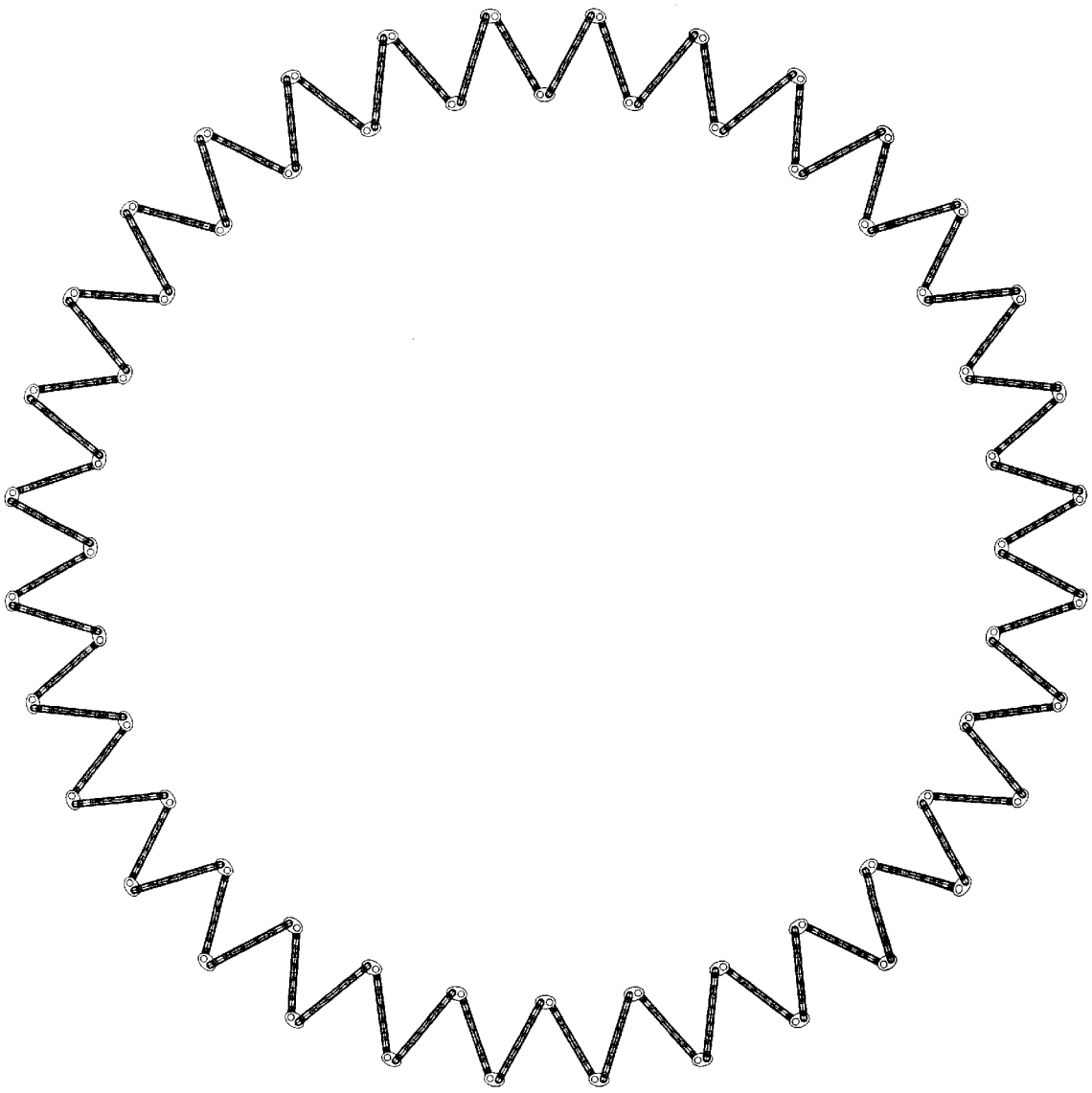
FIG. 54 is a plan view of 32 pairs of torsional elements shown in FIG. 38 connected in a circular array forming a toroid.
Figure 55:
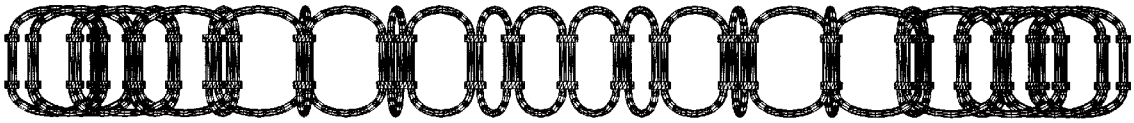
FIG. 55 is a side view of the circular array shown in FIG. 54.
Figure 56:
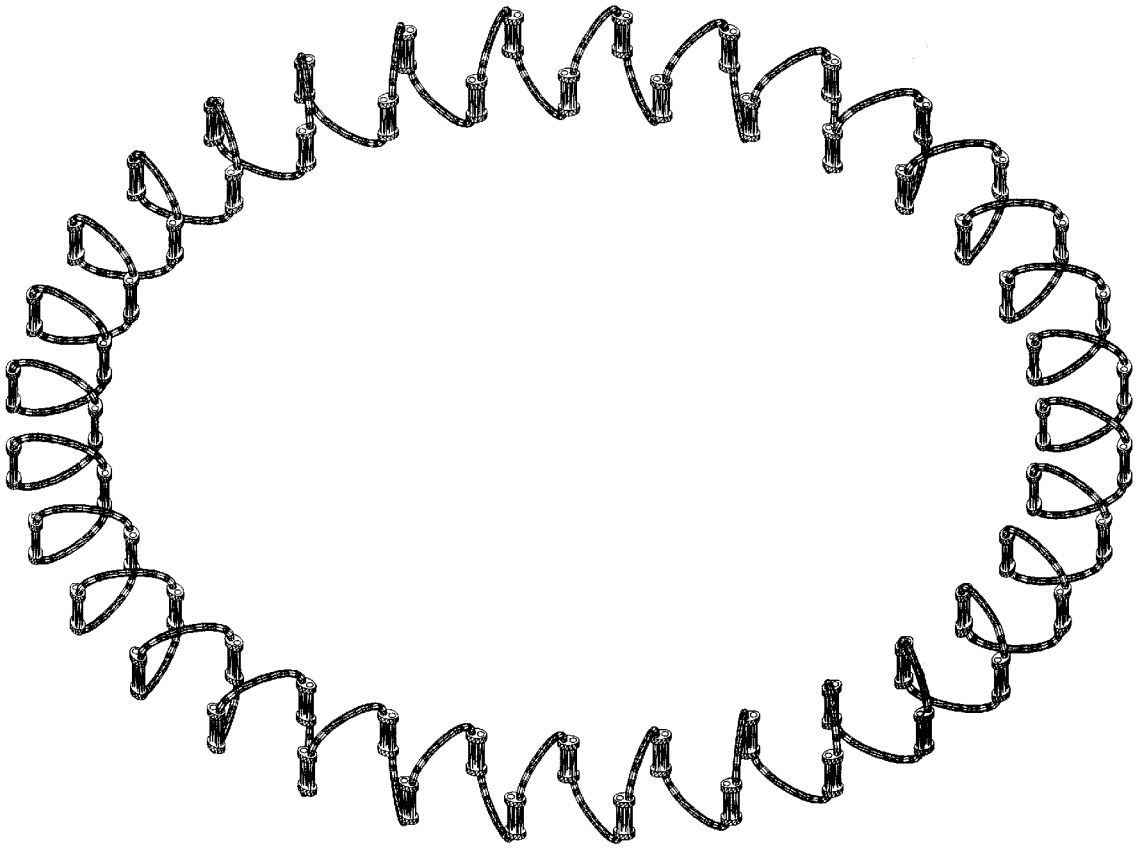
FIG. 56 is a perspective view of the circular array shown in FIG. 54.
Figure 57:
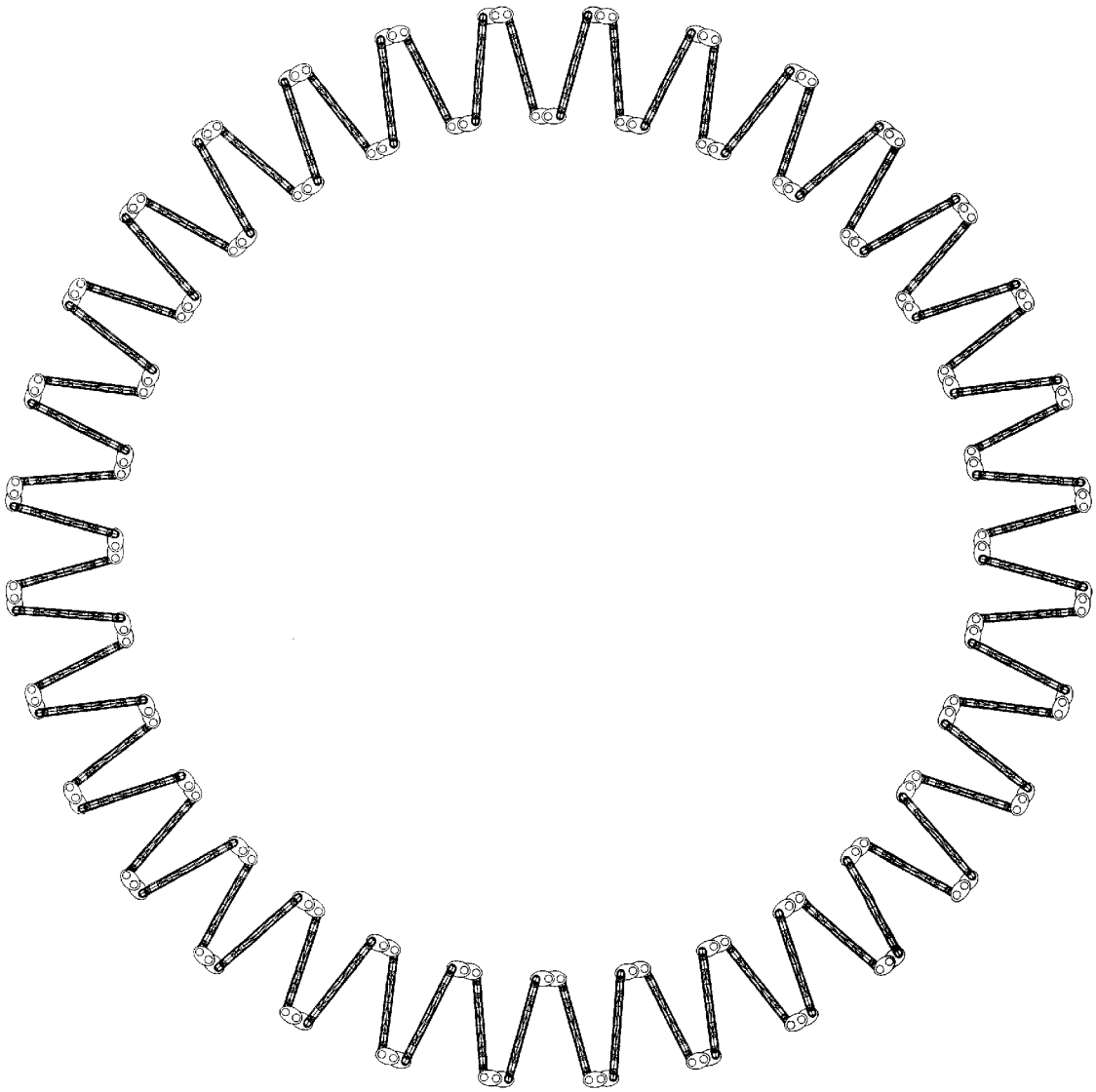
FIG. 57 is a plan view of 32 pairs of torsional elements shown in FIG. 42 connected in a circular array forming a toroid.
Figure 58:
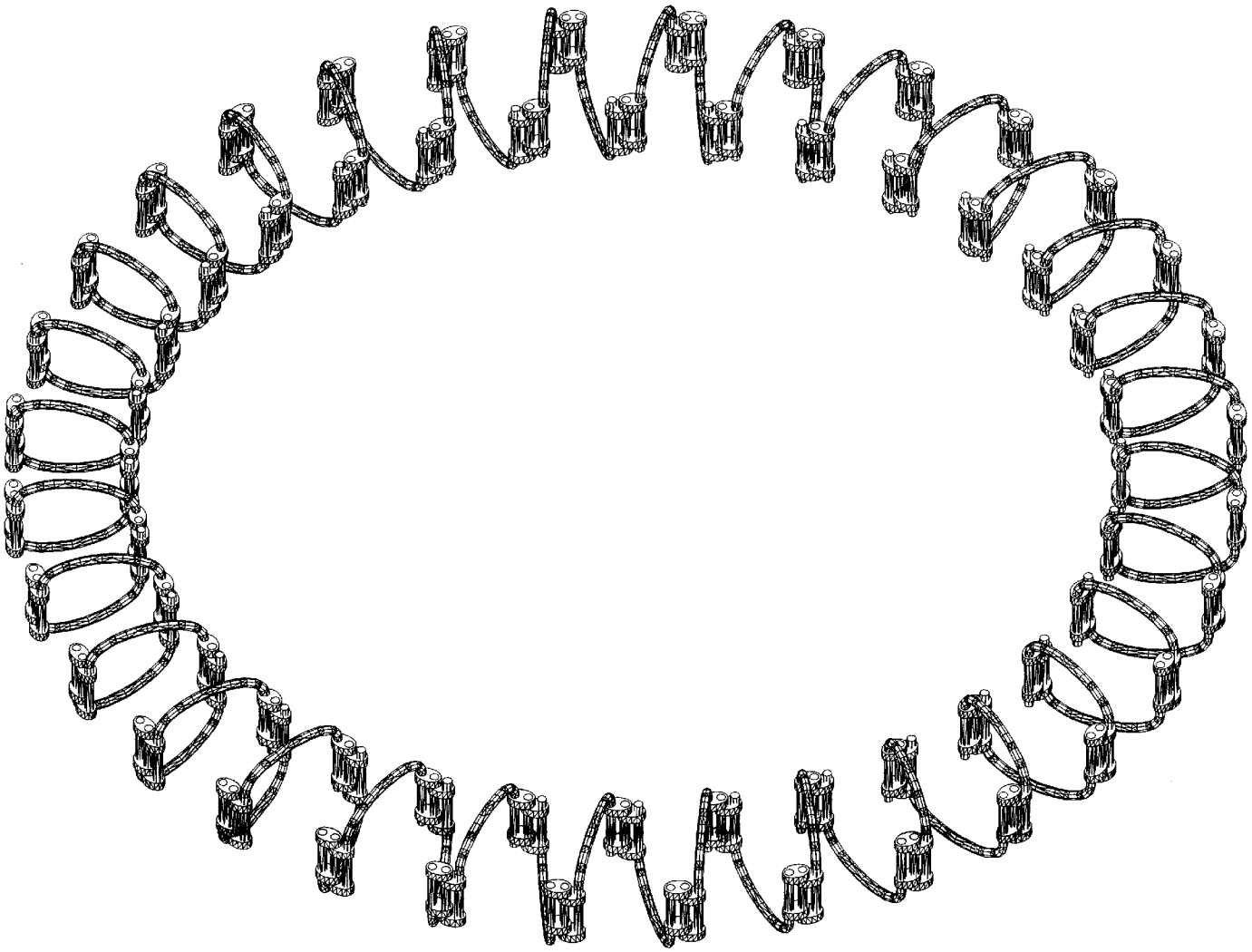
FIG. 58 is a perspective view of the circular array shown in FIG. 57.

The three types of modules shown in FIGS. 1–12 may themselves be similarly connected in linear arrays as shown in FIGS. 13–18. Although, the linear arrays shown in FIGS. 13–18 are homogeneous with respect to the type of torsion structural module shown, the different types of modules shown may be connected to form linear arrays. The linear array of torsion elements connected in any of the ways shown in FIGS. 1–12 operates to distribute torsional loading on any torsion elements among all of the torsion elements of the array. This is true regardless of the shape of the array. The arrays may have any shape, and may be closed, as are the circular arrays constructed shown in FIGS. 19–22, as well as asymmetrical and irregular as shown in FIG. 23.

Closed arrays of connected torsion modules have no terminus for the transmission of loading, as do linear arrays. Thus, any torsional load placed on a torsion element in a closed array will be transmitted to and distributed among all of the torsion elements in the array.

As previously indicated the torsion elements may be of virtually any shape so long as they may be connected in a way similar to that as shown in FIGS. 1–12, thus providing for the bearing and transmission of torsional loading. Two examples of other torsion element shapes are shown in FIGS. 24–31, connected in the various ways shown in FIGS. 1–12.

Torsion elements may be angularly connected to produce angular torsion modules and structures and form linear arrays thereof as shown in the example of FIGS. 32–37. The same characteristics of transmission of torsional loading exist in this type of configuration as in the structures shown and discussed earlier. Angular connections are possible for virtually any type of torsion element as shown in the examples of FIGS. 38 through 53. Moreover any type of connection as shown in FIGS. 1–12 may be used for angular connection of torsion elements.

Angularly connected torsion elements may also be connected in closed arrays as shown in FIGS. 54–58. The angular connection between elements allows for the inclusion of more torsion elements in the array within the same length, thereby providing for a greater capacity of the array to absorb torsional stress. Although only circular arrays have been shown, any closed array is possible and will share the same characteristics of distribution of torsional loads as circular arrays. The symmetry of an array and the manner in which it is loaded may determine the evenness of the distribution of torsional stress, whether the array is open or closed. Also, as can be seen from FIGS. 54–58, closed symmetrical arrays of torsion elements also form toroids, the shapes of the preferred embodiment of the invention.

Figure 59:
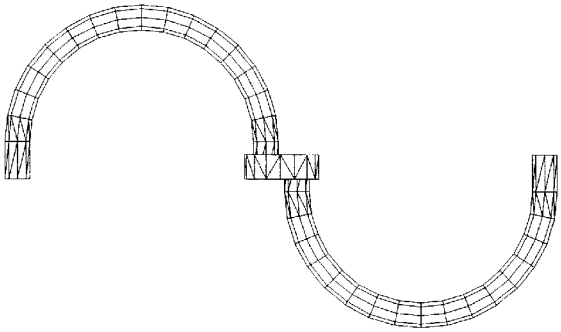
FIG. 59 is a plan view of two semicircular torsion elements connected in opposite orientation by one coupling.
Figure 60:
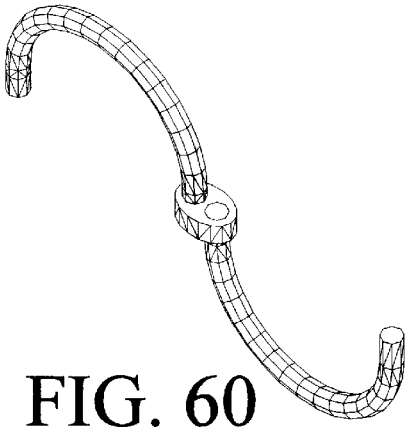
FIG. 60 is a perspective view of the torsion elements in FIG. 59.
Figure 61:
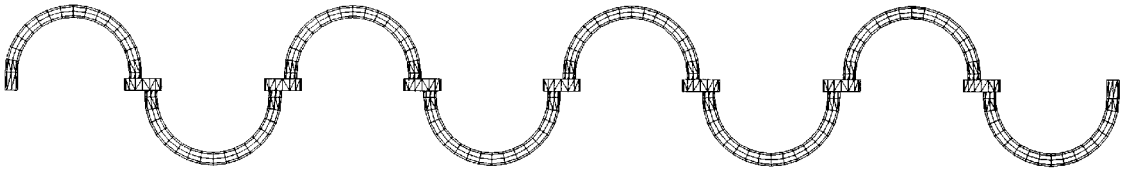
FIG. 61 is a plan view of the semicircular torsion elements shown in FIG. 60 connected in a linear array.
Figure 62:
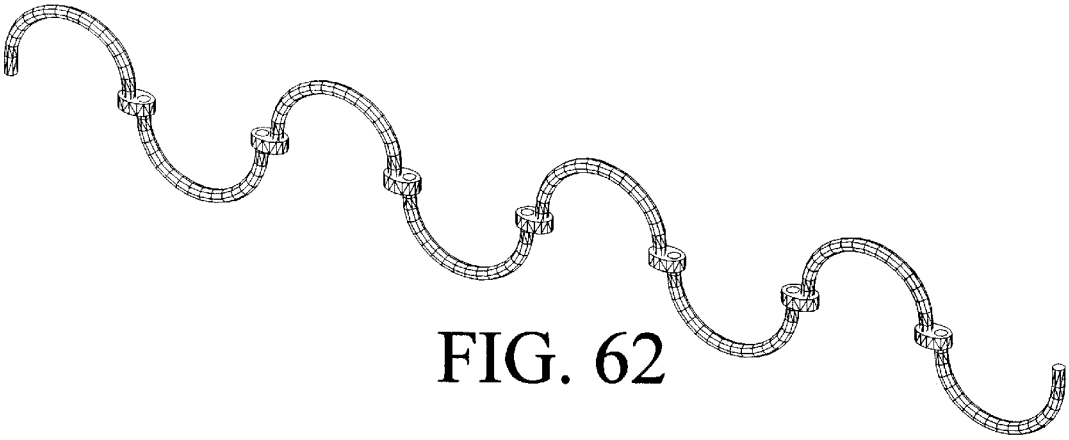
FIG. 62 is a perspective view of the linear array shown in FIG. 61.
Figure 63:
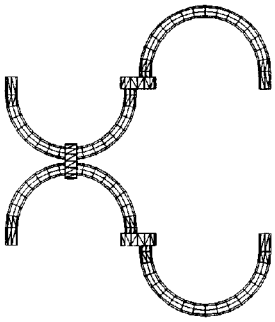
FIG. 63 is a plan view of two pairs of semicircular torsion elements shown in FIG. 59 connected in opposite orientation by one coupling.
Figure 64:
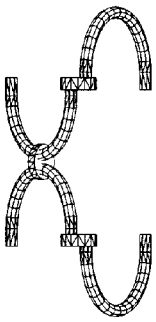
FIG. 64 is a plan view of two pairs of semicircular torsion elements shown in FIG. 59 connected in opposite orientation by one coupling, each torsion element in the pair being connected to the other at an angle by one coupling.
Figure 65:
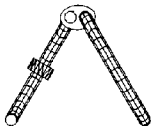
FIG. 65 a side view of the torsion elements in FIG. 64.
Figure 66:
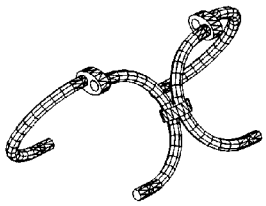
FIG. 66 is a perspective view of the torsion elements in FIG. 64.
Figure 67:
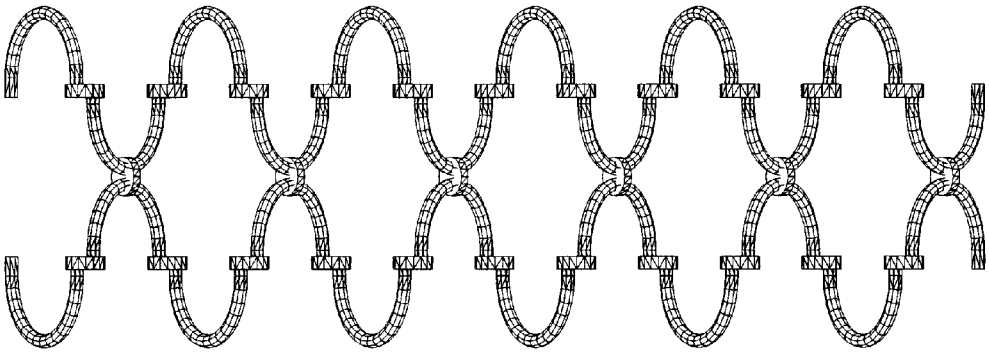
FIG. 67 is a plan view of 6 sets of connected semicircular torsion elements shown in FIG. 64 connected in a linear array.
Figure 68:
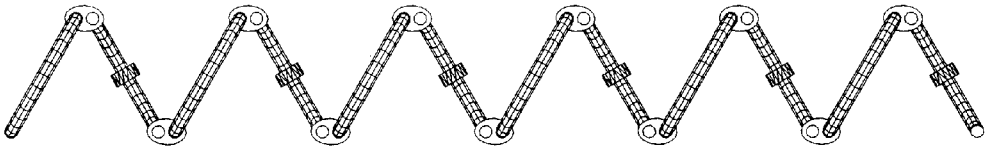
FIG. 68 is a side view of the linear array shown in FIG. 67.
Figure 69:
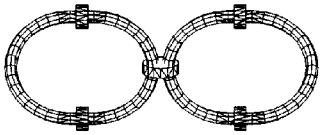
FIG. 69 is an end view of the linear array shown in FIG. 67.
Figure 70:
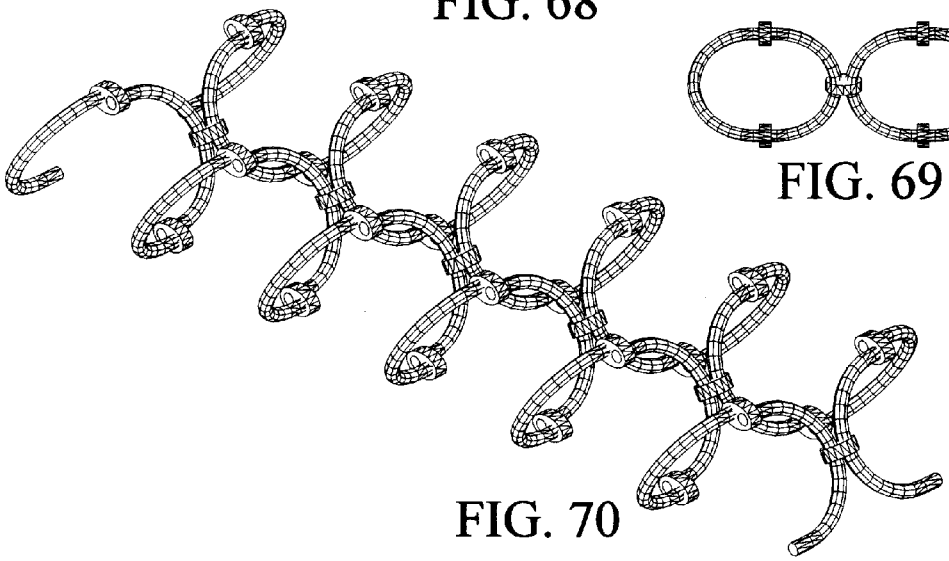
FIG. 70 is a perspective view of the linear array shown in FIG. 67.

Structural modules of torsion elements, and arrays thereof, connected by one coupling are also possible, as shown in FIGS. 59–62 where the torsion elements are semicircular. Semicircular or otherwise smoothly curved torsion elements absorb torsion stress variably along the length of the toroidal tube. Torque applied to any point on such a torsion element along its tube length which tends to twist the body of the torsion element is transmitted along the body of the torsion element as determined by the structure of the torsion element, the capacity of the material used to absorb torsional stress, and the curvature of the torsion element. Nevertheless, the load on one curved torsion element fixedly connected with one coupling to another curved torsion element as shown in FIG. 59 will be transmitted to the other in the same manner as for the connected torsion elements shown in FIGS. 1–4.

Figure 71:
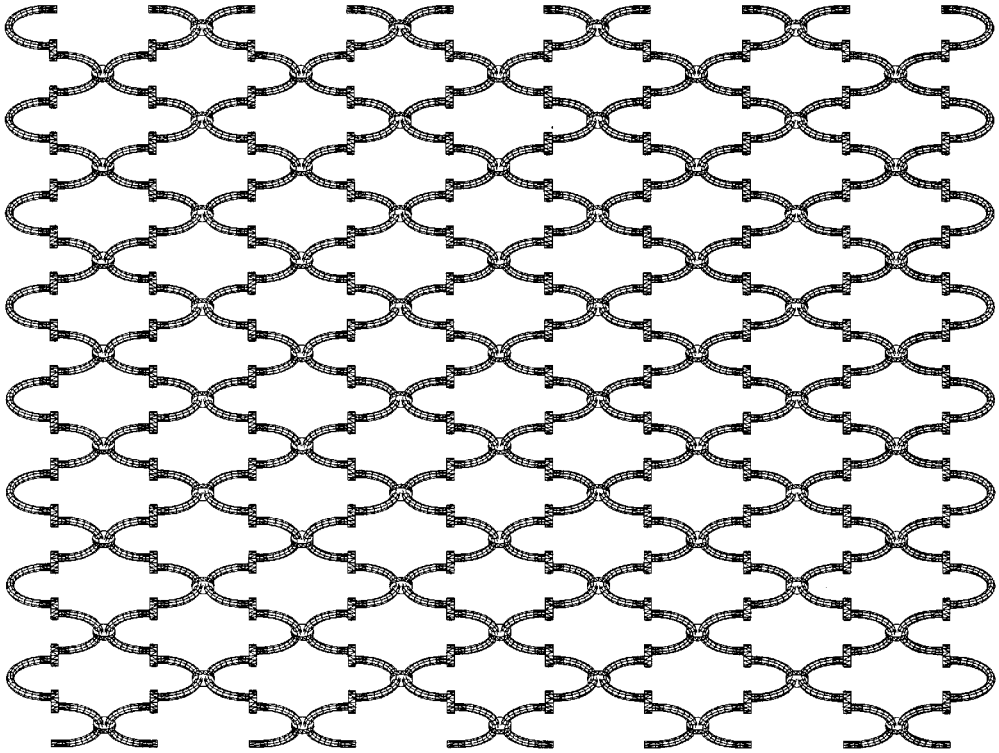
FIG. 71 is a plan view of a 5 wide array of the linear array shown in FIG. 67.
Figure 72:
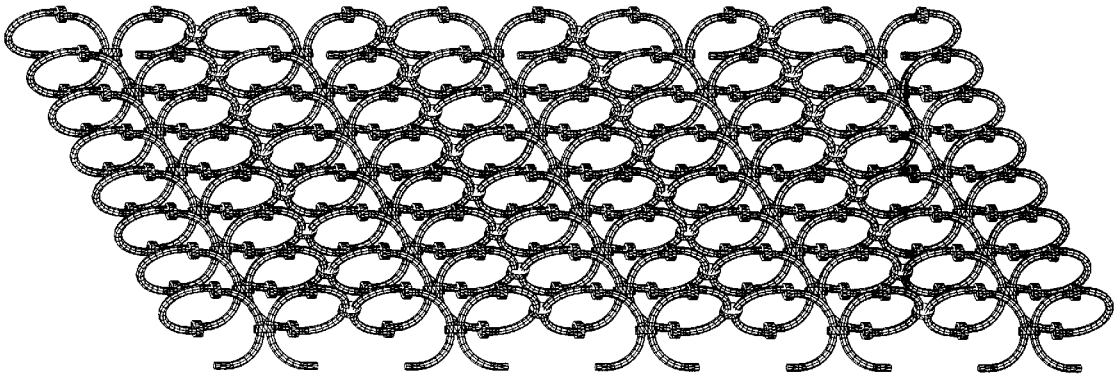
FIG. 72 is a perspective view of the array shown in FIG. 71.
Figure 73:
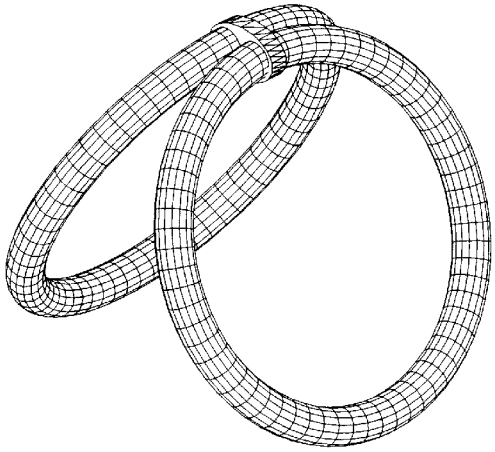
FIG. 73 is a perspective view of two toroidal torsion elements connected at an angle by one coupling.
Figure 74:
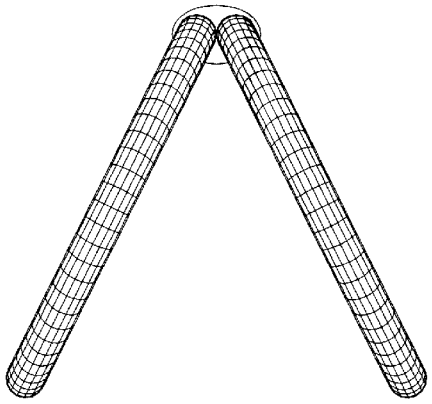
FIG. 74 is a side view of the toroidal torsion elements in FIG. 73.
Figure 75:
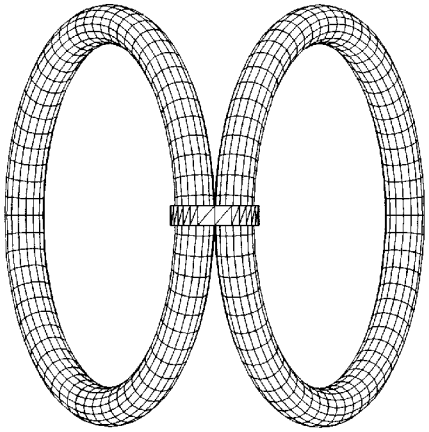
FIG. 75 is a plan view of the toroidal torsion elements shown in FIG. 73
Figure 76:
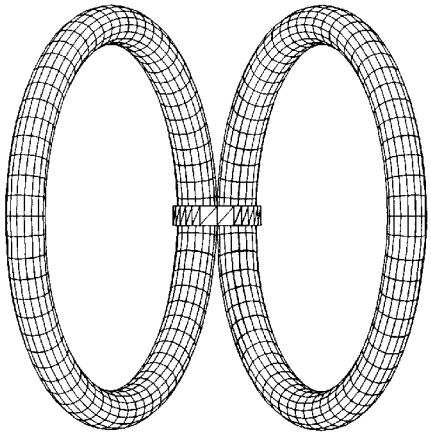
FIG. 76 is a bottom view of the toroidal torsion elements shown in FIG. 73.

The semicircular torsion elements shown in FIG. 59, as well as any other similar torsion elements, may yet be further connected in angular and more complex modules as shown in FIGS. 63–66, which may in turn be connected in linear arrays as shown in FIGS. 67–70. Such linear arrays may be further connected to arrays which form deck, plate or similar flat planar structures as shown in FIGS. 71 and 72.

The preferred torsion element for the invention, however, is the toroidal torsion element, an angularly connected pair of which are shown in various views in FIGS. 73–76.

Figure 77:
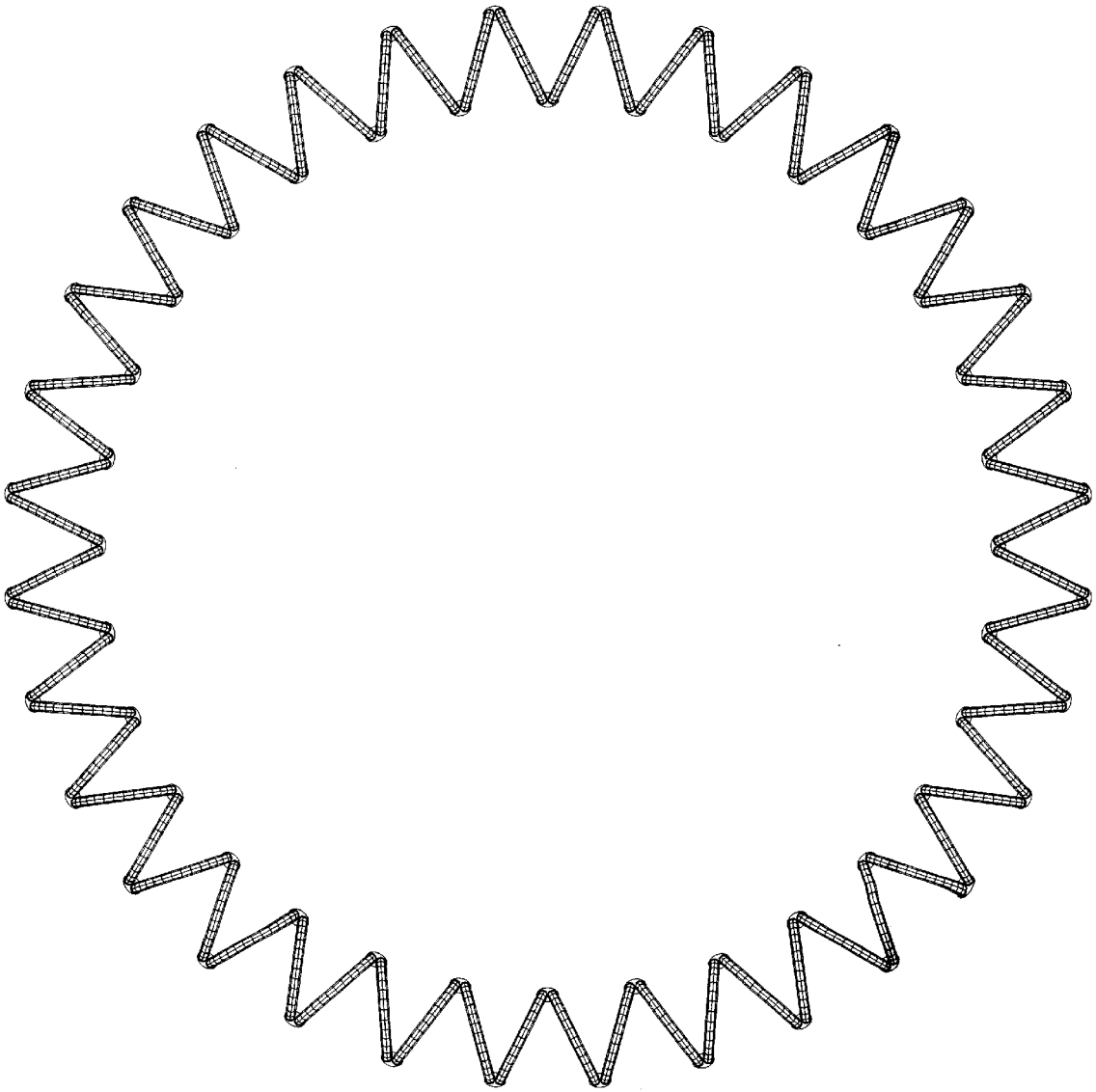
FIG. 77 is a plan view of 32 pairs of toroidal torsional elements shown in FIG. 74 connected in a circular array forming a toroid.
Figure 78:
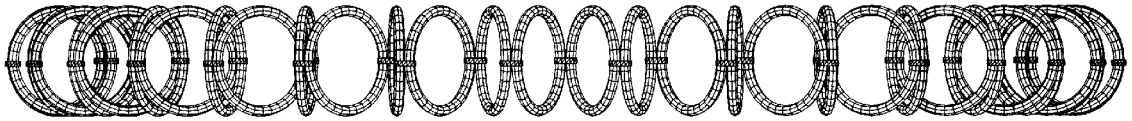
FIG. 78 is a side view of the circular array shown in FIG. 77.
Figure 79:
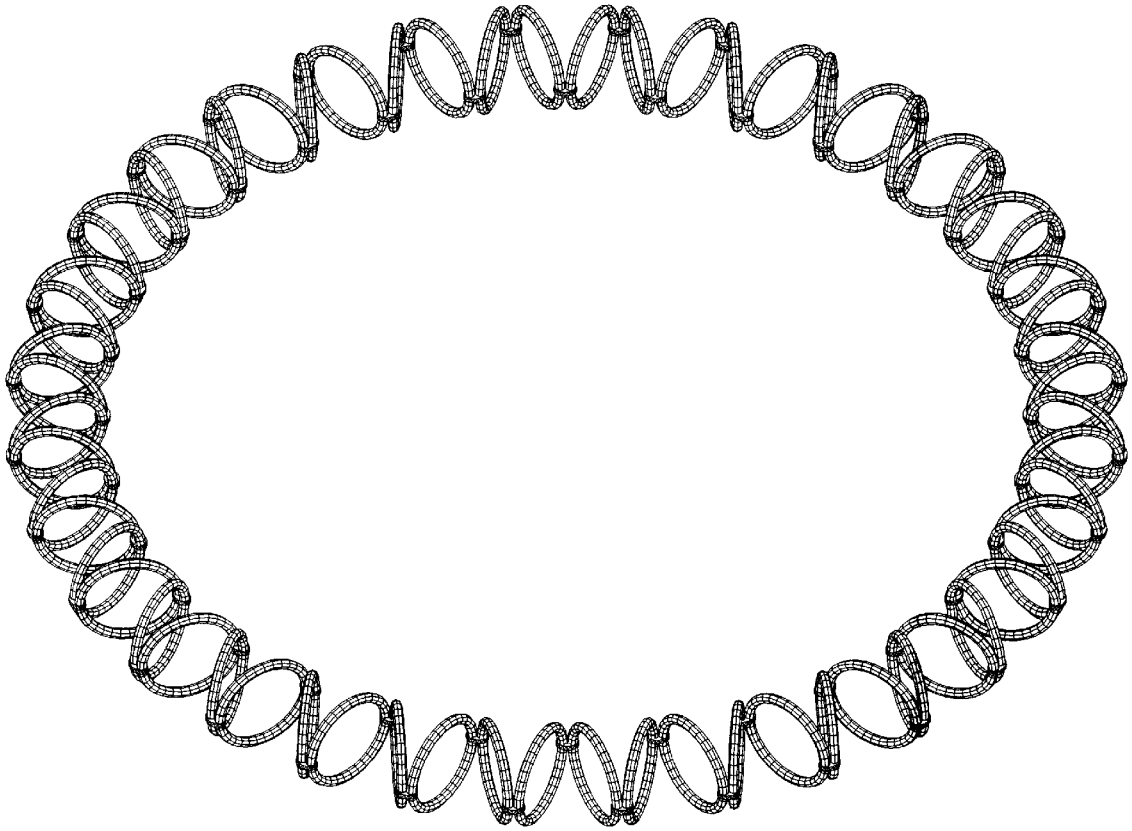
FIG. 79 is a perspective view of the circular array shown in FIG. 77.
Figure 80:
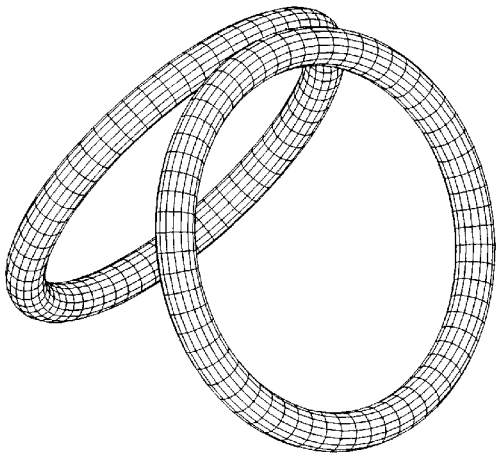
FIG. 80 is a perspective view of two toroidal torsion elements connected at an angle without an external coupling.

As with all other torsional elements, toroidal torsional elements can be connected in closed arrays as shown in FIGS. 77–79, which may form the framework of larger toroidal elements having torsional strength characteristics. Indeed, it is contemplated by this invention that the self-similarity of toroidal torsion elements constructed from other smaller toroidal torsion elements can be extended to precisely control all of the structural characteristics of such toroidal torsion elements.

Through FIG. 79 all of the connections between torsion and toroidal torsion elements have been shown in the figures as "external", i.e. achieved with an "external" coupling applied to the exterior surfaces of torsional or toroidal torsion elements. Such connections shall be continued to be referred to as "external", as opposed to "internal" connections, which include all means for connecting torsion elements without the use of a coupling or other intermediate device. Torsion elements in an internally connected pair are shown in FIGS. 80–83.

For the purpose of the figures of this disclosure, it shall be understood that all of the closely proximate torsion elements and toroidal torsion elements shown are connected in the region of their closest proximity by internal connection, unless otherwise indicated such as by connection with couplings. Furthermore, for the purpose of the rest of this disclosure, the lack of the appearance of an external coupling at the point of closest proximity of two torsion elements or two toroidal torsion elements shall not be taken to mean that such elements are not connectable by couplings, unless otherwise indicated. All connections thus shown in the figures may be internal or external as required by the application, even though not indicated as such in a particular figure. This convention is used in the examples of closed arrays shown in FIGS. 84–88, where the torsion structural modules shown in FIGS. 80–83 form the framework of toroidal torsion elements.

Figure 85:
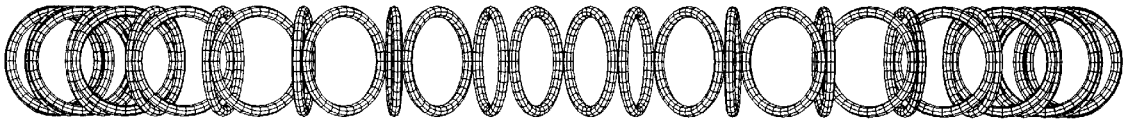
FIG. 85 is a side view of the toroid formed by the circular array shown in FIG. 84.
Figure 86:
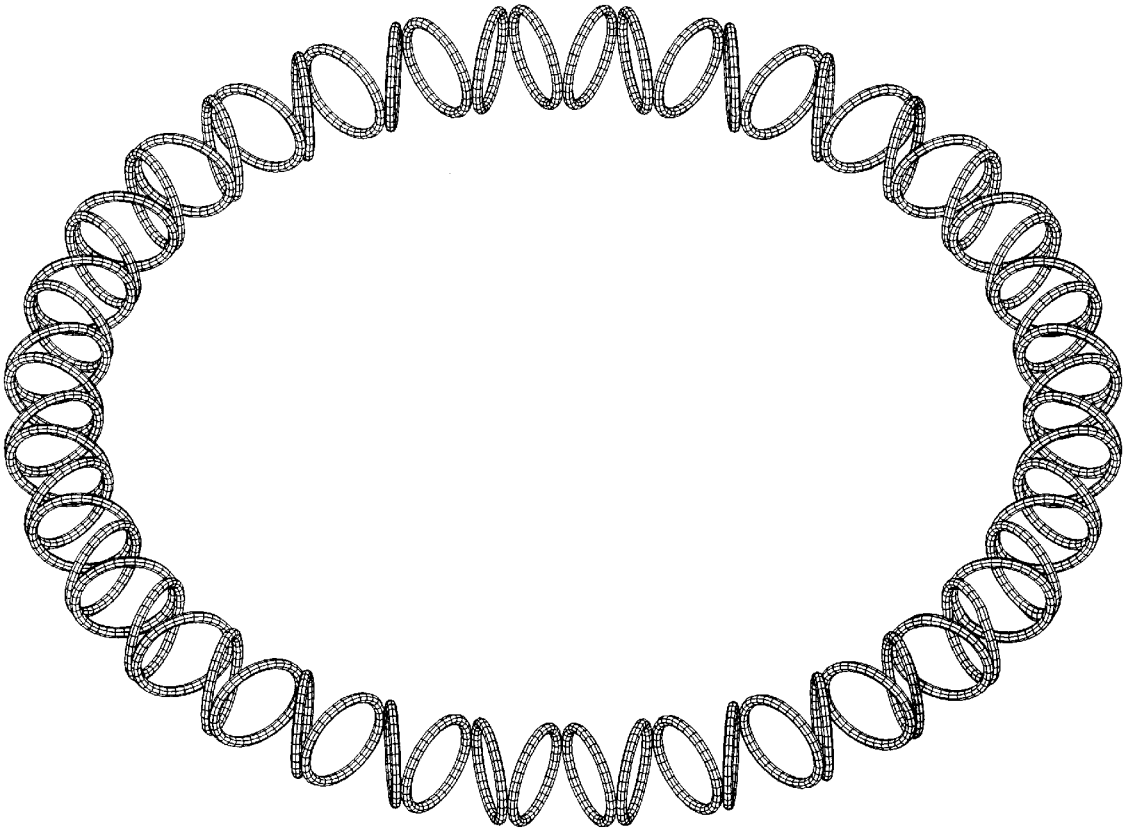
FIG. 86 is a perspective view of the toroid formed by the circular array shown in FIG. 84.
Figure 88:
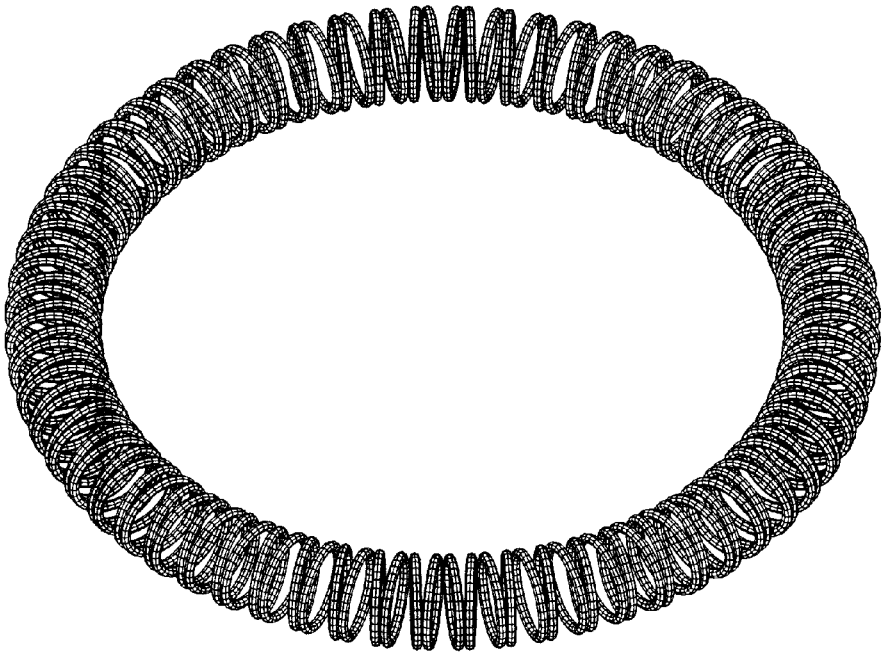
FIG. 88 is a perspective view of the toroid shown in FIG. 87.
Figure 89:
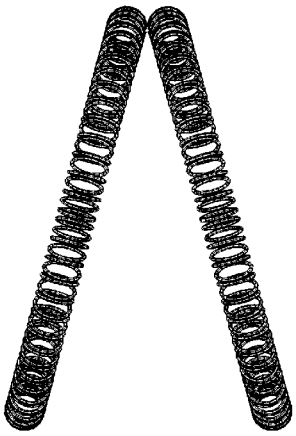
FIG. 89 is a side view of two toroids such as the one shown in FIG. 87 connected internally by couplings connecting a plurality of the toroidal elements of one with proximate toroidal elements of the other.
Figure 90:
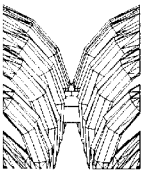
FIG. 90 is a fragmentary view of the region of internal connection between the toroids in FIG. 89.
Figure 91:
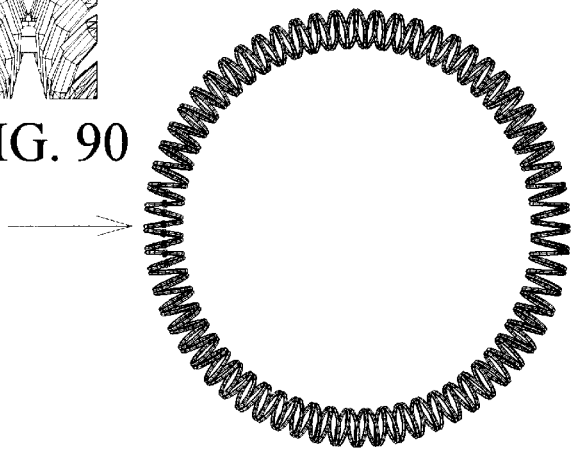
FIG. 91 is another side view of the two toroids shown in FIG. 89.
Figure 92:
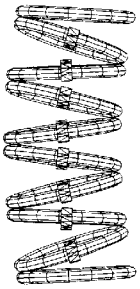
FIG. 92 is a fragmentary view of the region of internal connection between the toroids in FIG. 81.
Figure 96:
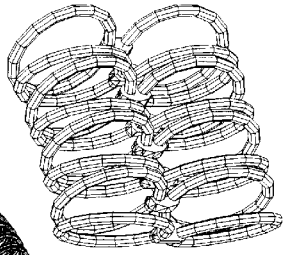
FIG. 96 is a fragmentary view of the region of internal connection between the toroids shown in FIG. 95.
Figure 93:
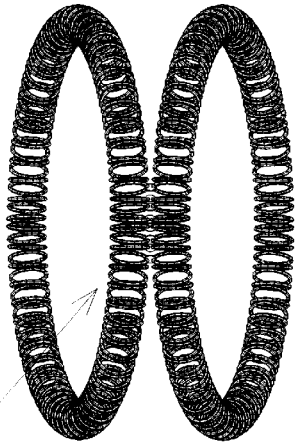
FIG. 93 is a view of the two toroids in the direction of the arrow in FIG. 9 1.
Figure 94:
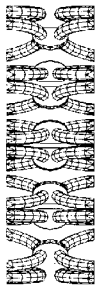
FIG. 94 is a fragmentary view of the region of internal connection between the toroids in FIG. 93.
Figure 95:
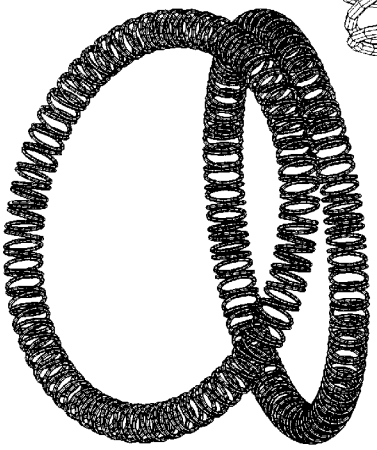
FIG. 95 is a perspective view of the two toroids in the direction of the arrow in FIG. 93.

Comparison of the closed array shown in FIGS. 84–86 indicates fewer toroidal torsion elements than that shown in FIGS. 87 and 88, the latter having twice as many toroidal torsion elements as the former. The greater the number of toroidal torsion elements in a structure, the greater the number of elements that share the torsion stress that may be induced in the system, thus decreasing the torsion stress absorption required of each element.

Figure 98:
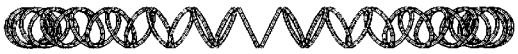
FIG. 98 a side view of the toroid formed by the circular array shown in FIG. 97.
Figure 99:
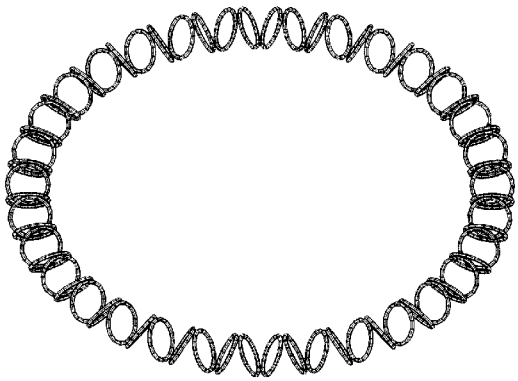
FIG. 99 is a perspective view of the toroid formed by the circular array shown in FIG. 97.
Figure 100:
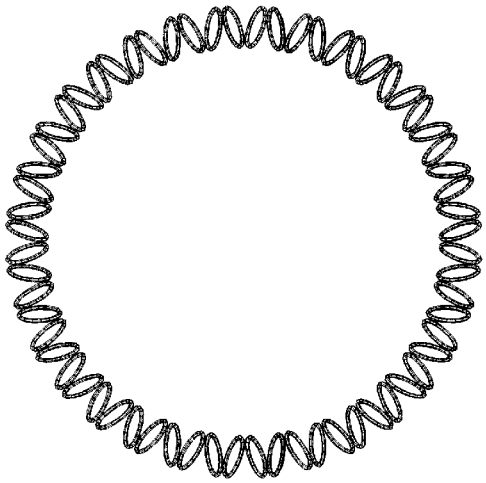
FIG. 100 is a plan view of a toroid formed by 32 pairs of the angularly connected toroidal torsional elements oriented at an angle of about 45 degrees in rotation about the axis arrow shown in FIG. 82 connected in a circular array.
Figure 101:
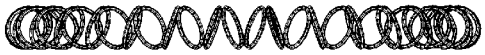
FIG. 101 is a side view of the toroid formed by the circular array shown in FIG. 100.
Figure 102:
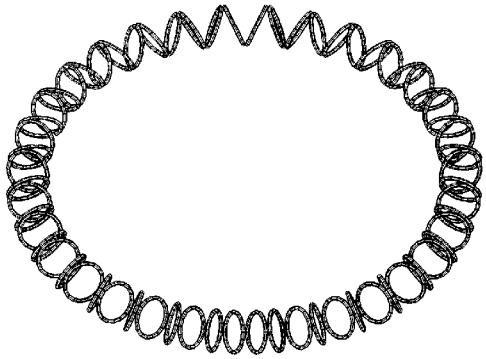
FIG. 102 is a perspective view of the toroid formed by the circular array shown in FIG. 100.
Figure 103:
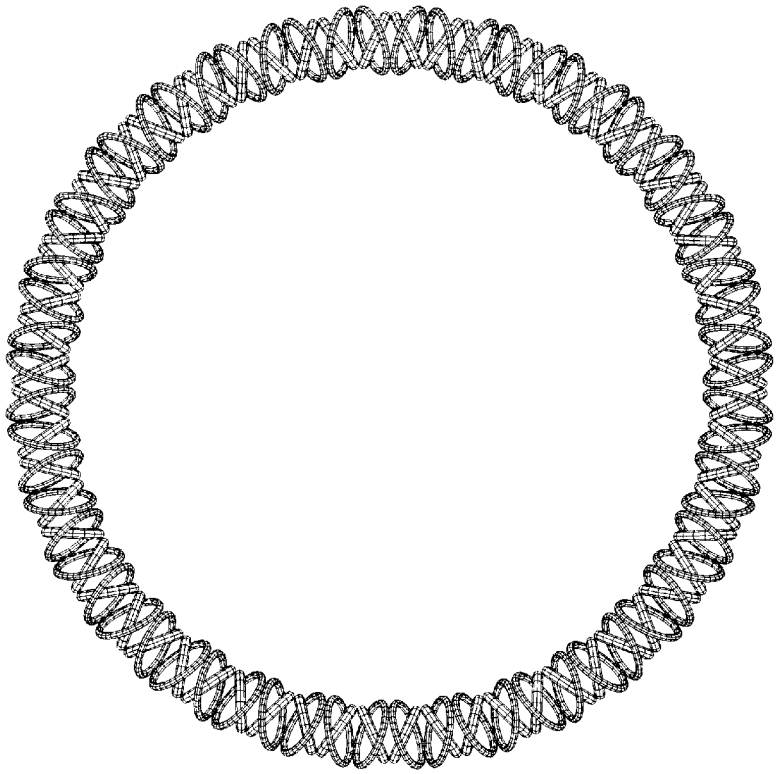
FIG. 103 is a plan view of a toroid formed by two tubularly concentric toroids, the outer being of the type shown in FIG. 102 and the inner being of the type shown in FIG. 84.
Figure 104:
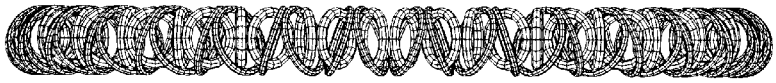
FIG. 104 is a side view of the toroid formed by the circular array shown in FIG. 103.
Figure 105:
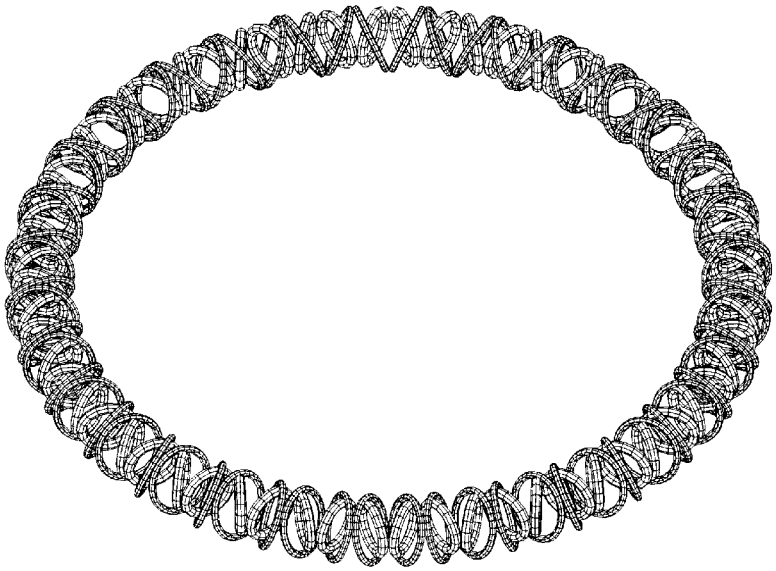
FIG. 105 is a perspective view of the toroid formed by the circular array shown in FIG. 103.
Figure 106:
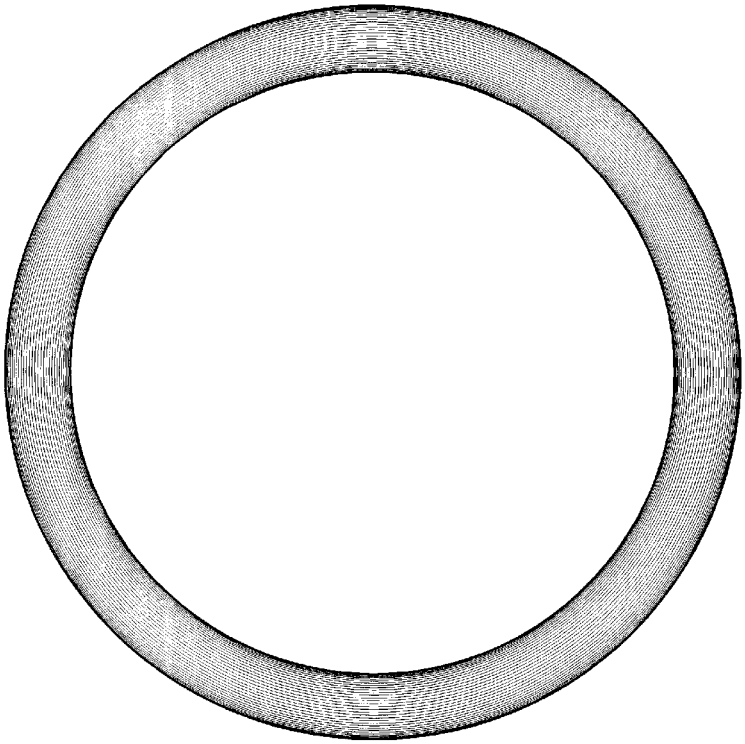
FIG. 106 is a plan view of a filament wound toroidal element.
Figure 108:
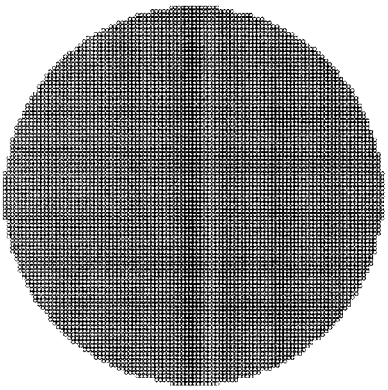
FIG. 108 is a cross section of the tube of the toroidal element shown in FIG. 106.
Figure 107:
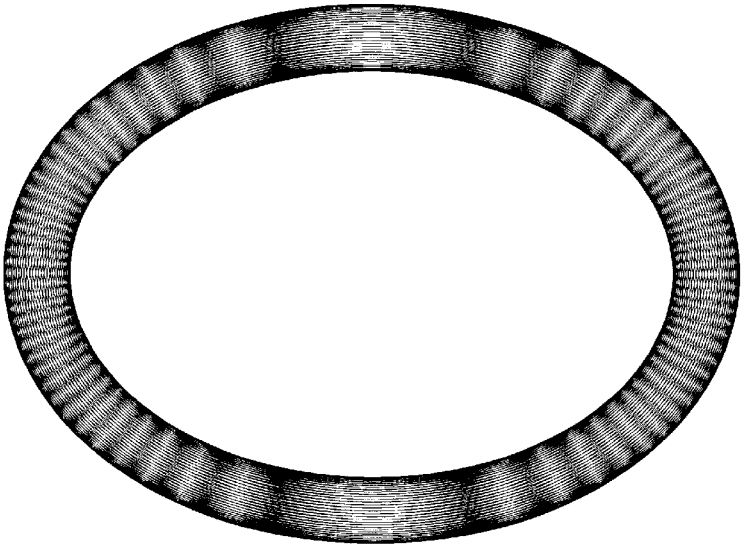
FIG. 107 is a perspective view of the toroidal element in FIG. 106.
Figure 109:
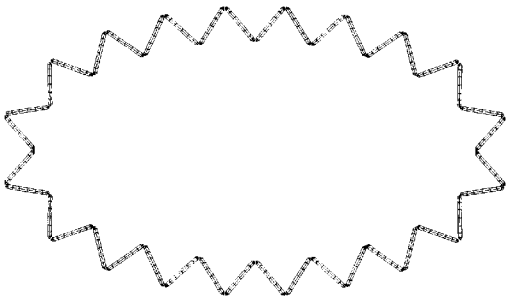
FIG. 109 is a plan view of 20 pairs of toroidal torsional elements as shown in FIG. 81 connected in a elliptical array forming a toroid.
Figure 110:
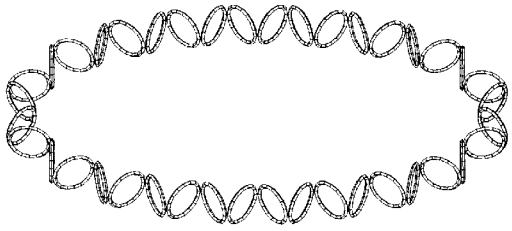
FIG. 110 is a perspective view of the toroid formed by the elliptical array shown in FIG. 109.

By the convention herein established the circular array shown in FIGS. 87 and 88 is comprised of toroidal torsion elements that are internally connected. However, observation of an internal connection, shown in the various views of FIGS. 89–96 between two toroids formed as shown in FIGS. 87 and 88, demonstrates that internal connections of torsion elements may be achieved by the use of external connections between their constituent toroidal torsion elements. This internal connection, rather than being accomplished by coupling of the constituent toroidal torsion elements of the toroids, could have been accomplished by internal connections between the torsion elements of which the constituent toroidal torsion elements are constructed. Such internal connection may also be mediated by additional elements, torsional or otherwise. Furthermore, this process may be continually replicated in a self-similar manner on a smaller and smaller scale, down to a fundamental torsion element, a torsion element which may be a construction itself, but not necessarily by formation from a circular array Arrays of angularly connected toroidal torsion elements that themselves form toroids may be elliptical, as shown in FIGS. 109 and 110, or of any other shape, and have various directional characteristics as shown in FIGS. 97–99, where lateral flexion of the resulting toroidal torsion element is converted to torsional loading of its constituent toroidal torsion elements. Additionally, as shown in FIGS. 100–102, where the orientation of the connection of the constituent torsion elements is not parallel or perpendicular to the axis of the resulting toroidal torsion element, but at an intermediate angle, yet different directional characteristics of the resulting toroidal torsion element will result. Such varying constructions of toroidal torsion elements may be combined as needed to meet extrinsic structural requirements by tubularly concentric connection between such toroidal torsion elements as shown in FIGS. 103 to 105.

Constructions from linear arrays of connected toroidal torsion elements may also be used to form structural members such as rods, tubes, poles or posts, examples of which are shown in FIGS. 148–151. These constructions may also have directional characteristics similar to that of the closed arrays discussed above, and may be included in compound tubularly concentric constructions as shown in FIGS. 152–153.

Figure 111:
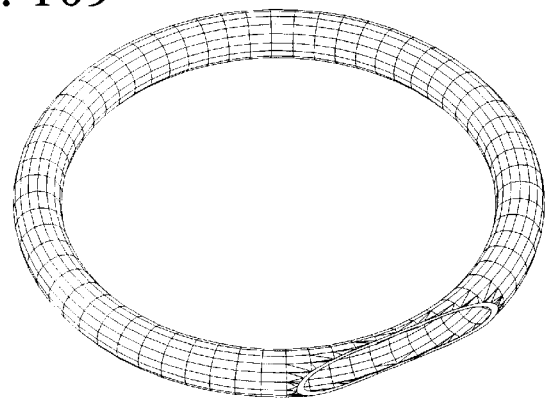
FIG. 111 is a perspective view of a hollow tubular toroidal element sectioned to show its interior.
Figure 112:
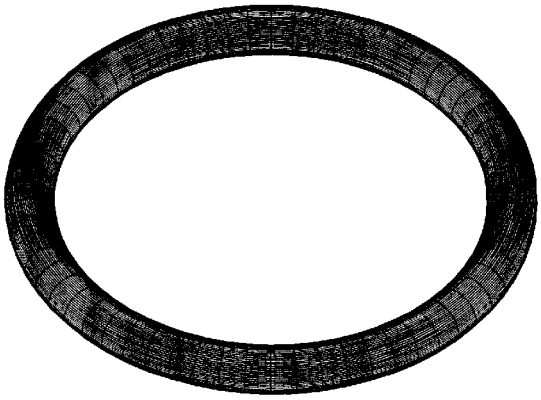
FIG. 112 is a perspective view of a filament wound toroidal element with the filament toroidal tube bundle radially bound.
Figure 113:
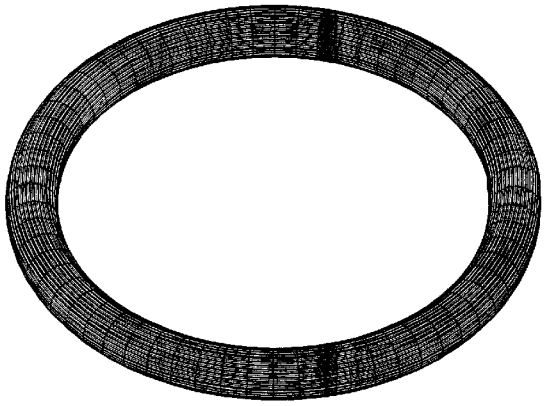
FIG. 113 is a perspective view of a filament wound toroidal element with relatively thicker filaments than that of the toroid shown in FIG. 112.
Figure 114:
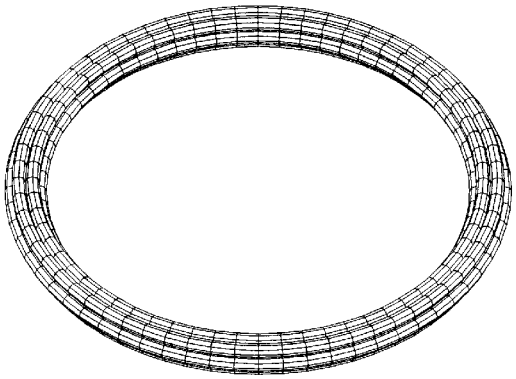
FIG. 114 is a perspective view of a toroidal element comprised of seven coaxial toroidal elements, the tubes of which are bonded, bound or otherwise connected to one another.
Figure 117:
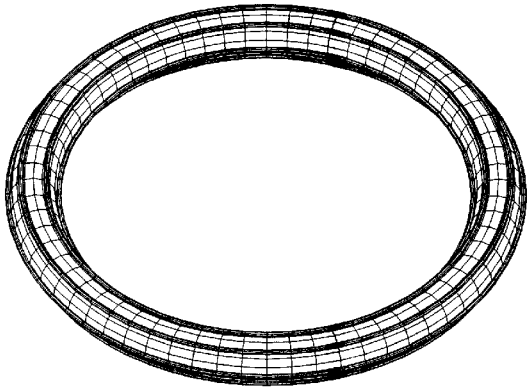
FIG. 117 is a perspective view of a toroidal element comprised of a tubularly central toroidal element whose tube is bordered by other toroidal elements of lesser tubular diameter which are bonded, bound or otherwise connected to the central element.
Figure 115:
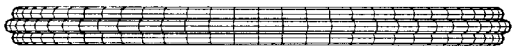
FIG. 115 is a side view of the toroidal element shown in FIG. 114.
Figure 118:
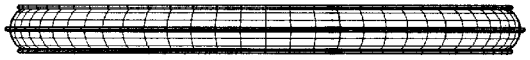
FIG. 118 is a side view of the toroidal element shown in FIG. 117.
Figure 116:
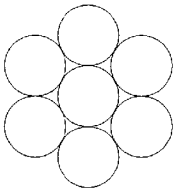
FIG. 116 is a cross section of the tube of the toroidal element shown in FIG. 114.
Figure 119:
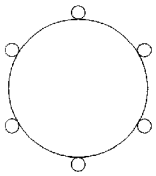
FIG. 119 is a cross section of the tube of the toroidal element shown in FIG. 117.
Figure 120:
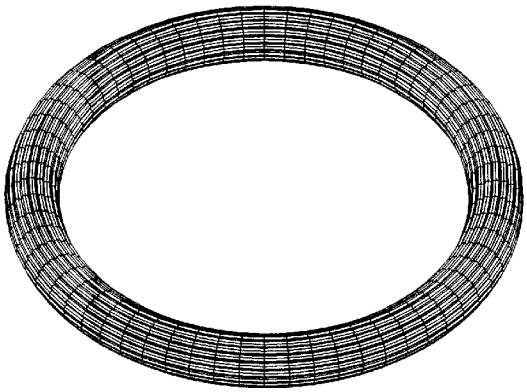
Figure 121:
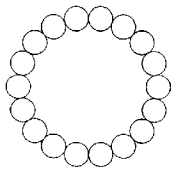

Fundamental torsion elements may be fabricated from what can be considered solid material, such as metal, polymers, foams, wood, or tubes of such material, as in FIG. 111. Such fundamental torsion elements may even be molded as torsion elements connected in modules, partial or whole, in the form of a framework of a torsion element. Fabrication of fundamental torsion elements may proceed from any standard manufacturing method, such as winding as indicated in FIGS. 106–108 and FIG. 112, extrusion, injection molding, layering of resins and fabrics, and fiber compositing.

Torsion elements may also be constructed from other toroidal torsion elements without the use of connected arrays, such as in FIGS. 113–121, which show toroidal torsion elements consisting of constituent toroidal torsion elements that are connected coaxially. The constituent toroidal torsion elements of these constructions may themselves be fundamental or constructed, even from arrays of connected toroidal torsion elements. Another example of a torsion element constructed without the use of a circular array and which may be employed as fundamental is shown in FIGS. 138–141. The interlinkage, as shown in FIGS. 142–147, forms an apparent braid of six toroids about a central axial toroid, all of which are identical in dimension. The principal characteristic of this type of toroidal torsion element is that the apparent braid of toroids rotates freely about its circular axis impeded only by the internal friction of the toroids in the braid and the frictional forces between them.

Figure 122:
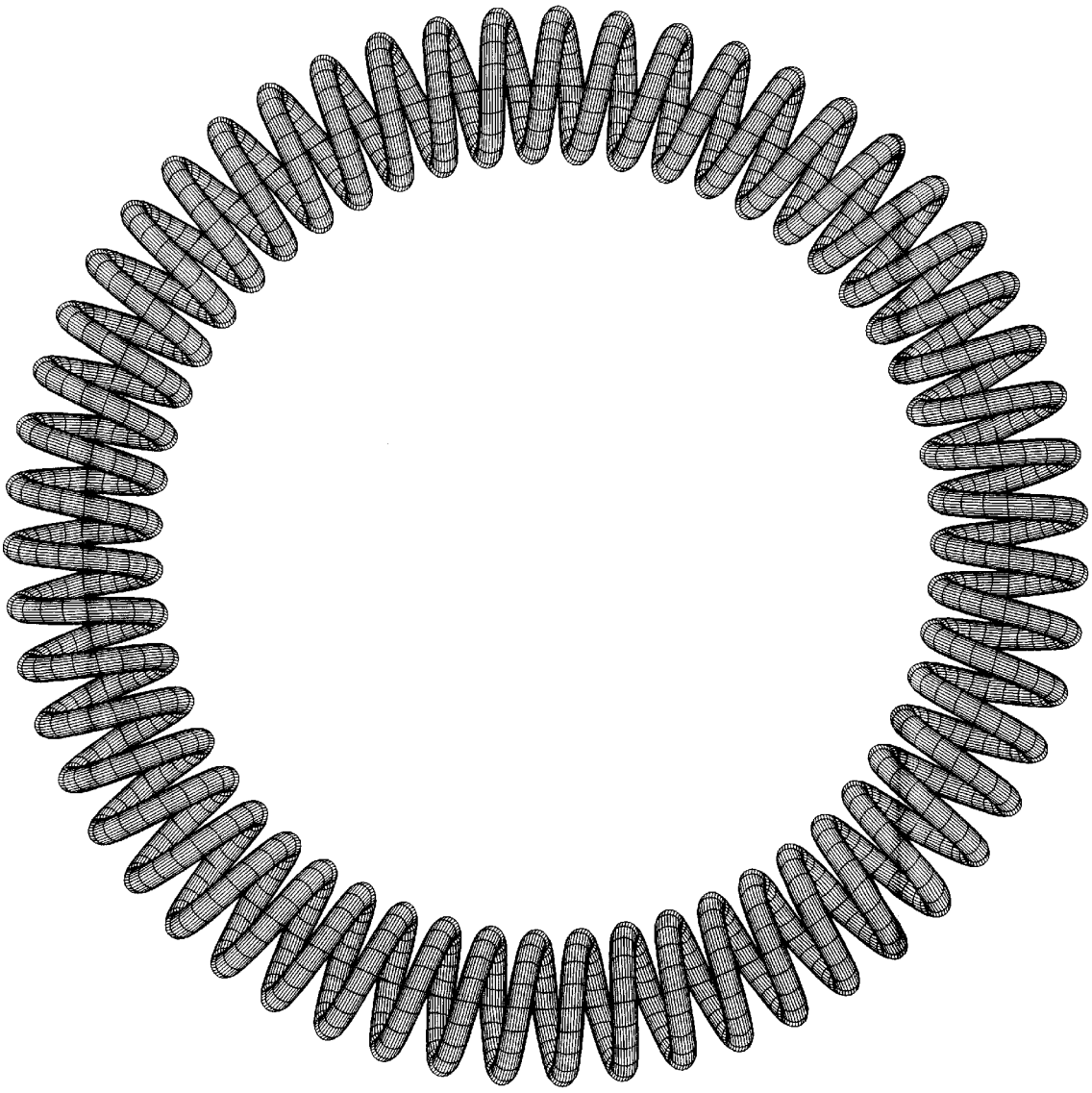
Figure 123:
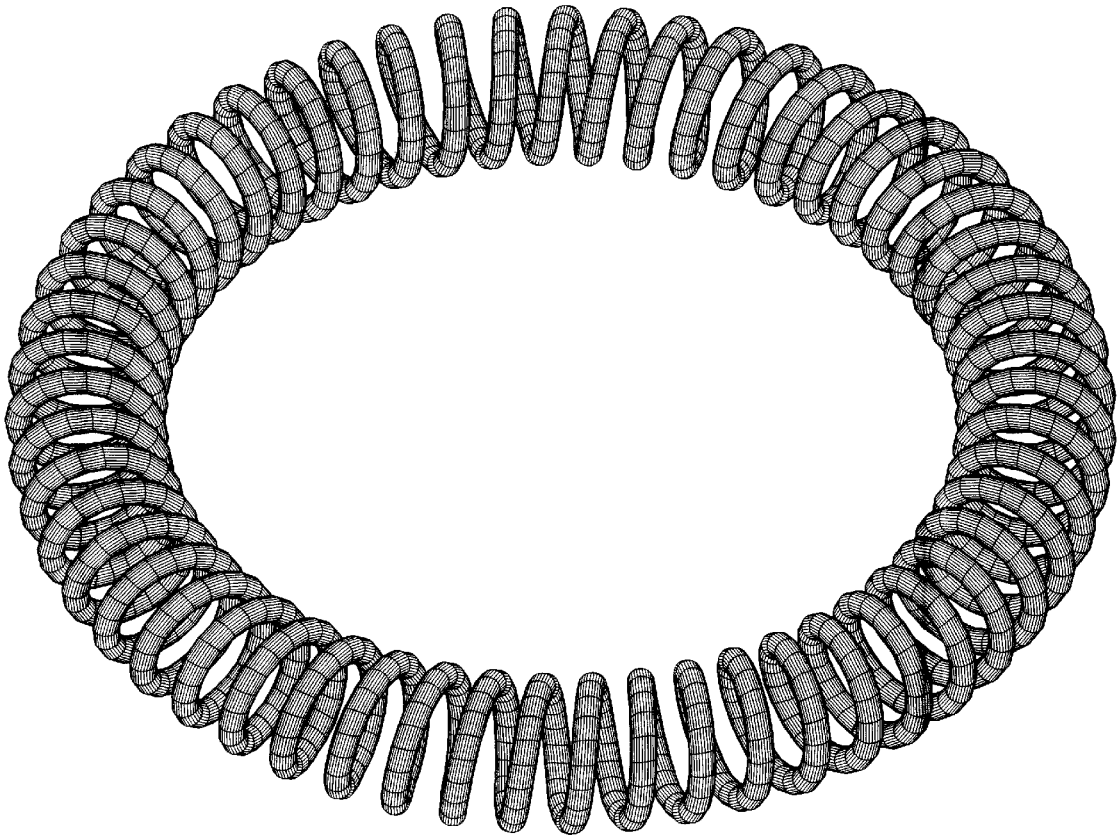
Figure 124:
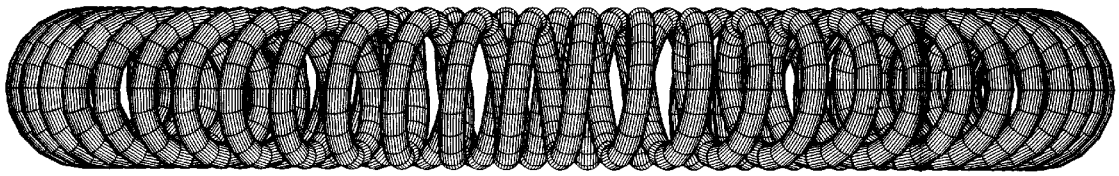
Figure 125:
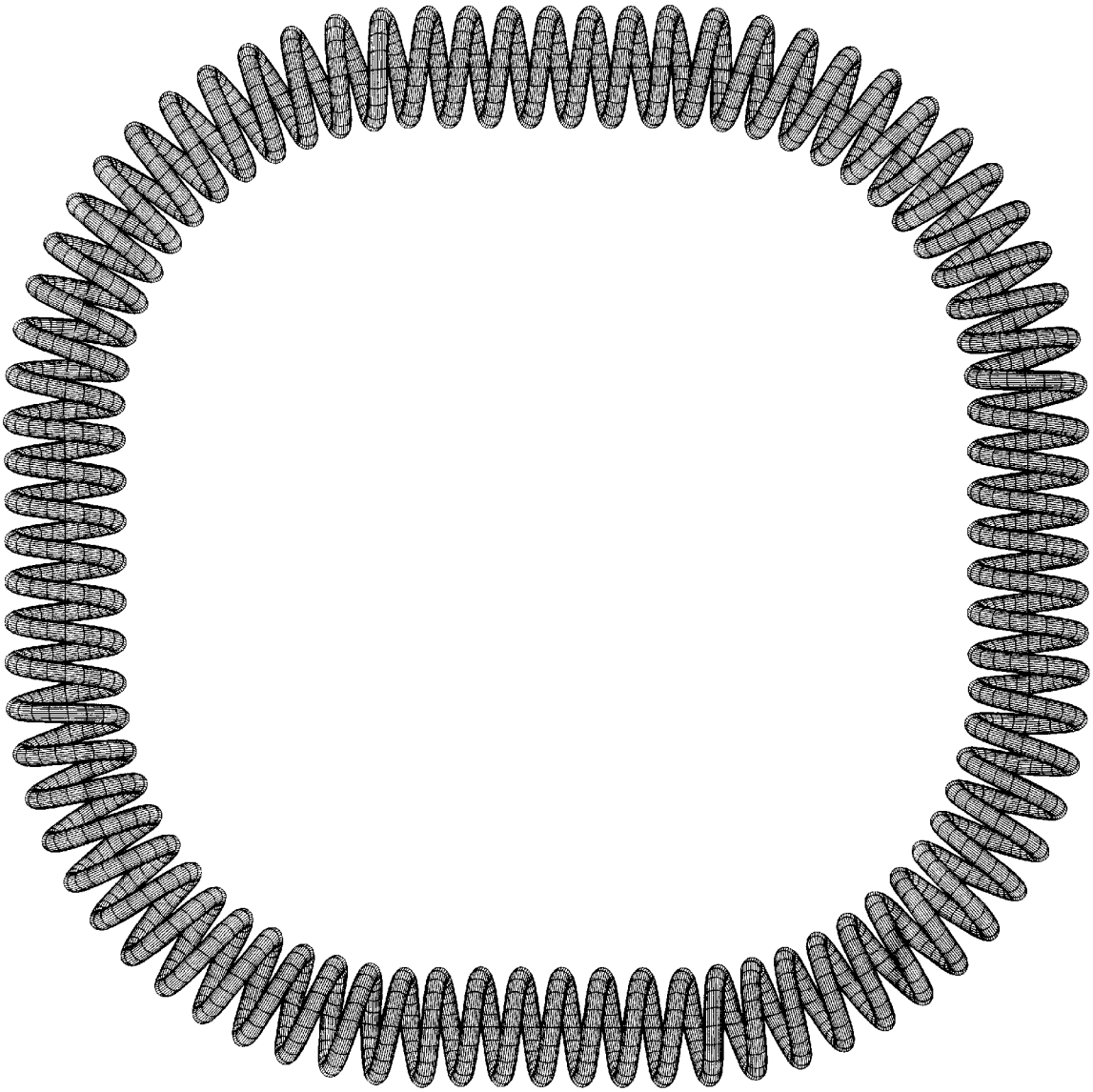
Figure 126:
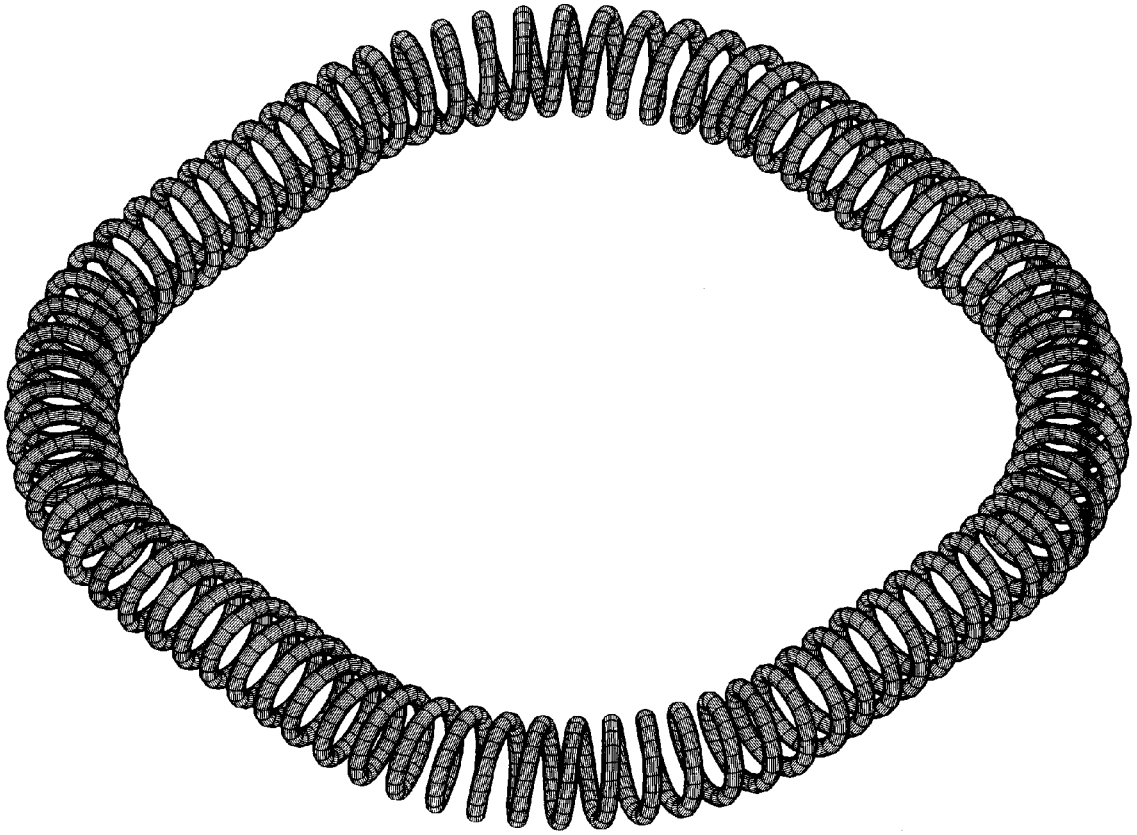
Figure 127:
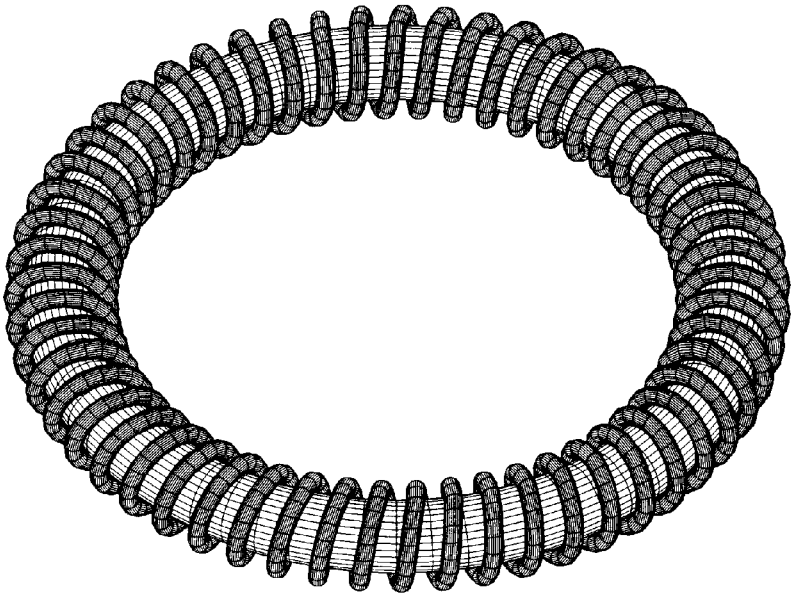
Figure 128:
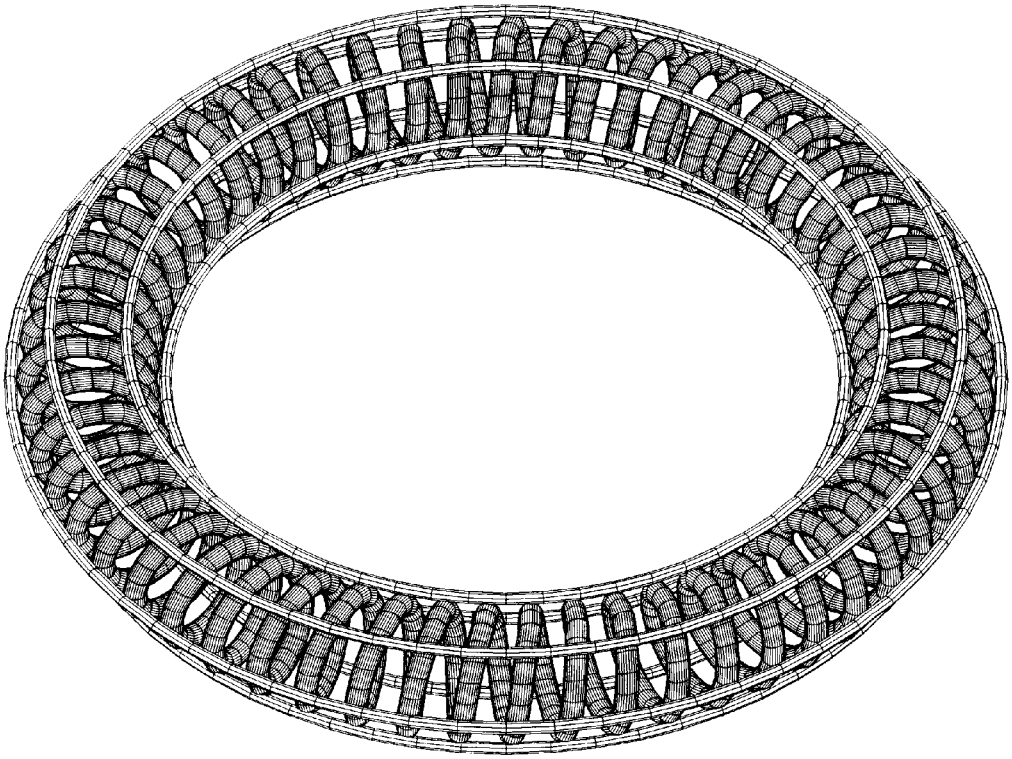
Figure 129:
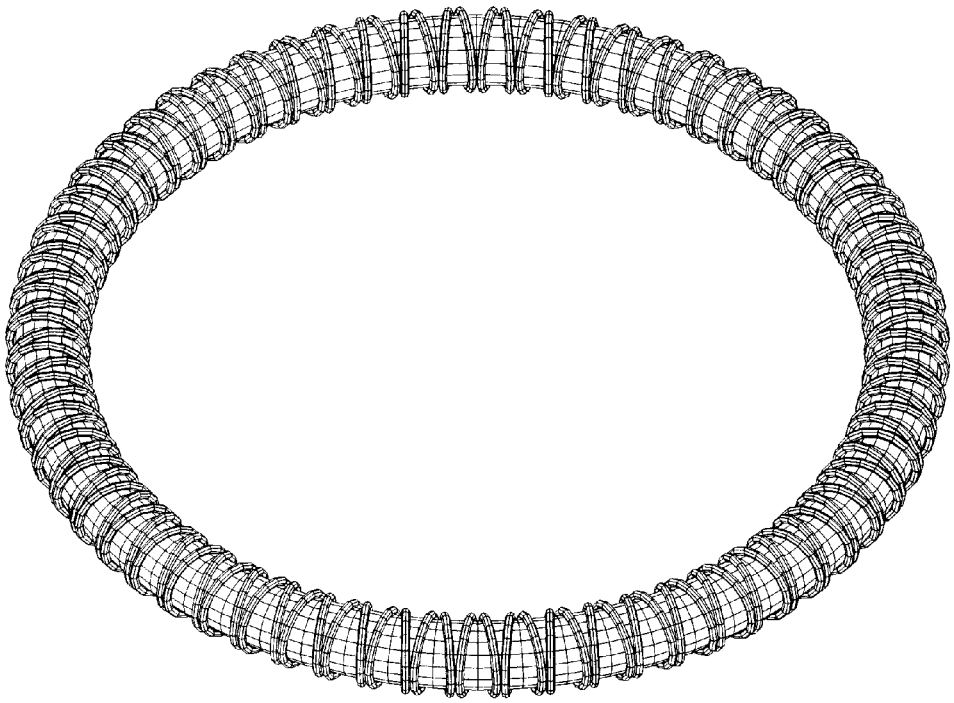
Figure 130:
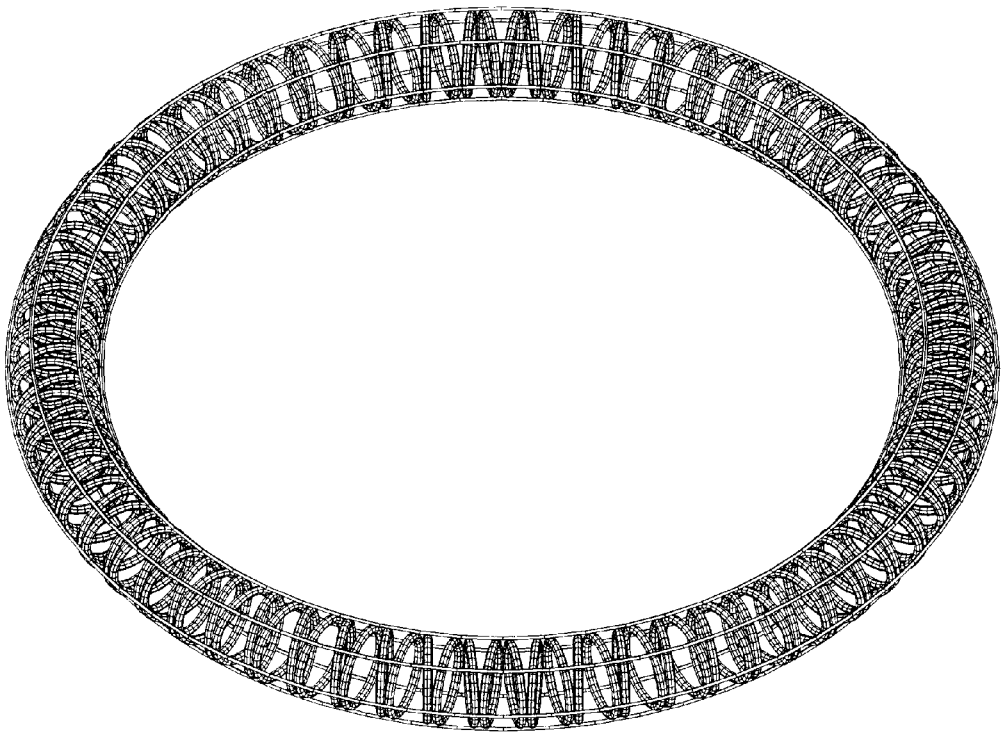
Figure 131:
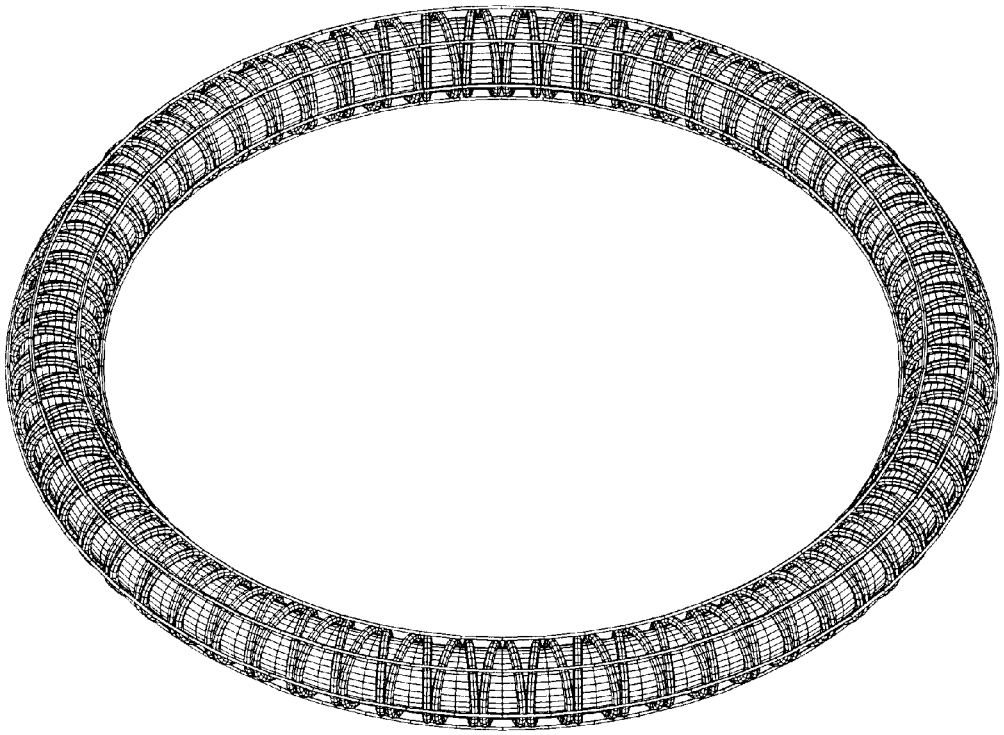

It is possible to construct a toroidal torsion element with a tube defined by a closed circular spiral as shown in FIGS. 122–124, or a multitude of other shapes exemplified in FIGS. 125 and 126. The principal characteristic of this type of toroidal element is that the spiral tube rotates freely about its tubular axis, which is the closed curve within and at the center of the tube, impeded only by internal friction. Such a toroidal spiral can transmit torque about the tubular axis of the tube to any point around the tube, and thereby distribute torsion stress throughout the toroidal element. Such a toroidal spiral can be stabilized by another toroidal element to form a compound element as shown in FIG. 127. Such a toroidal spiral can also be stabilized by toroidal elements connected to the periphery of the tube as shown in FIG. 128, so that the rotation of the spiral about its tubular axis is regulated by the peripheral toroidal elements. The toroidal spiral element may itself be a spiral array of connected torsion elements.

Other torsion elements formed by closed arrays of connected torsion elements can be stabilized and their torsion stress regulated as shown in FIGS. 129–132, as in the case of the toroidal torsion element formed by a spiral, which can be seen by the comparison of FIGS. 127–128 with FIGS. 129–132.

Virtually any shape of torsion element is possible as shown in FIGS. 133–137 and FIGS. 392–397, and may be constructed by either appropriately shaped arrays of torsion elements, or fabricated as fundamental torsion elements.

The combination and orientations in which torsion structural modules may be constructed with the use of couplings is exemplified by the categories shown in FIGS. 154–167. Examples of couplings that can be used to achieve such combinations and orientations are shown in FIGS. 168–173 and FIGS. 192–195 for two-element connections, as shown in FIGS. 1–4, 9–12, 59–60, and 73–76; in FIGS. 174–179 for four-element connections as shown in FIGS. 160–167; and in FIGS. 180–191 for the types of connections shown in FIGS. 154–159.

The spline grip couplings and the corresponding spline collars of toroidal elements are among several other means contemplated for achieving fixed connections between torsion elements and connecting couplings to transmit torsional loading. Examples of such other means are welding, gluing, fusing; the use of fasteners, such as pins, screws and clamps; and the mating of the coupling with a toroidal element of non-circular cross section.

Couplings may also be designed with various mechanical devices for integrated securing against movement of the torsion element held. Some examples of such a coupling is shown in FIGS. 168–173, a split block coupling in which each of the parts of the block, 61 and 63 are fitted with spline grips 62. The manner in which the coupling effects the connection is to close the block sections 61, 63 around the spline collars of the torsion elements to be connected, and bind the block with the compression band 65 tightened into the band groove 64 with a tightening device 66, such as a ratcheted roller on which the compression band is wound.

Similarly the coupling shown in FIGS. 174–179 is a split block coupling in which each of the parts of the block, 71, 73 and 77 are fitted with spline grips 72. The manner in which the coupling effects the connection is to close the block sections 71, 73 and 77 around the spline collars of the torsion elements to be connected, and bind the block with the compression band 75 tightened into the band groove 74 with the tightening device 76.

The coupling shown in FIGS. 180–191 is an open-end coupling in which each of the end caps 83 and 87 and the main body of the coupling 81 are fitted with spline grips 82. The manner in which the coupling effects the connection is to close end caps 83 and 87 around the spline collars of the torsion elements to be connected, and bind the caps to the main body block with the compression bands 85, which are locked to the main body by the lock pins 88 and tightened into the band grooves 84 with the tightening devices 86.

Torsion elements such as 102, 104, 106, 108, and 110 shown in FIGS. 196–201 with spline collars 101, 103, 105, 107 and 109, are those which are connected by the couplings which have spline grips. The spline collars may be integral to the torsion element, or may be attached by a means of bonding the spline collar to the torsion elements or their components, by means of a mechanical linkage within the spline collar, or by or attachment or fastening to the spline collar. If a structural element does not have spline collars attached, other forms of connection are possible, such as with a coupling with form grips, or by internal connection with torsion elements constituting such structural elements.

An example of a split-block coupling with form grips is shown in FIGS. 192–195 for the simplest two element connection as shown in FIGS. 73–76. Form grips can be a structural foam that cures to a permanent shape after being compressed about the torsion element, or a resilient elastic cushion that grips the torsion element. The coupling is caused to grip the torsion element by closing the block sections 91 and 93 around the torsion elements to be connected, so that the form blocks 92 compress and conform to the shape of the torsion elements, moderated by the cushions 94. The block sections of the coupling are then locked in place by either compression bands, as used on the split-block coupling shown in FIGS. 168–173, or other means of fastening the block together, such as screws or bolts.

The formation of structures using the system proceeds from constructions which may be referred to as "structural modules". One basic form of structural module is a connected triangular array of torsion elements shown in FIGS. 202 and 203. Two types of connected linear arrays of the triangular structural module are shown in FIGS. 204–209 which form two different types of rod, beam, or post structures having different structural properties. Connected arrays of such modules form plate or deck structures as shown in FIGS. 210–211. Another basic structural module is the connected cubic array of torsional elements which is shown in FIGS. 212–213, with a connected linear array shown in FIGS. 214–215 forming rod, beam or post structures. Connected arrays of these structures can form plate, deck and joist structures as shown in FIGS. 216–218. As can be seen from some of the examples of possible structural modules in FIGS. 219–230, a wide variation thereof is possible.

FIGS. 231–237 are examples of the more complex structures, such as arches or ribbing, formed when the structural modules shown are connected in arrays, as with the structural module shown in FIG. 229. The closed array in FIG. 231 may also be another form of toroidal torsion element.

Structures may also be formed from polygonal toroidal elements, such as that shown in FIGS. 238–239. The preferred use of such forms is as a body for a complex torsion element having internal shafts for the absorption of torsion stress as shown in FIGS. 240–241, with a reinforced version being shown in FIGS. 242–243. One variation of this type of torsion element is shown in FIGS. 244–246, in which torsion stress is absorbed by multiple internal shafts 112. The shafts 112 are the point region of connection with other elements where they are not enclosed by the polygonal body 111 of the element. The shafts 112 rotate on bearings 114 which are positioned by bearing mounts 113 which are fixedly attached to the body 111. A torque applied to turn the shaft 112 at its point of connection will induce a stress in the shaft 112 if the rotation of the shaft is restricted in some way. In the torsion element shown the shaft 112 to which the torque applied is connected at both ends to other shafts 112 by means of a universal joint 115 which transmits the torque to the other shafts 112. If the rotational motion of any of the shafts 112 are restricted, a torque on the shaft 112 will induce a torsional stress in the shaft 112, and the loading will be transmitted to adjacent shafts 112 by means of the universal joint 115 which connects them. Restriction of motion of a shaft 112 can be provided for by a rotation block 116, which is a means of fixing the end of a shaft 112 to the body 111 or of otherwise resisting rotation so that the end of the shaft 112 will not rotate freely. Such a rotation block 116 may be applied to the ends of a shaft 112 to which the torque may be applied where it is exposed for connection to other torsion elements as in FIGS. 247–248, or to additional shafts 112 as previously discussed, also shown in FIGS. 249–250. If there are no rotational blocks the shafts will be free to rotate. If such free shafts are further connected by universal joints around the sides of the element, as shown in FIGS. 251–252, the torque will be transmitted from the region of application to the other region of connection. Thus rotation induced at one side of the element will be transmitted to the other side of the element without substantial constraint within the element. However, if the movement of the shafts on one side of the element is restricted, as by connection to another torsion element, a torsional load will result and transmitted equally along the connected shafts and torsion stress will be induced therein.

As with other toroidal elements, polygonal torsion elements may be connected in arrays, which may be closed to form a toroidal torsion element as shown in FIGS. 253–258 and 265. The couplings used may be of the split block type shown in FIGS. 259–264. Thus polygonal torsion elements are another means for implementing the invention. Also as with other toroidal torsion elements a wide variation in form and combination is possible with polygonal torsion elements, as shown in FIGS. 266–277, in which polygonal torsion elements are shown that range from the pentagonal (FIGS. 266–269) to the octagonal (FIGS. 270–273) to the nonogonal (FIGS. 274–277) and with the number of sides limited only by the application. FIGS. 278–281 demonstrate the manner in which polygonal torsion elements may be combined with other toroidal torsion elements to form complex toroidal elements with structural features that can be tailored to any structural application. In this last case it should be noted that the toroidal shell enclosing the polygon is partially filled interior to the polygonal torsion element. Such filling can be with the material of the shell, structural foam or other structures, partially or not at all, again, depending on the structural requirements of the application.

In addition to the connections between toroidal elements in which the toroidal torsion elements remain outside of the peripheral tube of the other, previously demonstrated in FIGS. 73–76, 80–83 and 154–167, connections between toroidal torsion elements where one element is within the space surrounded by the tube of another are a useful structural alternative to combination by constructing toroidal elements with coaxial tubes. Such a variation is shown in FIGS. 282–291 where the toroidal torsion elements are coaxial, and in FIGS. 292–311 where the axes of the toroidal elements are angulated with each other.

Certain basic structural forms that are difficult to achieve without significant structural disadvantage using conventional structural systems, are natural using the present invention with no structural disadvantages. Among these are symmetrical spherical frameworks, as shown in FIGS. 312–320, and framework towers, as shown in FIGS. 321–324. Other examples of structures for which toroidal torsion elements are similarly suitable are shown in FIGS. 325–354. All of the simple structural forms demonstrated in FIGS. 312–354 are also useful in combination with each other, for reinforcement, aesthetics, as well as in the design of complex structures.

With regard to the spherical frameworks shown in FIGS. 312–320 another useful structural form is possible with the replication of a section as shown in FIGS. 387–389, and then connecting it in an appropriate scale to a toroidal torsion element forming the spherical surface shown in FIGS. 390–392. The replication of the spherical section shown in FIG. 387 is applied once 141 and then again in smaller scale 142 to the first. This application of the spherical section shown in FIG. 387 can be made in replication to all of the toroidal elements that form the sphere, and yet again and again to all of the toroidal elements that form successive replications, until a practical limit is reached, beyond which the process has no structural efficacy.

Generally, structures such as buildings, bridges, even automobiles, seacraft, airframes and spaceframes are considered to be static structures in accordance with their manner of performance. That is, the expectation of performance for such structures is that they respond to the loads to which they are subjected by adequate management of the stress on the materials used and the means by which the materials are connected to comprise the structure. There are some structures that are built with moving parts, such as a roof that opens by sliding or some other aperture that is created by actuation, manual or otherwise, as in the housing of an astronomical observatory. As stated earlier the present invention also contemplates its application to create a dynamic structure, a structure in which the stress of the materials and their connections are managed by automated actuation of the coupling of torsion elements. Also as stated earlier, this invention contemplates the shifting of the size and shape of structures by actuation of couplings.

An example of an actuated coupling which can perform a fundamental shifting of shape is shown in FIGS. 355–357, in which a motor 135 rotates a bearing 133 supported spline grip 132 by the rotational power it delivers to the drive 136 through the use of a transmission 134. When the motor 135 is powered, the spline grips 132 are driven, in a controlled manner to rotate and thus rotate a torsion element held in a grip in relation to the body 131 of the coupling, as well as any other torsion or toroidal element held in the other spline grip 132. The manner in which the change in shape of a 20 element array can be effected using such actuated couplings is demonstrated in FIGS. 358–360. Couplings such as those described above and shown in FIGS. 355–357 (but not shown in FIGS. 358–360) would connect the toroidal elements, in the region of closest proximity of the elements, and would cause the angulation of the elements to change with sufficient precision so as to achieve the exact shape and size of the resulting toroid required. Such a change of shape or size could be directed to take place in an organized way for all of the torsion elements of the structure, including replicated substructures, which would result in a change of shape or size of the entire structure. An example of such an operation is shown in the schematic series of FIGS. 361–370, where the frame of the surface of the prolate spheroid (FIG. 361) is transformed in stages (FIGS. 362–363) to the frame of the surface of a sphere (FIG. 365) by the changing of the shape of the constituent connected elliptical toroidal elements comprising the frame of the surface of the prolate sphere to more circular toroidal elements. This transformation results in a reduction of the volume bounded by the framework. A further transformation is shown in the schematic series of FIGS. 366–370 where the frame of surface of the sphere (FIG. 365–366) is transformed in stages (FIGS. 367–369) to the frame of the surface of an oblate spheroid (FIG. 370) again by the changing of the shape of the constituent connected toroidal elements comprising the frame of the surface of the sphere to elliptical toroidal elements. This transformation results in an increase in the volume bounded by the framework. A similar but isovolumetric pair of transformations is shown in the series of FIGS. 371–380.

This aspect of the present invention thus demonstrated for spheroids is a general property of the structural system. This can be demonstrated further, schematically, with the transformation of a plane array of connected toroidal torsion elements, schematically shown in three views in FIGS. 381–383, to a connected array of toroidal torsion elements in the surface of a paraboloid, also schematically shown in three views in FIGS. 384–386, by a calculated and controlled changing of the shape of the constituent connected toroidal torsion elements comprising the framework of the plane to more elliptical toroidal torsion elements, variably to form the framework of the paraboloid. Such shape shifting may be used to alter the shape or size of any array of elements, not only those that provide the framework of surfaces.

While the invention has been disclosed in connection with a preferred embodiment, it will be understood that there is no intention to limit the invention to the particular embodiment shown, but it is intended to cover the various alternative and equivalent constructions included within the spirit and scope of the appended claims.

What I claim as my invention is:

1. A structural system of torsion elements comprising:

(a) a plurality of structural elements which function with torsion as a load bearing mode; and (b) means for connecting the structural elements such that the torsional load on one or more of the structural elements is transmitted to one or more of the other of the structural elements to which said one or more of the structural elements is connected, and so that the torsional load on said one or more of the other of the structural elements is in the opposite direction to the torsional load on said one of the structural elements;

with which a structural framework is formed wherein the loading of the structural elements is distributed within the structural framework as torsional stress.

2. The structural system of claim 1 in which the portions of the structural elements within a connection are not coaxially aligned.

3. The structural system of claim 2 in which the means for connecting structural elements is adjustable so that the position of one or more of the structural elements connected by said means for connecting may be changed with respect to other structural elements connected to said one or more of the structural elements by said means for connecting.

4. The structural system of claim 1 in which the means for connecting structural elements is such that a structural element in a connection will not have substantial movement in the connection.

5. The structural system of claim 1 in which the means for connecting structural elements is such that a torsion element having been positioned in a connection will not have substantial movement in the connection.

6. The structural system of claim 1 in which the structural elements function with torsion as the principal load bearing mode.

7. The structural system of claim 1 in which the structural elements each function with a load bearing mode that is at least 50% torsional.

8. The structural system of claim 1 in which the means for connecting structural elements is such that a structural element may be moved in a connection and that such movement will be regulated by the connection.

9. The structural system of claim 1 in which the means for connecting structural elements is such that a structural element may be moved in a connection and that such movement will be regulated by the connection so that the structural element will not thereafter have substantial movement in the connection except as regulated by the connection.

10. The structural system of claim 1 in which the means for connecting structural elements is such that after a structural element is moved in a connection such movement will be regulated by the connection so that the structural element will not have substantial movement in the connection except as regulated by the connection.

11. The structural system of claim 1 wherein one or more of the structural elements are toroidal in shape.

12. The structural system of claim 11 wherein one or more of said structural elements which are toroidal in shape are further comprised of one or more smaller structural elements which function with torsion as a load bearing mode which are connected in an array to form the toroidal shape of said one or more of said structural elements.

13. The structural system of claim 1 in which the means for connecting structural elements is actuated, so that one or more structural elements may be moved by a connection and then held by the connection in the position resulting from such movement so that the structural element will not have substantial movement in the connection unless again moved by the connection.

14. A structural system of torsion elements for constructing frameworks of all sizes, comprising: a plurality of torsion elements, each of which is a structural element which functions with torsion as a load bearing mode, connected so that the torsional load on one or more of the torsion elements is transmitted to one or more of the other of the torsion elements to which said one or more of the torsion elements is connected.

15. The structural system of claim 14 in which the portions of the torsion elements within a connection are not coaxially aligned.

16. The structural system of claim 15 in which one or more connections are adjustable so that the position of one or more of the torsion elements in such a connection may be changed in such a connection with respect to other torsion elements in such a connection.

17. The structural system of claim 14 in which the connections are such that a torsion element in a connection will not have substantial movement in the connection.

18. The structural system of claim 14 in which the connections are such that a torsion element having been positioned in a connection will not have substantial movement in the connection.

19. The structural system of claim 14 in which the elements function with torsion as the principal load bearing mode.

20. The structural system of claim 14 in which the elements each function with a load bearing mode that is at least 50% torsional.

21. The structural system of claim 14 wherein the loading of one or more of the torsion elements in a structure is distributed among one or more of the other torsion elements as torsional stress.

22. The structural system of claim 14 in which the connections are such that a torsion element may be moved in a connection and that such movement will be regulated by the connection so that the torsion element will not thereafter have substantial movement in the connection except as regulated by the connection.

23. The structural system of claim 14 in which the connections are such that after a torsion element is moved in a connection such movement will be regulated by the connection so that the torsion element will not have substantial movement in the connection except as regulated by the connection.

24. The structural system of claim 14 wherein one or more of the torsion elements are toroidal in shape.

25. The structural system of claim 24 wherein one or more of said torsion elements which are toroidal in shape are further comprised of a plurality of smaller torsion elements which are connected in an array to form the toroidal shape of said one or more of said torsion elements.

26. The structural system of claim 14 in which one or more connections are actuated so that one or more torsion elements may be moved by a connection and then held by the connection in the position resulting from such movement so that the torsion element will not have substantial movement in the connection unless again moved by the connection.

27. The structural system of claim 14 in which the torsion elements are connected so that the torsional load on said one or more of the other of the torsion elements is in the opposite direction to that of said one of the torsion elements.

28. A structural system for constructing structural frameworks of all sizes, comprising: a plurality of torsion elements, each of which is a structural element which functions by torsional load bearing, which are connected so that the torsional load on one or more of the torsion elements is transmitted to one or more of the other of the torsion elements to which said one or more of the torsion elements is connected, with which a structural framework is formed wherein the loading of the torsion elements is distributed within the structural framework as torsional stress.

29. The structural system of claim 28, in which one or more connections are adjustable so that the position of one or more of the torsion elements in such a connection may be changed in such a connection with respect to other torsion elements in such a connection.

30. The structural system of claim 28, in which the portions of the torsion elements within a connection are not coaxially aligned.

31. The structural system of claim 28, in which the connections are such that a torsion element having been positioned in a connection will not have substantial movement in the connection.

32. The structural system of claim 28, in which the elements function with torsion as the principal load bearing mode.

33. The structural system of claim 28, in which the torsion elements each function with a load bearing mode that is at least 50% torsional.

34. The structural system of claim 28, in which the connections are such that a torsion element may be moved in a connection and that such movement will be regulated by the connection.

35. The structural system of claim 28, in which the connections are such that a torsion element may be moved in a connection and that such movement will be regulated by the connection so that the torsion element will not thereafter have substantial movement in the connection except as regulated by the connection.

36. The structural system of claim 28, in which the connections are such that after a torsion element is moved in a connection such movement will be regulated by the connection so that the torsion element will not have substantial movement in the connection except as regulated by the connection.

37. The structural system of claim 28 wherein one or more of the torsion elements are toroidal in shape.

38. The structural system of claim 37 wherein one or more of said torsion elements which are toroidal in shape are further comprised of a plurality of smaller torsion elements which are connected in an array to form the toroidal shape of said one or more of said torsion elements.

39. The structural system of claim 28, in which one or more connections are actuated so that one or more torsion elements may be moved by a connection and then held by the connection in the position resulting from such movement so that the torsion element will not have substantial movement in the connection unless again moved by the connection.

40. The structural system of claim 28 in which the torsion elements are connected so that the torsional load on said one or more of the other of the torsion elements opposes the torsional load on said one of the torsion elements.

41. A method for constructing frameworks of all sizes with torsion elements comprising: connecting a plurality of torsion elements to form a framework so that the torsional load on one or more of the torsion elements is transmitted to the other torsion elements to which said one or more of the torsion elements is connected, wherein the loading of the torsion elements is distributed within the framework as torsional stress.

42. The method for constructing frameworks of claim 41 wherein the torsion elements are connected so that the torsional load on said other torsion elements is in the opposite direction to the torsional load on said one or more of the torsion elements.

43. The method for constructing frameworks of claim 41 wherein said structure is formed according to a plan for said structure.

44. The method for constructing frameworks of claim 41 further comprising a first step of fabricating a plurality of torsion elements.

45. A system for constructing frameworks of all sizes, comprising:

(a) a plurality of torsion elements; and (b) means for connecting the torsion elements such that the torsional load on one or more of the torsion elements is transmitted to one or more of the other of the torsion elements to which said one or more of the torsion elements is connected;

wherein the loading of the torsion elements is distributed within a framework as torsional stress.

46. The system for constructing frameworks of all sizes of claim 45 wherein one or more of the torsion elements are toroidal in shape.

47. The system for constructing frameworks of all sizes of claim 46 wherein one or more of said torsion elements which are toroidal in shape are further comprised of a plurality of smaller torsion elements which are connected in an array to form the toroidal shape of said one or more of torsion elements.

* * * * *